US005580468A

United States Patent [19]

Fujikawa et al.

[11] Patent Number: 5,580,468

[45] Date of Patent: Dec. 3, 1996

[54] METHOD OF FABRICATING HEAD FOR RECORDING APPARATUS

[75] Inventors: Takashi Fujikawa, Kawasaki; Asao Saito; Makoto Shibata, both of Yokohama; Junichi Kohayashi, Ayase; Hirokazu Komuro, Yokohama; Isao Kimura, Kawasaki; Kenji Hasegawa, Kawasaki; Teruo Ozaki, Kawasaki, all of Japan

[73] Assignee: Canon Kabushiki Kaisha, Tokyo, Japan

[21] Appl. No.: 543,658

[22] Filed: Oct. 16, 1995

Related U.S. Application Data

[62] Division of Ser. No. 418,160, Apr. 6, 1995, Pat. No. 5,479,197, which is a continuation of Ser. No. 912,164, Jul. 10, 1992, abandoned.

[30] Foreign Application Priority Data

| | | | |
|---|---|---|---|
| Jul. 11, 1991 | [JP] | Japan | 3-170857 |
| Jul. 12, 1991 | [JP] | Japan | 3-172552 |
| Jul. 12, 1991 | [JP] | Japan | 3-172569 |
| Jul. 16, 1991 | [JP] | Japan | 3-175244 |
| Oct. 23, 1991 | [JP] | Japan | 3-275522 |

[51] Int. Cl.[6] ..... B44C 1/22

[52] U.S. Cl. ..... 216/27; 216/18

[58] Field of Search ..... 216/16, 18, 27, 216/39, 56; 156/644.1, 656.1, 657.1; 346/1.1, 140 R; 29/827, 852; 427/97

[56] References Cited

U.S. PATENT DOCUMENTS

| | | | |
|---|---|---|---|
| 4,313,124 | 1/1982 | Hara | 346/140 |
| 4,345,262 | 8/1982 | Shirato et al. | 346/140 |
| 4,417,251 | 11/1983 | Sugitani | 346/1.1 |
| 4,459,600 | 7/1984 | Sato et al. | 346/140 |
| 4,463,359 | 7/1984 | Ayata et al. | 346/1.1 |
| 4,558,333 | 12/1985 | Sugitani et al. | 346/140 |
| 4,723,129 | 2/1988 | Endo et al. | 346/1.1 |
| 4,740,796 | 4/1988 | Endo et al. | 346/1.1 |
| 4,936,952 | 6/1990 | Komuro | 216/27 |
| 5,030,317 | 7/1991 | Noguchi | 156/630 |
| 5,036,897 | 8/1991 | Tamura et al. | 216/27 |
| 5,081,474 | 1/1992 | Shibata et al. | 346/140 R |

FOREIGN PATENT DOCUMENTS

| | | |
|---|---|---|
| 54-56847 | 5/1979 | Japan . |
| 59-123670 | 7/1984 | Japan . |
| 59-138461 | 8/1984 | Japan . |
| 60-71260 | 4/1985 | Japan . |
| 61-125858 | 6/1986 | Japan . |

*Primary Examiner*—William Powell

*Attorney, Agent, or Firm*—Fitzpatrick, Cella, Harper & Scinto

[57] ABSTRACT

A head for an ink jet recording apparatus including: an electro-thermal transducer for generating thermal energy for use to discharge ink; and a circuit portion electrically connected to the electro-thermal transducer, wherein the circuit portion has a first conductive layer, an insulating layer disposed on the first conductive layer, and a second conductive layer disposed on the insulating layer, and an opening portion of the insulating layer is filled with a conductor formed by a selective deposition method so that the first conductive layer and the second conductive layer are connected to each other.

9 Claims, 32 Drawing Sheets

METHOD OF FABRICATING HEAD FOR RECORDING APPARATUS

This application is a division of application Ser. No. 08/418,160, filed Apr. 6, 1995, now U.S. Pat. No. 5,479,197, which is a continuation application of application Ser. No. 07/912,164, filed Jul. 10, 1992, now abandoned.

BACKGROUND OF THE INVENTION

1. Field of the Invention

The present invention relates to a head for an ink jet recording apparatus, and more particularly to a head having a thermal energy generating means and a method of fabricating the same.

2. Description of the Prior Art

Among a variety of the conventional recording methods, a so-called liquid jet recording method (ink jet recording method) is an extremely advantageous recording method because this method is a non-impact recording method satisfactorily free from generation of noise at the time of the recording operation, capable of performing the high speed recording operation and recording data on the plain paper without a special fixing treatment. A variety of methods have been suggested and some of them have been commercialized but some of them are under the research performed for putting them into practical use.

The liquid jet recording method is a method in which a droplet which is a recording liquid called "ink" is jetted by any of a variety of principles and ink is allowed to adhere to a recording medium such as paper so that recording is performed.

Also, the applicant of the present invention has a novel method relating to the liquid jet recording method has been suggested in U.S. Pat. No. 4,723,129. The basic principle of this method is as follows: thermal pulses are, as information signals, given to recording liquid introduced into a working chamber capable of keeping recording liquid; recording liquid communicated to the working chamber is discharged through a liquid discharge opening to jet as a small droplet by the working force generated during a process in which recording liquid generates vapor bubbles; and then the small droplet is allowed to adhere to the recording medium.

The above-mentioned method can be easily adapted to a high density multi-array configuration capable of performing the high speed recording and the color recording operations. Furthermore, since the structure of the apparatus employed is to simpler as compared with the conventional structure, the overall size of the recording head can be reduced and it is suitable to be mass-produced. In addition, the advantages obtainable from the IC technology and the microelectronic machining technology, which have been significantly advanced in the semiconductor field, can be satisfactorily utilized, so that the overall length can be elongated. As described above, the aforesaid method displays wide applicability.

A typical recording head for a liquid jet recording apparatus adapted no the above-mentioned liquid jet recording method has a thermal energy generating means for forming jetting droplets by discharging recording liquid from the liquid discharge opening.

FIGS. 2 and 3 illustrate the structure of the thermal energy generating means for the conventional recording head, where FIG. 2 is a plan view and FIG. 3 is a cross sectional view taken along line 3—3 of FIG. 2. Referring to FIG. 3, reference numeral 21 represents a silicon (Si) substrate. The Si substrate 21 has a heat regenerating layer 2 made of $SiO_2$ for regenerating heat and accomplishing electrical insulation, the heat regenerating layer 2 being formed on the Si substrate 21. The heat regenerating layer 2 is formed by, for example, oxidizing the surface of the Si substrate with heat or it may be layered on the surface of the Si substrate 21 by sputtering or the like. The heat regenerating layer 2 has, on the surface thereof, a heat-generating resistance layer 3 made of $HfB_2$ or the like by, for example, sputtering to have a predetermined thickness. The heat-generating resistance layer 3 has Al electrodes 14 formed on the surface thereof by sputtering or the like to have a predetermined thickness, and is formed into a predetermined shape by the photolithography technology. The portions of the heat-generating resistance layer 3 positioned between the Al electrodes 14 are exposed to outside. The exposed portions serve as heat generating portions 18 for generating heat due to electricity supplied from the Al electrodes 14. The above-mentioned Al electrodes and the heat generating portions 18 form electro-thermal transducers. Each of the electro-thermal transducers has recessed portions formed due to the gap between the heat generating portions 18 and the Al electrodes 14.

Each of the aforesaid electro-thermal transducers has, on the surface thereof, ink-resisting protection layer 7 in order to protect electric corrosion taking place due to the contact of the above-mentioned elements with ink. The ink-resisting protection layer 7 is usually formed into a two-layer structure as shown in FIG. 3. In this example, the protection layer 7 is composed of a lower layer 8 made of $SiO_2$ for shielding the heat generating portions 18 from ink, and an upper layer 9 made of Ta serving as a cavitation-resisting layer which withstands the cavitation generated when ink bubbles disappear. If necessary, a layer (omitted from illustration) made of tantalum oxide for improving the strength for adhering Ta placed between the upper and the lower protection layers 8 and 9 may be formed.

FIG. 4 is a cross sectional view which illustrates a junction for connecting the electro-thermal transducers. The electrode 14 and the electric line 4 are connected to each other via a contact hole 5.

However, the conventional structure experiences the following problems because of its structure arranged in such a manner that the Al wiring 4 is formed in a region in which the contact hole has a large stepped portion. (1) In a case where the heat-generating resistance layer or the electrodes and the electric line are formed on the substrate by a high density of, for example, about 400 dpi to 1000 dpi for the purpose of performing precise recording operations with high image quality, the electric lines must be thinned considerably and therefore the stepped portion of the protection layer 8 becomes too large and steeply, resulting in the accuracy in the operation of machining the electric lines and the reliability to deteriorate. Furthermore, the covering facility of the Al wiring in the contact hole is unsatisfactory. What is worse, Al is undesirably formed into polycrystal and therefore, if a high density electric current is passed through it, a phenomenon in which the metal atoms in the wiring move undesirably, that is, electromigration, takes place. The electromigration will cause a void to be generated along the grain boundary of the crystal, a problem of coarse grains to arise, or hillocks or whiskers to be enlarged. As a result, the heat is undesirably generated at the electric wire the electric wire will be welded and broken because the cross sectional area of the electric wire is reduced excessively due to the enlargement of the void. (2) In a case where the contact hole 5 is formed inside an ink chamber 12, the unsatisfactory covering facility will cause the ink and the electric wire to come in contact with each other. As a result, corrosion or an electrolysis takes place.

SUMMARY OF THE INVENTION

An object of the present invention is to provide a recording head capable of overcoming the above-mentioned problems, and exhibiting excellent migration resistance and satisfactory reliability.

Another object of the present invention is to provide a recording head arranged in such a manner that the surface of the substrate on which the electro-thermal transducers are formed is flattened.

Another object of the present invention is to provide a head for an ink jet recording apparatus comprising:

an electro-thermal transducer for generating thermal energy for use to discharge ink; and a wiring portion electrically connected to the electro-thermal transducer, wherein the wiring portion has a first conductive layer, an insulating layer disposed on the first conductive layer, and a second conductive layer disposed on the insulating layer, and an opening portion of the insulating layer is filled with a conductor formed by a selective deposition method so that the first conductive layer and the second conductive layer are connected to each other.

Another object of the present invention is to provide a head for an ink jet recording apparatus comprising:

an electro-thermal transducer for generating thermal energy for use to discharge ink; and a wiring portion electrically connected to the electro-thermal transducer, wherein the wiring portion has a substrate having a conductive surface serving as a first conductive layer, an insulating layer formed on the substrate and a heat-generating resistance layer formed on the insulating layer and serving as a second conductive layer, and an opening portion of the insulating layer is filled with a conductor formed by a selective deposition method so that the conductive surface and the heat-generating resistance layer are connected to each other.

Another object of the present invention is to provide a head for an ink jet recording apparatus comprising:

an electro-thermal transducer for generating thermal energy for use to discharge ink; and a wiring portion electrically connected to the electro-thermal transducer, wherein the wiring portion has a substrate having a semiconductor surface, an insulating layer formed on the substrate, and a heat-generating resistance layer formed on the insulating layer, and an opening portion of the insulating layer is filled with a conductor formed by a selective deposition method so as to be connected to the heat-generating resistance layer.

Another object of the present invention is to provide a head for an ink jet recording apparatus comprising:

an electro-thermal transducer for generating thermal energy for use to discharge ink; and a wiring portion electrically connected to the electro-thermal transducer, wherein the wiring portion has a substrate having a semiconductor surface, an insulating layer formed on the substrate, and a heat-generating resistance layer formed on the insulating layer, a pair of openings of the insulating layer are filled with conductors formed by a selective deposition method, and the heat-generating resistance layer is connected to the conductors.

Another object of the present invention is to provide a head for an ink jet recording apparatus comprising:

an electro-thermal transducer for generating thermal energy for use to discharge ink; and a wiring portion electrically connected to the electro-thermal transducer, wherein the wiring portion has a pair of recesses formed in a substrate having an insulating surface, a pair of substantially flat conductors with respect to the surface and respectively embedded in a pair of the recesses, and a heat-generating resistance layer formed on a pair of the conductors and a portion of the surface, and a pair of the conductors are formed by a selective deposition method.

Another object of the present invention is to provide a head for an ink jet recording apparatus comprising:

an electro-thermal transducer for generating thermal energy for use to discharge ink; and a wiring portion electrically connected to the electro-thermal transducer, wherein the wiring portion has a heat-generating resistance layer formed on a substrate, a pair of conductive layers formed on the heat-generating resistance layer, an insulating layer formed on a pair of the conductive layers, an opening portion formed in the insulating layer, and a conductor formed in the opening portion by a selective deposition method, and the conductor is layered on a pair of the conductive layers.

Another object of the present invention is to provide a head for an ink jet recording apparatus comprising:

an electro-thermal transducer for generating thermal energy for use to discharge ink; and a wiring portion electrically connected to the electro-thermal transducer, wherein a first and a second protection layers are formed on the electro-thermal transducer, members connected to the second protection layer via the first insulating layer are disposed on the two sides of the electro-thermal transducer, and the members are formed by a selective deposition method.

Another object of the present invention is to provide a head for an ink jet recording apparatus comprising:

an electro-thermal transducer for generating thermal energy for use to discharge ink; and a wiring portion electrically connected to the electro-thermal transducer, wherein a first and a second protection layers are formed on the electro-thermal transducer and members connected to the second protection layer via the first insulating layer are disposed on the two sides of the electro-thermal transducer.

The above-mentioned head can be manufactured by a method of fabricating a head for an ink jet recording apparatus having an electro-thermal transducer for generating thermal energy for use to discharge ink, and a wiring portion electrically connected to the electro-thermal transducer, which comprises:

forming a first conductive layer on a substrate;

forming an insulating layer on the first conductive layer;

forming an opening portion in the insulating layer in which at least a portion of the conductive layer is exposed therethrough;

forming a conductor in the opening portion by a selective deposition method; and forming a second conductive layer on the insulating layer and the conductive layer and connecting the first conductive layer and the second conductive layer to each other.

The above-mentioned head can be manufactured by a method of fabricating a head for an ink jet recording apparatus having an electro-thermal transducer for generating thermal energy for use to discharge ink, and a wiring portion electrically connected to the electro-thermal transducer, which comprises the steps of:

forming an insulating layer on a substrate having a conductive surface;

forming an opening portion in the insulating layer in which the conductive surface is exposed therethrough;

embedding a conductor in the opening portion by a selective deposition method;

forming a heat-generating resistance layer on the conductor and a portion of the insulating layer to electrically connect the conductive surface to the heat-generating resistance layer; and forming a conductive layer connected to the heat-generating resistance layer on the insulating layer.

The above-mentioned head can be manufactured by a method of fabricating a head for an ink jet recording apparatus having an electro-thermal transducer for generating thermal energy for use to discharge ink, and a wiring portion electrically connected to the electro-thermal transducer, which comprises the steps of:

forming a plurality of semiconductor regions defined by semiconductor junctions on the surface of a semiconductor substrate;

forming an insulating layer on the semiconductor substrate;

forming a plurality of opening portions in the insulating layer in each of which the semiconductor regions is exposed therethrough;

embedding conductors in the opening portions of the insulating layer by a selective deposition method; and forming a heat-generating resistance layer on a portion of the conductor and a portion of the insulating layer.

The above-mentioned head can be manufactured by a method of fabricating a head for an ink jet recording apparatus having an electro-thermal transducer for generating thermal energy for use to discharge ink, and a wiring portion electrically connected to the electro-thermal transducer, wherein the wiring portion has a substrate having the surface of a semiconductor, an insulating layer formed on the substrate, and a heat-generating resistance layer formed on the insulating layer, and a pair of opening portions of the insulating layer are filled with conductors formed by a selective deposition method so that the heat-generating resistance layer is connected to the conductor.

The above-mentioned head can be manufactured by a method of fabricating a head for an ink jet recording apparatus having an electro-thermal transducer for generating thermal energy for use to discharge ink, and a wiring portion electrically connected to the electro-thermal transducer, which comprises the steps of:

forming a pair of recessed portions in a substrate having an insulating surface;

forming a pair of conductors in a pair of the recessed portions by a selective deposition method, a pair of the conductors being substantially flat with respect to the surface; and forming a heat-generating resistance layer on a pair of the conductors and a portion of the surface.

The above-mentioned head can be manufactured by a method of fabricating a head for an ink jet recording apparatus having an electro-thermal transducer for generating thermal energy for use to discharge ink, and a wiring portion electrically connected to the electro-thermal transducer, which comprises the steps of:

forming a heat-generating resistance layer on a substrate;

forming a pair of conductive layers on the heat-generating resistance layer;

forming an insulating layer on a pair of the conductive layers;

forming an opening portion in the insulating layer in which at least portion of the conductive layer is exposed therethrough; and forming a conductor in the opening portion by a selective deposition method.

The above-mentioned head can be manufactured by a method of fabricating a head for an ink jet recording apparatus having an electro-thermal transducer for generating thermal energy for use to discharge ink, and a wiring portion electrically connected to the electro-thermal transducer, which comprises the steps of:

forming an undercoat layer on a substrate on the two sides of the heat-generating resistance layer for defining the electro-thermal transducer at an interval;

selectively depositing a conductor on the undercoat layer; and forming a protection layer on the conductor.

It is preferable that the selective deposition method is a chemical vapor deposition method.

It is preferable that the method further comprises a step of injecting ink into an ink storing portion.

It is preferable that the above-mentioned head be arranged in such a manner that the conductor is metal mainly composed of aluminum.

It is preferable that the above-mentioned head has an ink chamber for storing ink, and a plurality of ink discharge ports communicated with the ink chamber.

It is preferable that the above-mentioned head be arranged in such a manner that the head discharges ink in a direction substantially parallel to the heat generating surface of the electro-thermal transducer.

It is preferable that the above-mentioned head be arranged in such a manner that the head discharges ink in a direction substantially intersecting the heat generating surface of the electro-thermal transducer.

It is preferable that the above-mentioned head has an ink chamber and ink stored in the chamber.

The above-mentioned head constitutes an ink jet recording apparatus when it is combined with means for holding a recording medium at the recording position.

Other and further objects, features and advantages of the invention will appear more fully from the following description.

DESCRIPTION OF THE PREFERRED EMBODIMENTS

A method of fabricating a recording head according to the present invention is characterized in that a selective deposition method is employed.

Specifically, the selective deposition method is employed in the process of forming at least a portion of the electrodes of the electro-thermal transducer or a process of forming a member provided for flattening the surface of the substrate.

That is, the deposit is selectively formed in only portions, in which recesses are formed if the conventional method is employed, so that the generation of excessive projections and pits on the surface can be prevented.

[First Embodiment]

The method of fabricating the recording head according to one aspect of the present invention includes: a process for forming a heat-generating resistance layer for supplying thermal energy to recording liquid for the purpose of discharging the recording liquid to the surface of a substrate; a process for forming electrodes made of electron-supplying material so as to be electrically connected to the heat generating resistance layer; and a process for selectively forming a metal film in a through hole which reaches the electrode on the protection layer by a selective deposition method.

Figure 5:
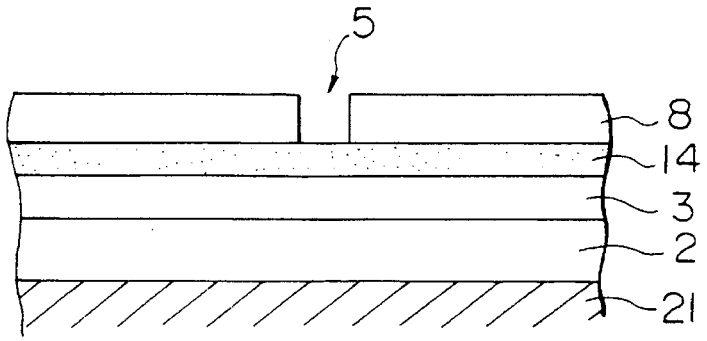
FIG. 5 is a schematic cross sectional view which illustrates a process of manufacturing the junction of the recording head according to a first embodiment of the present invention.

FIG. 5 is a cross sectional view which illustrates a portion called a contact hole or a through hole formed in a substrate of the recording head.

First, a heat accumulating layer 2 is formed on a supporting member 21 made of an Si wafer. The protection layer 2 may be made of a transition metal compound oxide such as titanium oxide, vanadium oxide, niobium oxide, molybdenum oxide, tantalum oxide, tungsten oxide, chrome oxide, zirconium oxide, hafnium oxide, lanthanum oxide, yttrium oxide, manganese oxide; a metal oxide such as aluminum oxide, calcium oxide, strontium oxide, barium oxide, silicon oxide and their complex, a high resistance nitride such as silicon nitride, aluminum nitride, boron nitride, tantalum nitride and their oxide; and a semiconductor such as a thin film material exemplified by amorphous silicon, a amolphous selenium which has a small resistance in a state where it is in the form of a bulk but which can be brought to a large resistance material by the sputtering method, the CVD method, the evaporating method, the gas-phase reaction method and the liquid coating method. The thickness of the protection layer is usually 0.1 μm to 5 μm, preferably 0.2 μm to 3 μm.

Then, the heat-generating resistance layer 3 is formed. General materials may be employed as the material for forming the heat-generating resistance layer if it is able to desirably generate heat when supplied with electricity.

As the material of the above-mentioned type, the following materials are exemplified: a tantalum nitride, nichrome, silver-palladium alloy, silicon semiconductor, or a boride of hafnium, lanthanum, zirconium, titanium, tantalum, tungsten, molybdenum, niobium, chromium, or vanadium or the like.

The metal boride is exemplified as a preferable material for forming the heat-generating resistance layer among the above-mentioned materials. In particular, hafnium boride has the most significant characteristics, and zirconium boride, lanthanum boride, tantalum boride and vanadium boride are exemplified as having the significant characteristics following the hafnium boride in this sequential order.

The heat-generating resistance layer 3 can be formed by using the above-mentioned material by the electron beam evaporation method, or the sputtering method, or the like.

On the above-mentioned heat-generating layer 3, a first electrode 14 which is electrically connected to the heat-generating layer 3 is formed. As the material for forming the first electrode 14, metal the main component of which is Al, Au, Ag, or Cu, or the like may be employed. The selected material is used to form the electrode 14 by the sputtering method or the electron beam evaporating method.

Then, a protection film 8 is formed by using a material similar to that for the heat regenerating layer 2 by the sputtering method or the CVD method. Then, a contact hole 5 is formed by etching (see FIG. 5).

Figure 6:
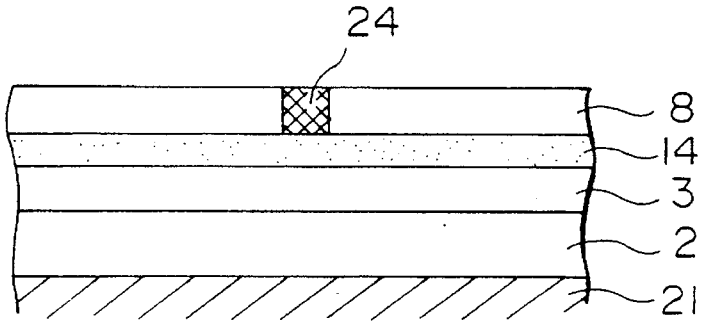
FIG. 6 is a schematic cross sectional view which illustrates a process of manufacturing the junction of the recording head according to a first embodiment of the present invention.

Then, an Al portion 24 is selectively formed in the contact hole 5 by a selective CVD method (see FIG. 6). As a result of observation of a state where the film is enlarged, the Al portion 24 is enlarged perpendicular to the Al film 14 made of the material which supplies electrons, but the same is not formed in the $SiO_2$ layer 2 made of the material which does not supply the electron.

Then, the Al film 4, which becomes a second electrode, is formed by the electron beam evaporating method, and then it is removed by etching while leaving a required portion.

Figure 7:
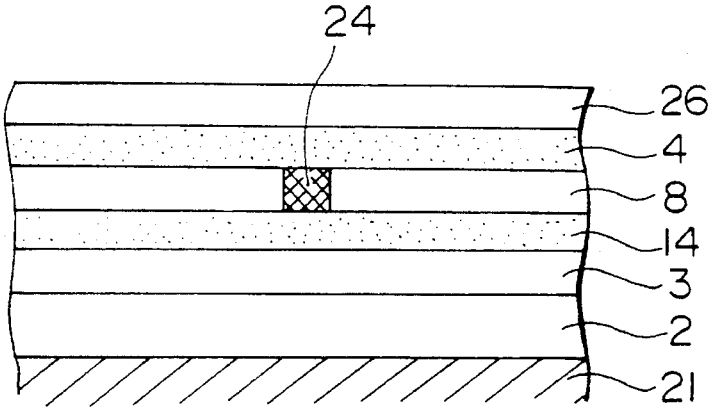
FIG. 7 is a schematic cross sectional view which illustrates a process of manufacturing the junction of the recording head according to a first embodiment of the present invention.

Finally, a protection film 26 made of material such as $SiO_2$, $Al_2O_3$ or $Si_3N_4$ exhibiting excellent ink-shielding characteristics is formed on the electrode in order to prevent the electric corrosion and oxidation effected by the recording liquid (see FIG. 7).

Figure 8:
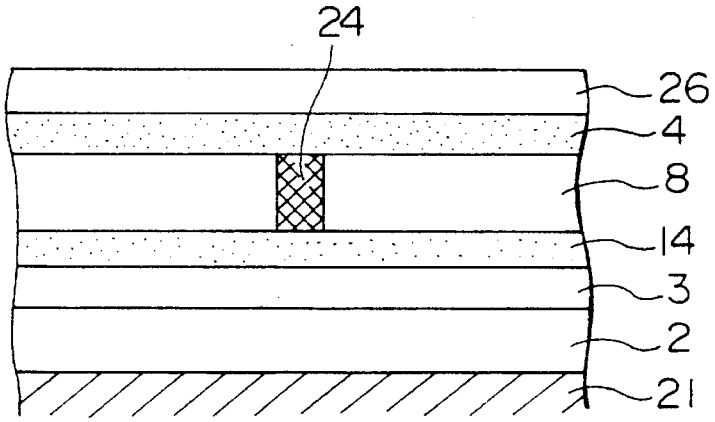
FIG. 8 is a schematic cross sectional view which illustrates a process of manufacturing the junction of the recording head according to a first embodiment of the present invention.

Since Al is selectively deposited on the Al layer by employing the selective CVD method, Al is not deposited on the side surface of the $SiO_2$ layer 8 even if the through hole has a large aspect ratio as shown in FIG. 8 but it is vertically deposited on the bottom of the Al electrode 14. Therefore, an excellent step coverage can be obtained by forming Al to have the same thickness as that of the second protection layer ($SiO_2$ layer) 8.

Figure 3:
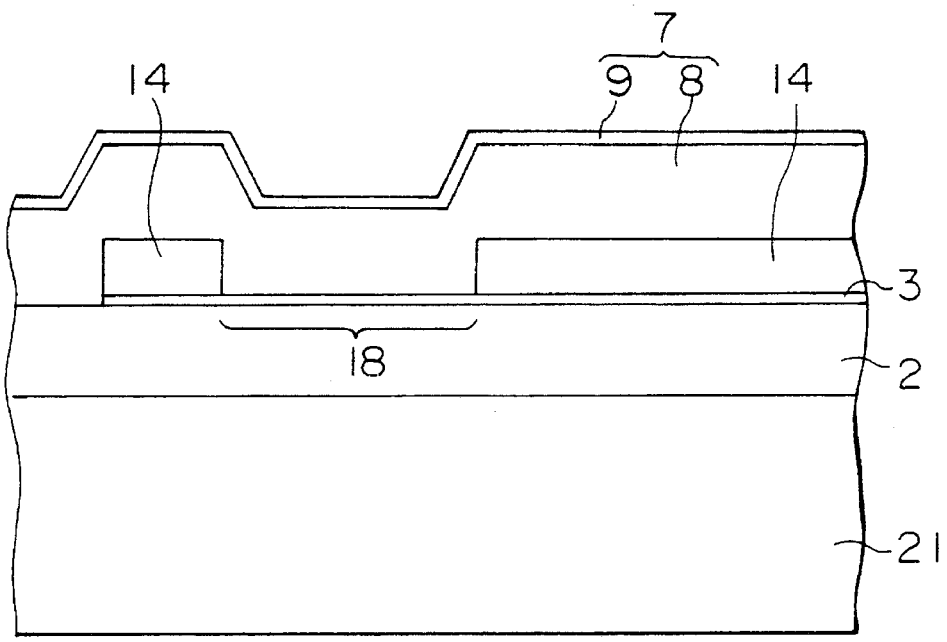
FIG. 3 PRIOR ART
FIG. 3 is a schematic cross sectional view taken along line 3—3 of FIG. 2.
Figure 4:
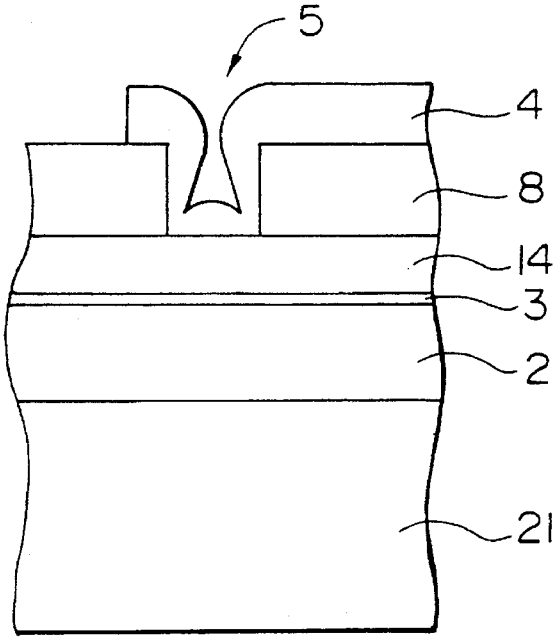
FIG. 4 PRIOR ART
FIG. 4 is a schematic cross sectional view which illustrates a junction of the conventional recording head.

The elements shown in FIG. 4 and given the same reference numerals are the similar elements as those shown in FIG. 3.

Then, a cavitation-resisting layer may be formed in order to improve the durability against the mechanical shock taken place when the vapor bubbles disappear, the cavitation-resisting layer being made of metal such as Al, Ta, Zr, Hf, V, Nb, Mg, Si, Mo, W, Y or La and their alloys, or their oxides, carbides, nitrides or borides or the like.

Although no particular illustration is made here, each electrode has an exposure portion made by a method such as bonding method in order to be connected to the outside of the device. Furthermore, the heat-generating resistance layers may be arranged to have a shape and the size with which the object can be achieved and each of the same may be varied in the shape and the size.

Figure 9:
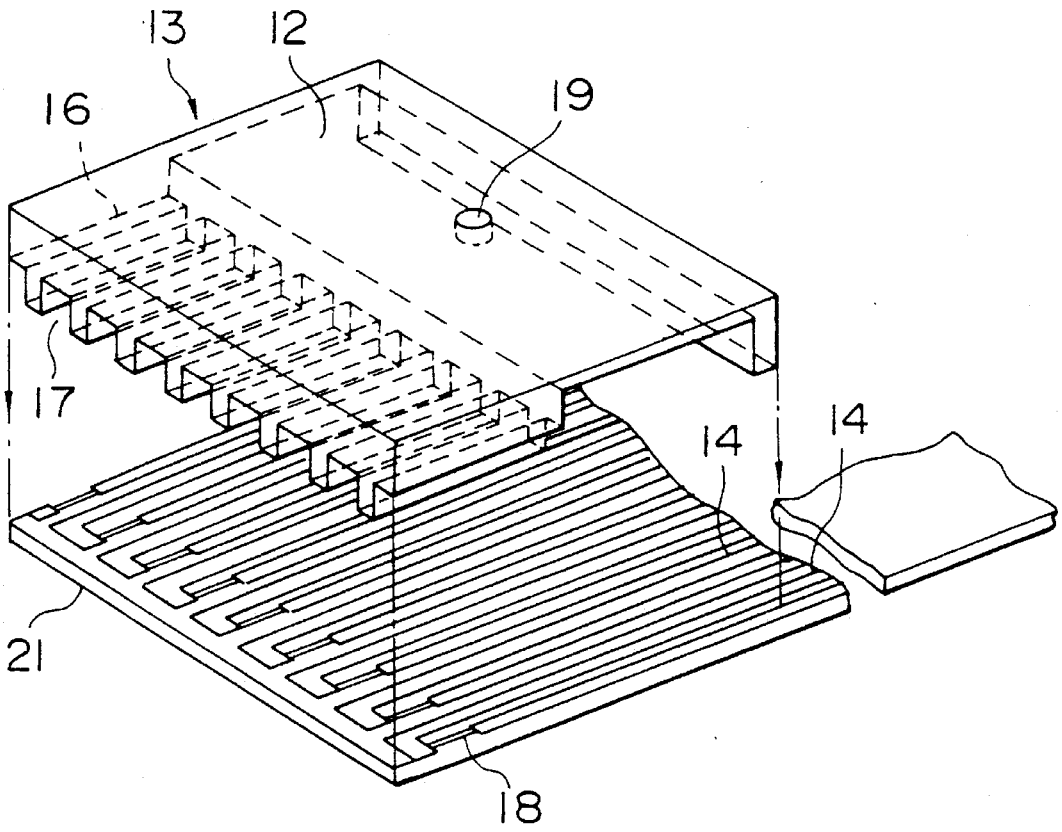
FIG. 9 is a schematic view which illustrates a process of fabricating the recording head according to the first embodiment of the present invention.

FIG. 9 is an exploded perspective view which illustrates the recording head.

Figure 10:
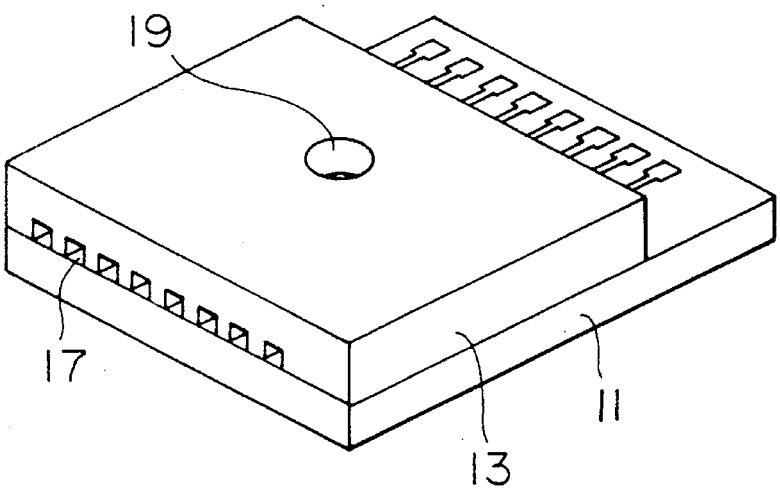
FIG. 10 is a schematic and perspective view which illustrates the recording head according to the first embodiment of the present invention.

Then, a heater 18 having the heat-generating layer for supplying thermal energy to the recording liquid for the purpose of discharging the recording liquid and a pair of electrodes 14 for supplying electric energy to the heater 18 are formed on the recording head substrate 21. Grooves serving as ink passages 16 which act as the working chambers are formed in the ceiling board 13. The ink passages 16 are communicated with an ink liquid chamber 12 to which ink is supplied through an ink supply port 19. At this time, ink discharge ports 17 and a recording head substrate 21 must accurately align to each other after locating has been made. Thus, the recording head formed as shown in FIG. 10 is manufactured. Furthermore, a lead substrate (omitted from illustration) is provided for each of the electrodes 14 for the purpose of applying a desired pulse signal from outside the recording head, so that an electric connection is established.

The ink discharge port 17 may be made of a photosensitive material such as a photosensitive resin film or photosensitive glass which can be machined. As an alternative to this, it may be formed by forming a groove in a proper flat plate such as glass by a mechanical method or etching and by applying the flat plate to the recording head substrate. At this time, the ink liquid chamber 12 and the ink supply port 19 and the like may be integrally manufactured.

A specific method for forming the ink discharge port by using the photosensitive material has been disclosed in U.S. Pat. No. 4,417,251, the method being arranged in such a manner that grooves serving as the ink passages are formed in the recording head substrate by forming a solid region by subjecting a photosensitive composition layer formed on the surface of a recording head substrate to a pattern exposure and the non-solidified composition is removed from the photosensitive composition layer. The aforementioned method may be employed to form the ink chamber and the ink discharge port.

As an alternative to this, the ceiling board of the recording head may be manufactured in such a manner that the substrate is covered with a photosensitive resin, a glass ceiling board is placed and connected to the photosensitive resin, unnecessary portions of the photosensitive resin are removed to form the ink discharge port, the ink passages and a common liquid chamber by the photosensitive resin (U.S. Pat. No. 5,030,317).

As described above, according to this embodiment, Al or the Al alloy is deposited in the through hole formed in the protection layer by the selective CVD method and therefore a flattened substrate can be easily manufactured. Furthermore, by controlling the time in which Al or the Al alloy is formed, the thickness of the Al film or the Al alloy film can be arbitrarily determined. Therefore, the undesirable stepped portion can be eliminated by arranging the thickness of the Al film or the Al alloy film to be as the thickness of the protection layer, causing the step coverage can be necessarily improved.

Furthermore, the stepped portion formed in the through hole by the conventional method can be eliminated and the above-mentioned portion can be flattened, so that thickness of the ink resisting protection film can be reduced. As a result, the responsivity of thermal transfer of the ink can be improved, resulting in the discharge characteristics being improved.

In addition, the aspect ratio of the through hole portion can be enlarged to a value larger than 1, the through hole pattern can be fined.

Furthermore, the durability of the recording head substrate can be improved and therefore and the yield can be improved, so that a low cost recording head can be manufactured.

[Second Embodiment]

A method for fabricating the recording head substrate according to another aspect of the present invention comprises the steps of: a process for forming a heat regenerating layer made of material which does not supply electrons on a substrate made of material which supplies electrons; a process for forming a through hole which penetrates the heat regenerating layer to reach the substrate; a process for forming a flat portion having substantially the same thickness as that of the heat regenerating layer by selectively depositing metal in the through hole by a selective deposition method; and a process for forming, in the flat portion, a heat-generating resistance layer electrically connected to the substrate via the metal for supplying thermal energy to recording liquid so as to discharge the recording liquid.

According to this embodiment, the stepped portion which disturbs the flow of the recording liquid can be eliminated in the direction in which the recording liquid flows. Therefore, the recording liquid can be discharged smoothly and the height of the stepped portion of the protection layer, which corresponds to the electrode line, can be lowered. As a result, the performance of the protection layer can be maintained even if the heat-generating resistance layer and the electric line for the electrode are formed at high density.

In addition, since the surface of the through hole can be flattened and smoothed, the heat-generating resistance layer formed in this through hole can be freed from cracks.

Then, the present invention will now be described with reference to the drawings.

Figure 11:
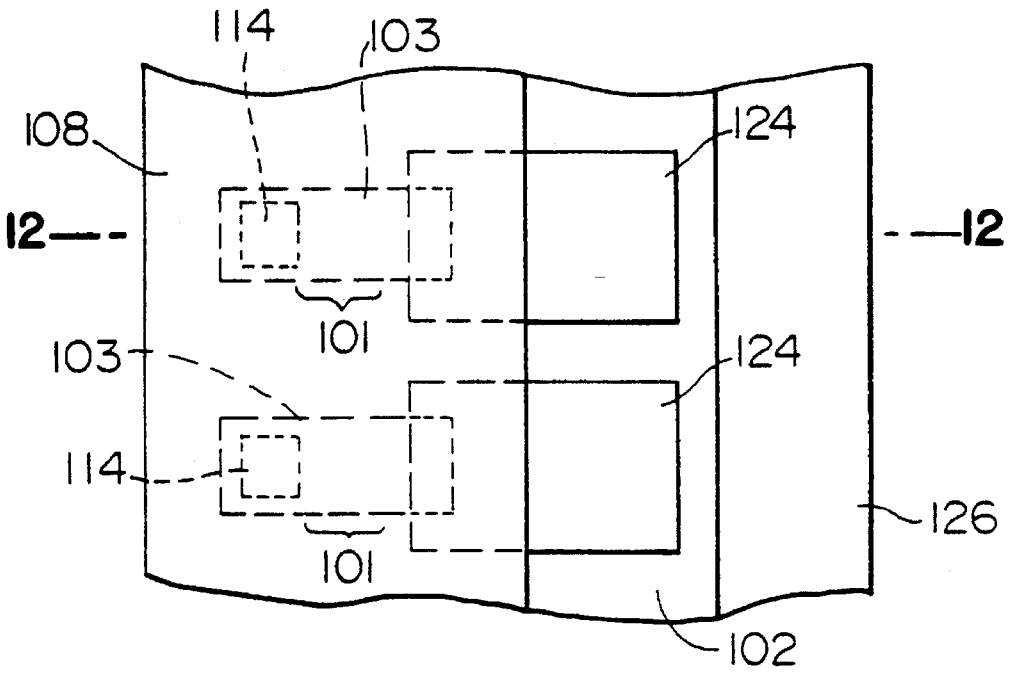
FIG. 11 is schematic top view which illustrates a recording head according to a second embodiment of the present invention.
Figure 12:
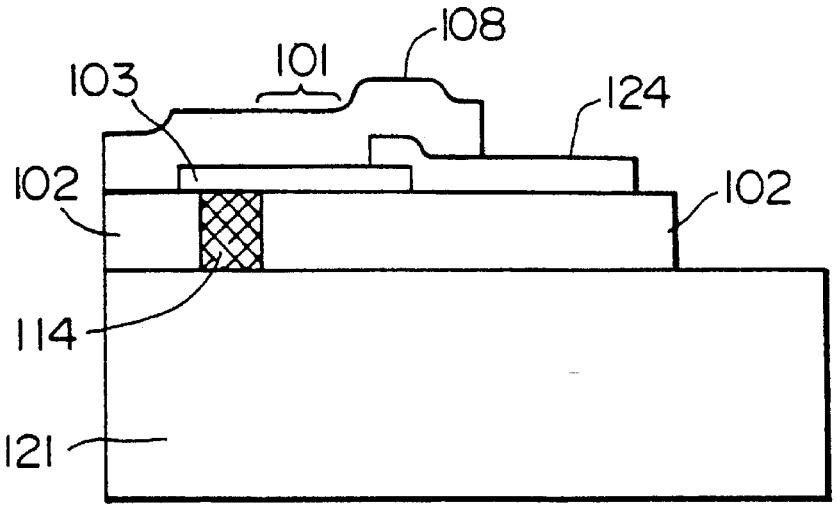
FIG. 12 is a schematic cross sectional view taken along line 12—12 of FIG. 11.

FIGS. 11 and 12 respectively are a plan view and a cross sectional view of an ink jet recording head according to the present invention.

Referring to FIGS. 11 and 12, reference numeral 108 represents a protection layer for protecting heat-generating resistance layers 103 made of a NiCr alloy or a medal boride such a ZrB2 or HfB2 and individual electrodes 124 from contact with recording liquid. Reference numeral 114 represents a common electrode embedded in a contact hole by the selective CVD method and 102 represents a heat regenerating layer for effectively transferring heat generated due to an application of electricity to the heat-generating resistance layer 103 to a heat acting surface 101. The heat regenerating layer 102 is made of an insulating material such as $SiO_2$. Reference numeral 126 represents a metal substrate serving as the common electrode for the heat-generating resistance layer 103. Referring to FIG. 12, the rear portion of the individual electrode 124, that is, the portion which is not covered with the protection layer 108, becomes an electrode pad portion of a bonding wire (omitted from illustration) to be connected to an electrically driving circuit for driving the ink jet recording head.

Then, the method of fabricating the recording head according to this embodiment will now be described with reference to FIGS. 13(*a–e*).

The heat regenerating layer 102 is formed on the conductive substrate 121, and a through hole is formed by etching (see FIG. 13A). The material for making the substrate 121 must be a conductive material exemplified by Al, stainless steel or, glass or a resin having a thin film made of Al, Cu, Ag, Mo, or W, or the like on the surface thereof. As the heat regenerating layer, any of the materials and the method described in the first embodiment may be employed.

Then, metal 114 is selectively deposited in the through hole by the selective deposition method (see FIG. 13B).

The heat-generating resistance layer 103 is formed on the metal 114 and a heat regenerating layer 102*a*, and then patterning is performed by etching (see FIG. 13C).

In order to form the electrode 124, a conductive film is deposited, and then patterning is performed by etching (see FIG. 13D).

If necessary, a protection layer 108 is formed (see FIG. 13E). As a result, the recording head substrate is manufactured.

The protection layer and the electrode or the heat-generating resistance layer and the like can be formed by using the same material and the same method as that for the above-mentioned first embodiment.

Then, the ceiling board is applied by a similar method as to that employed in the first embodiment.

Figure 14:
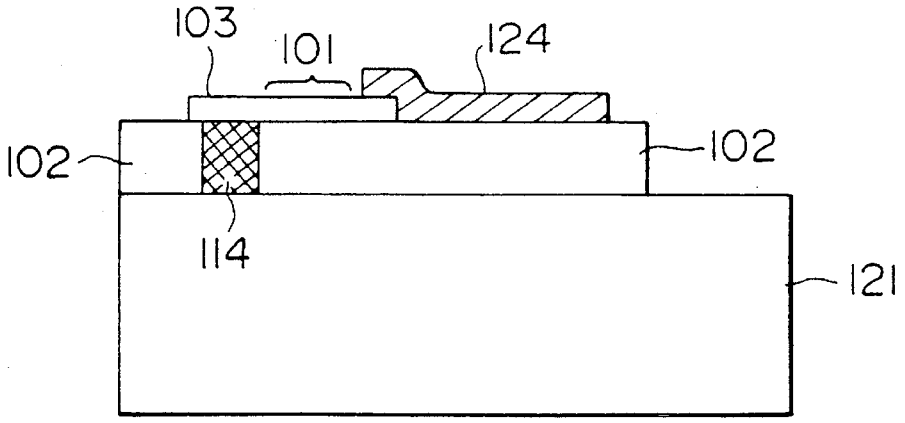
FIG. 14 is a schematic cross sectional view which illustrates a recording head according to another embodiment of the present invention.

In a case where the recording head has no protection layer 108, the substrate arranged as shown in FIG. 14 and the ceiling board are connected to each other.

[Third Embodiment]

The third embodiment of the present invention was found on the basis of a knowledge that a novel recording head can be manufactured by utilizing the characteristics of the selective deposition method.

That is, the recording head substrate according to this embodiment comprises: a device-separated type substrate in which a region containing a second conductive impurity is formed in a substrate made of a material which supplies electrons and contains a first conductive impurity; and a protection layer formed on the device-separated type substrate, having a recess which reaches the aforesaid region, and made of a material which does not supply electrons, wherein metal is deposited in the recess.

More specifically, the same comprises: a device-separated type substrate in which a region containing a second conductive impurity is formed in a substrate made of a material which supplies electrons and contains a first conductive impurity; and a protection layer formed on the device-separated type substrate, having a recess which reaches the aforesaid region, and made of a material which does not supply electrons, wherein metal is deposited in the recess, the same further comprises: a recording head substrate having a heat-generating resistance layer connected to the above-mentioned metal and acting to supply thermal energy for discharging recording liquid to the recording liquid; and a discharge port forming member formed on the recording head substrate and having an opening through which recording liquid is discharged by utilizing thermal energy supplied from the heat-generating resistance layer.

The method of fabricating a recording head according to the present invention comprises the steps of: a process in which a second conductive impurity is doped in a substrate containing a first conductive impurity and having electron-supplying characteristics; a process in which a device-separated region is formed in the substrate by doping the first conductive impurity; a process in which for forming an opening which reaches the device-separated region by patterning the substrate; and a process in which metal is selectively deposited in the opening by a selective deposition method.

Hitherto, the electric line in the recording head having the heat-generating resistor device formed on the same substrate thereof, a patterned Al evaporated film has been used. The reason for this lies in its total advantages obtainable in viewpoints of conductivity, facility in performing the wire bonding method, machining facility and cost reduction.

The Al evaporated film is formed by a physical evaporating method such as the vacuum evaporating method, sputtering method, or the electron beam evaporating method, or the like. However, the formed Al particles are formed into the multi-crystal structure, causing a boundary between particles and grain boundary to be present as compared with the single crystal. Therefore, the resistance ratio is too high and therefore a phenomenon in which metal atoms in the electric lines are moved, that is, the electromigration takes place when a high density electric current ($1\times10^5$ A/cm$^2$) is passed. The electromigration will finally cause the disconnection of the electric wire after it has gone through the following process:

(1) The Al atoms in the electric wire are moved due to the collision and dispersion of the high density electron flows and therefore voids are generated along the crystal grain boundary.

(2) The voids are aggregated and coarsened. Hillocks or whiskers are enlarged in a portion in which Al atoms are gathered (portion adjacent to the anode as compared with the voids)

(3) The electric wire generates heat due to the reduction in the cross sectional area of the electric wire due to the enlargement of the voids, causing the electric wire to be melted and broken.

The factors affecting the aforesaid electromigration can be listed as follows:

(1) Length and the width of the electric wire

Since the cause of the failures taken place due to the electromigration has statical characteristics because the failures depend upon the defects present in the film, the failures take place randomly in the lengthwise direction of the electric wire. Therefore, the longer the length of the electric wire is, the more the probability of the occurrence of the failure rises. The life is shortened expotentially by lengthening the length of the electric wire and it is saturated at a certain length.

If the width of the electric wire is wide, the void generated due to the electromigration is enlarged in the lateral direction of the electric wire, causing the time taken to a moment at which the electric wire is broken to be elongated. However, the width of the electric wire becomes substantially the same as the particle size, causing the dispersion of the grain boundary to be reduced and therefore the life is elongated. The life is, of course, elongated in proportion to the cross sectional area on the viewpoint of the density of the electric current. In this case, it is preferable that the width of the electric line be enlarged as much as possible in the limit present in the space so as to enlarge the cross sectional area rather than thickening the electric line because of the evaporation of the insulating film and the surface coverage.

(2) Temperature of the electric wire

Since the electromigration is accelerated at high temperature, restricting the rise in the temperature of the electric wire is one of the methods of preventing the electromigration. It is an important factor that the circuit must be designed in such a manner that the resistance of the electric line film is lowered so as to lower the self-generation of heat of the film and the diffusion resistance, the heat generation in the portion surrounding the PN junctions and the heat sink of the ground substrate are considered.

(3) Crystal structure

In order to improve the structure of the metal film, it is the most important thing to enlarge the particle size. It causes the following two effects:

(i) Since the electromigration mainly causes the diffusion of the grain boundary, the life can be lengthened by lowering the density of the crystal grain boundary.

(ii) Since crystal orientations of grains having a large size are aligned in a direction <111>, the discontinuity in the electric line is reduced and therefore the electromigration is restricted.

The crystal structure of the metal film depends upon the apparatus for forming the thin film and the forming conditions (the temperature, the degree of vacuum, and the evaporating speed, and the like). In general, the large diameter can be realized by lowering the evaporating speed, or raising the temperature of the base layer, or performing a heat treatment after the evaporation process has been completed.

As a result of experiments, it can be found that the large diameter can be realized and the life can be lengthened by the electron beam evaporating method as compared with the sputtering evaporation method. Since the sputtering evaporation method depends upon the temperature of the substrate, the particle size becomes dispersed and the life is shortened if the temperature of the base layer is lowered.

(4) Addition of other chemical elements

Addition of other elements to the Al thin film is the best method to improve the life against the electromigration. Hitherto, Cu, Ti, Ni, Co and Cr have been found as the elements which contribute to lengthening the life against the electromigration.

The effect to restrict the electromigration obtainable from the addition of the elements concerns the grain boundary diffusion. The addition of the elements decreases the number of the vacancies depending upon the grain boundary. As a result, the diffusion facility in the grain boundary deteriorates and therefore the life against the electromigration can be lengthened. A multiplicity of researches have been about the addition of Cu, resulting a knowledge to be found that Cu can be easily moved as compared with Al atoms and therefore Cu deposits as θ particles. As a result, the electromigration taken place due to the grain boundary diffusion of Al can be restricted.

(5) Surface coverage and surface treatment

The integrated circuit is usually arranged in such a manner that the protection film is formed on the metal electric line film. An arrangement in which the metal film of the above-mentioned type is covered with an insulating derivative is a method to prevent the electromigration. There have been reported $SiO_2$, anode oxidized alumina, SiN (nitriding film) up to now. The effect obtainable from covering with the derivative can be considered that the addition of mechanical stress prevents the surface diffusion and the enlargement of hillock and therefore the enlargement of the void is prevented.

(6) Flattening

In a case of the flat circuit, voids and hillocks are randomly generated in the lengthwise direction. On the other hand, the voids and the hillocks are concentrated in the stepped portion in a case of the stepped circuit. If the step coverage in the stepped portion is unsatisfactory, the cross sectional area of the Al electric line in the stepped portion becomes reduced and therefore the density of the electric currents in the subject portion is raised. As a result, the life against the electromigration can be excessively shortened.

(7) Multi-layer Circuit

In order to highly integrate the circuit and raise the density, a multi-layer structure with the Al electric wire has been employed. The factors different from the conventional circuit, the stepped portion disposed in the lower portion of the circuit, the through hole and the mutual interference between the different Al electric wires.

A necessity for the through hole lies in flattening the structure. If the through hole is formed into a flattened shape having reduced dispersion, the conventional single-layer circuit and the electromigration phenomenon can be treated similarly. The fact that the dispersion is reduced means the failures are taken place in the lengthwise direction due to the electromigration and therefore the life depends upon the number of the through holes.

The mutual interference between different layers is the short circuit between the layers which is taken place due to the electromigration and in which the insulating film is separated and thin Al hillocks are enlarged.

(8) Contact portion

In a contact portion in which Si and Al come in contact with each other, a phenomenon in which Si is diffused in Al and a phenomenon in which Si is deposited are taken place.

As a result of the high temperature treatment, Si is supplied into Al up to the solid solubility limit at the treatment temperature, causing alloyed Al to be introduced into the Si substrate. Therefore, an alloy spike is generated. If the alloy spike is generated, the leak current from the PN junction formed in Si is increased. In order to prevent the generation of the alloy spike, it is feasible to employ a method in which Si is previously contained in the Al electric line so as to prevent the diffusion of Si into the Al electric wire, or to employ another method in which metal having a high melting point is used as barrier metal.

In a case where the electromigration taken place due to the supply of electric currents and generated in the contact portion, the two facts must be considered in which Al is moved and Si is solidified into Al. In inverse proportion to the size of the contact portion, the density of the electric currents is raised in the contact portion and Al and Si contained in Al is moved to the anode due to the electromigration. If the density of Si in Al is lowered, Si present in the contact surface is solidified into Al and voids are formed in the Si substrate, causing the contact resistance to be enlarged. If the junction is formed in a shallow portion, the leak current is enlarged. The enlargement of the contact resistance is in inverse proportion to the area of the contact. In order to prevent the enlargement of the contact resistance and to prevent the leak from the junction, a method may be employed in which a barrier layer is formed between Al and Si. The barrier metal is exemplified by Ti, W, Pt and palladium.

As a result of the considerations thus made, the failures due to the electromigration can be prevented by employing any one of the following methods:

A method in which the width of the Al electric wire is enlarged;

A method in which a circuit for lowering the density of the electric currents is used; or A method in which a heat-generating device is not positioned near the electric line having a high electric current density.

However, with the above-mentioned method, the desire of fining the electric line and raising the mounting density cannot be met.

However, according to the third embodiment, a single-crystal metal wiring can be employed in the recording head substrate. Therefore, the resistance value can be decreased as compared with polycrystal Al prepared by the conventional electron beam evaporating method or the sputtering method, and the grain boundary is not present and no hillocks and voids are generated. As a result, electromigration resistance can be improved. Consequently, the electric line can be fined and high density mounting can be accomplished.

Then, the third embodiment will now be described with reference to the drawings.

FIGS. 15 to 21 are schematic cross sectional views which illustrate the process of fabricating the recording head according to the present invention.

Figure 15:
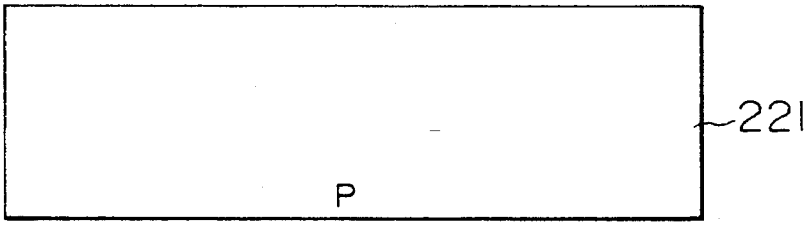
FIG. 15 is a schematic view which illustrates a process of fabricating a recording head according to a third embodiment of the present invention.

First, boron is doped into a substrate made of silicon by a quantity of $1\times10^{16}/cm^3$, so that a P-type dope Si substrate 221 is fabricated (see FIG. 15). In a case where doping is performed by, for example, the gas-phase method, a rarefied dopant gas is usually mixed with the gas to be supplied. The P-type dopant gas is exemplified by $B_2H_6$ (diborane), boron tribromide, methyl borate, and boron trichloride. It is preferable to determine the quantity of doping to be $10^{14}$ to $10^{18}/cm^3$. In a case where the gas doping operation is performed, the density of the gas to be supplied and the carrier density in the grown layer are in proportion in a wide range. Therefore, usually, the density of the gas to be supplied adjusted so as to realize the target carrier density depending upon the result of an examination previously made about the relationship between the gas density and the carrier density. However, if the doping density is very high, the carrier density shows a saturation tendency and therefore it is not always in proportion to the quantity to be supplied. The reason for this lies in the presence of the highest density to be determined by the solid solution limit of the dopant in Si. If the density is too low ($<10^{14}/cm^3$), it is difficult to control the quantity of doping. The reason for this lies in an introduction of undesired impurities due to automatic doping operation or from the gas or the apparatus. Therefore, the doping can be easily controlled when it is ranged from $10^{14}$ to $10^{18}/cm^3$.

Figure 16:
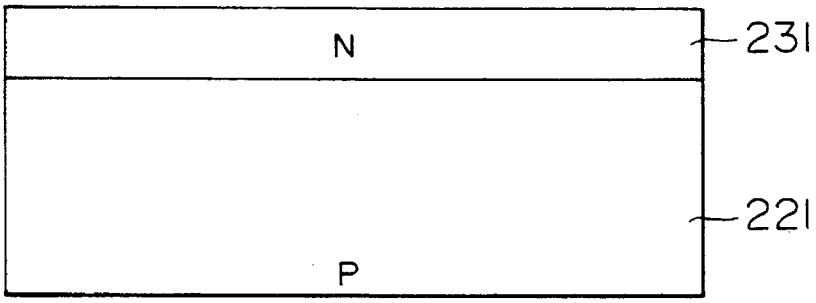
FIG. 16 is a schematic view which illustrates a process of fabricating the recording head according to the third embodiment of the present invention.

The P-type dope Si substrate 221 is subjected to doping of P at $10^{16}/cm^3$ by the thermal diffusion method or the epitaxial method so that an N-type dope Si region 231 is formed near the surface (see FIG. 16). The N-type dopant gas is exemplified by $PH_3$ (phosfine), $AsH_3$ (arsine), red phosphorus, phosphorus pentaoxide, ammonium phosphate, phosphorus oxychloride and phosphorus tribromide.

Figure 17:
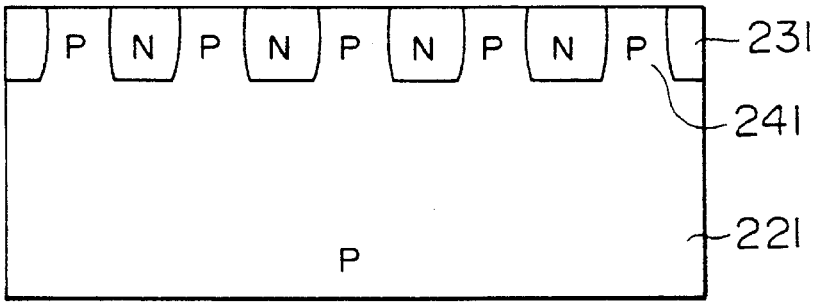
FIG. 17 is a schematic view which illustrates a process of fabricating the recording head according to the third embodiment of the present invention.

Then, the P-type impurities are diffused by the thermal diffusion method or the ion injection method so as to form a device separated region in which the P-type layer 241 reaches the base P-type dope Si substrate 221 and which is electrically separated (see FIG. 17).

Then, the insulating protection film 208 is formed and may be made of the material as that employed in the aforesaid first embodiment. It may be also formed by the heat oxidation method, the sputtering method, the CVD method, the evaporating method, the gas-phase reaction method or the liquid coating method, or the like. It is preferable that the thickness of the insulating protection film 208 be 0.1 μm to 5 μm, preferably 0.2 μm to 3 μm. According to this embodiment, an $SiO_2$ film 208 is formed by the heat oxidation method to have a thickness of 10,000 Å.

Figure 18:
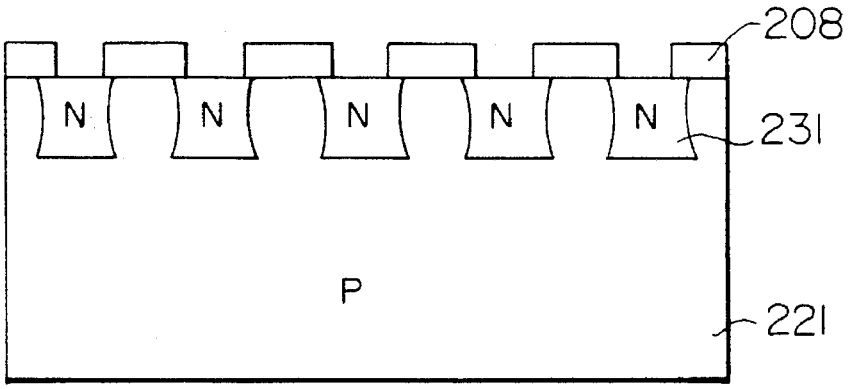
FIG. 18 is a schematic view which illustrates a process of fabricating the recording head according to the third embodiment of the present invention.

Then, patterning of only a required portion of the electric line is performed by the photolithography method or the like so as to cause the surface of the N-type dope Si region 231 to appear outside (see FIG. 18).

Figure 19:
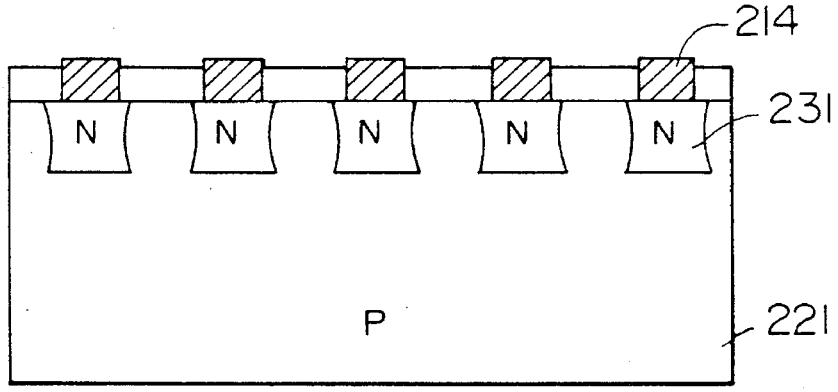
FIG. 19 is a schematic view which illustrates a process of fabricating the recording head according to the third embodiment of the present invention.

Then, an Al layer 214 is selectively formed in a portion in which the surface of the N-type dope Si region 231 appears outside by a CVD method in which DMAH and hydrogen are used (see FIG. 19). Since the N-type dope Si region 231 is made of an electron-supplying material, Al is selective enlarged in only the N-type dope Si region 231, but Al is not deposited on the $SiO_2$ film 4 which is made of the material which does not supply electrons. Therefore, even if the aspect ratio (the depth of the groove/the diameter of the groove) is too large, Al is selectively deposited on the N-type dope Si region 231. It leads to a fact that the each of the electric lines can be fined satisfactorily. Furthermore, since Al in the form of single crystal is obtained by the above-mentioned CVD method, it is different from the polycrystal Al obtainable from the conventional evaporating method or the sputtering method. As a result of this, the resistance ratio of Al can be lowered and therefore high density electric currents can be allowed to pass. Consequently, excellent electromigration resistance can be accomplished.

Figure 20:
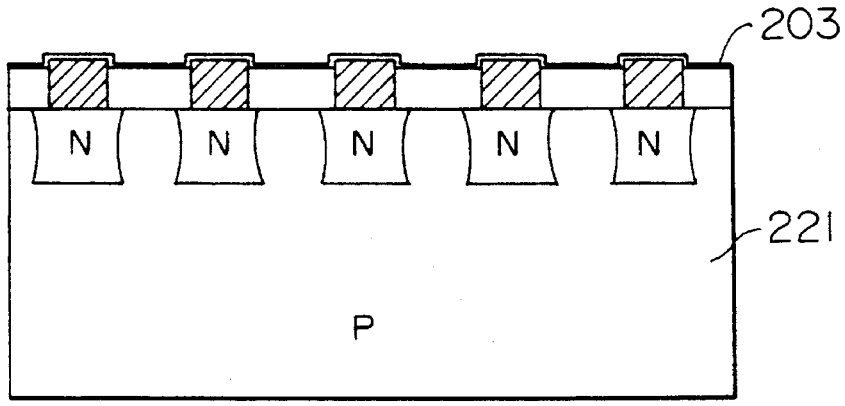
FIG. 20 is a schematic view which illustrates a process of fabricating the recording head according to the third embodiment of the present invention.

Then, a heat-generating resistance layer 203 is formed (see FIG. 20). The heat-generating resistance layer 203 may be made of the major portion of the materials if desired heat can be generated when the material is supplied with electricity.

As the material of this type, the materials listed in the description made about the first embodiments may be employed.

Figure 21:
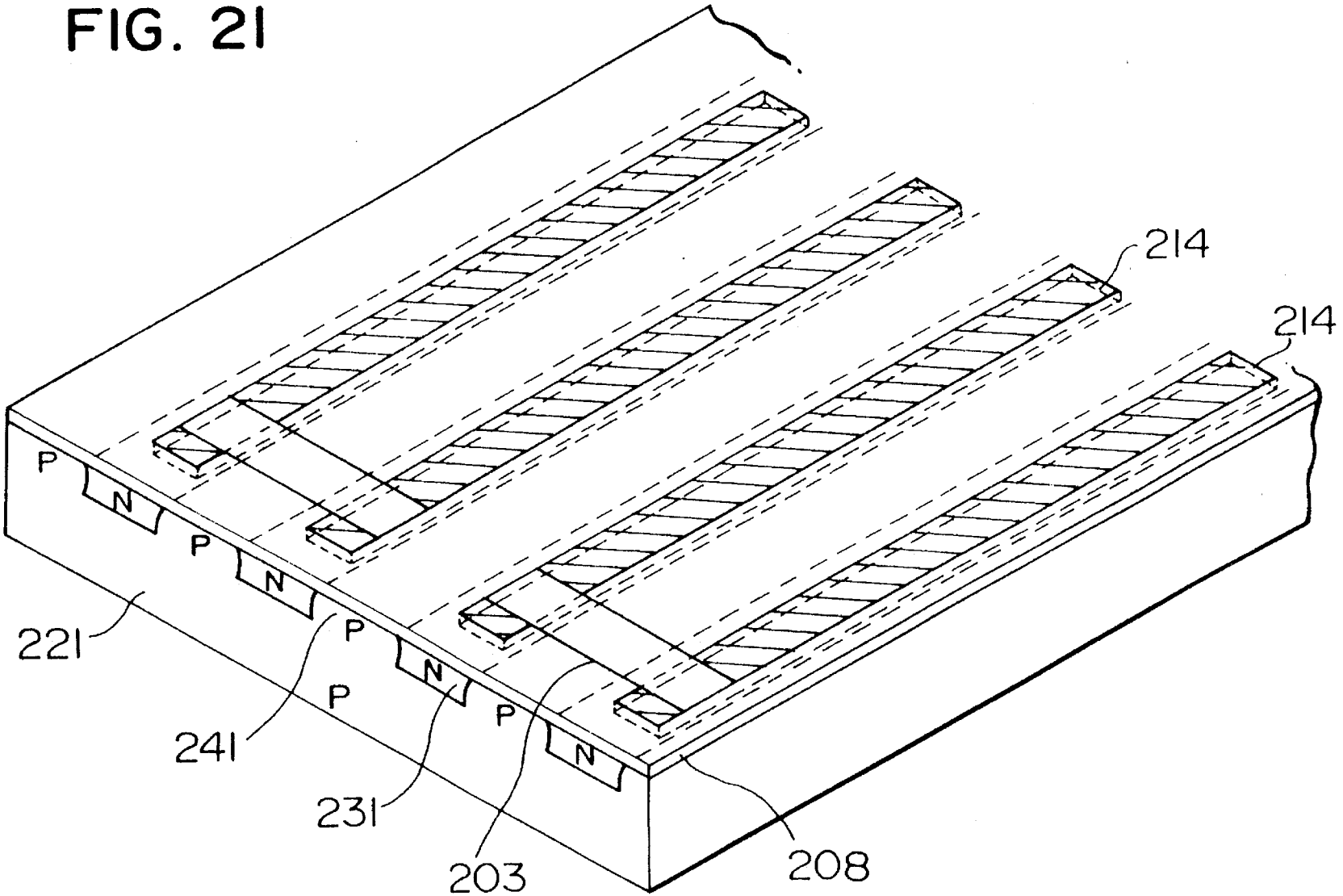
FIG. 21 is a schematic view which illustrates a process of fabricating the recording head according to the third embodiment of the present invention.

The heat-generating resistance layer can be formed by using any of the above-mentioned materials and by the electron beam evaporating method or the sputtering method. In this embodiment, $HfB_2$ film is formed to realize a thickness of 1000 Å, and then patterning is performed by etching so as to form the shape of the heater arranged as shown in FIG. 21.

Figure 22:
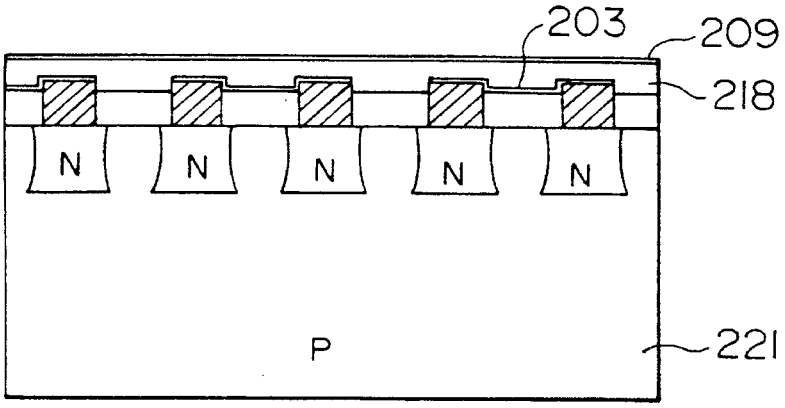
FIG. 22 is a schematic view which illustrates a process of fabricating the recording head according to the third embodiment of the present invention.

Then, protection layers 218 and 209 are formed on the heat-generating resistance layer 5 (see FIG. 22).

The protection layer 218 must have excellent heat resistance and ink insulating characteristics in order to prevent the electric corrosion and oxidation caused by the recording liquid, must not obstruct the effective transfer of heat generated in the heat-generating resistance layer 202, and must be able to protect the heat-generating resistance layer 5 from the recording liquid. The advantageous material which forms the protection layer 218 is exemplified by a silicon oxide, silicon nitride, magnesium oxide, aluminum oxide, tantalum oxide, zirconium oxide and the like. The protection layer 218 may be formed by using the selected material by the electron beam evaporating method or the sputtering method. It is preferable that the thickness of the protection layer 218 be 0.01 to 10 μm, preferably 0.1 to 5 μm, most preferably 0.1 to 3 μm.

Then, in order to improve the durability against the mechanical shock generated at the time of the disappearance of the vapor bubbles, a second protection layer 209 may be formed by using metal such as Al, Ta, ZAr, Hf, V, Nb, Mg, Si, Mo, W, Y, and La, or their alloys, their oxides, carbides, nitrides or borides. As described above, the recording head substrate is fabricated.

Furthermore, the ceiling board 13 for defining the ink passage, nozzle, common liquid chamber, and the recording liquid supply port is provided for the recording head substrate thus fabricated. Thus, a recording head constituted as shown in FIG. 23 is fabricated.

Figure 23:
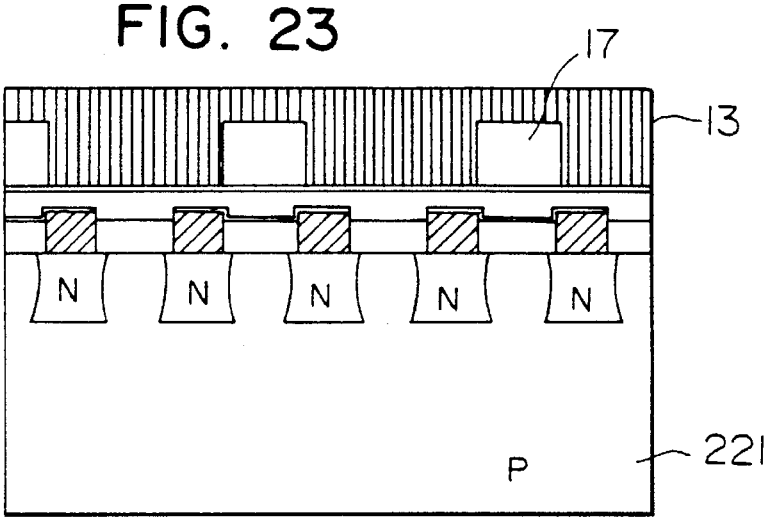
FIG. 23 is a schematic view which illustrates a process of fabricating the recording head according to the third embodiment of the present invention.

Referring to FIG. 23, the ceiling board 13 may be made of a photosensitive material such as a photosensitive resin film and photosensitive glass. As an alternative to this, the recording head may be fabricated in such a manner that a groove is formed in the ceiling board 13 by a mechanical method or etching by using a proper flat plate made of, for example, glass, and then the ceiling board 13 is applied to the recording head substrate.

Figure 24:
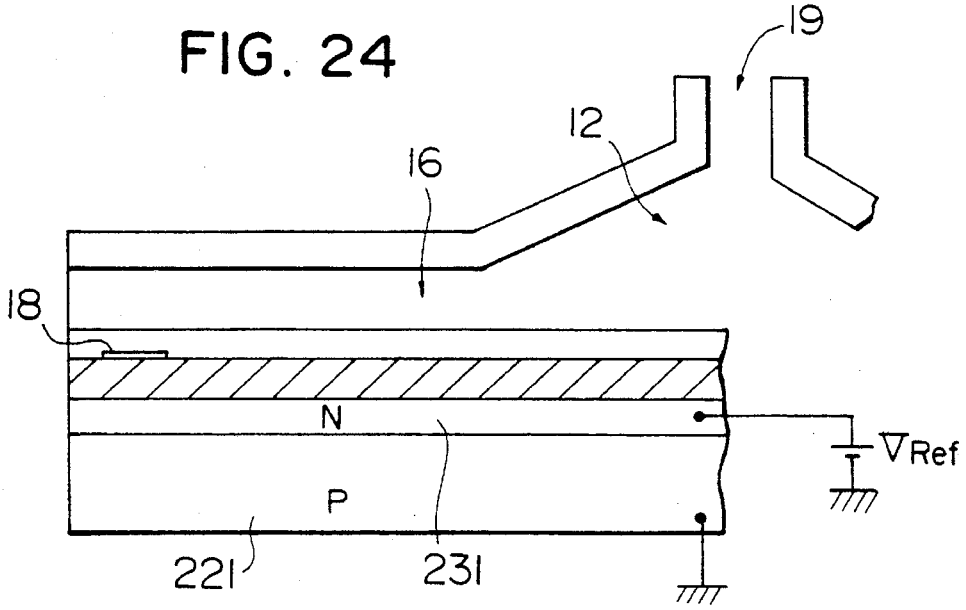
FIG. 24 is a schematic view which illustrates the recording head according to the third embodiment of the present invention.
Figure 25:
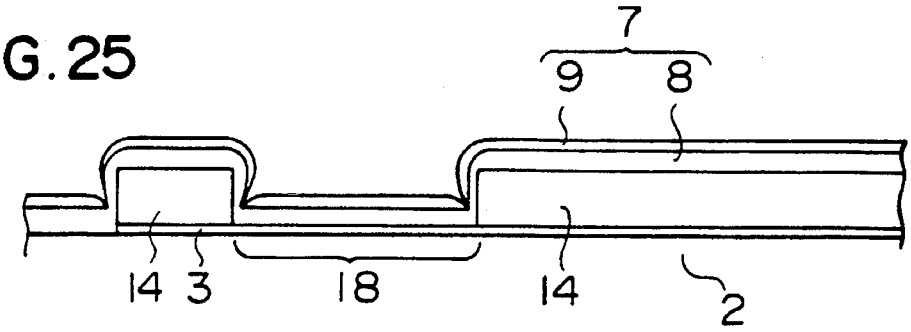
FIG. 25 is a schematic view which illustrates an effect obtainable from a fourth embodiment of the present invention.

FIG. 24 is a schematic view which illustrates the operation of the recording head according to this embodiment.

In at least a state of the operation in which ink is discharged, a potential is supplied with which the junction between the N-type region 231 and the P-type substrate 221 is inversely biased. The aforesaid potential is supplied by, for example, maintaining the substrate 221 at the ground potential as the reference potential and by connecting the N-type region to reference voltage source Vref so as to maintain it at the positive reference potential.

[Fourth Embodiment]

The fourth embodiment is arranged to provide an ink jet recording head which can be operated with a reduced electric power consumption and which exhibits an excellent efficiency of transferring thermal energy.

Specifically, according to this embodiment, a method of fabricating a recording head is provided which comprises the processes of: a process in which a heat regenerating layer having projections and pits is formed on a conductive substrate; a process in which two electrodes disposed away from each other while interposing a projection of the heat regenerating layer are formed; a process in which a heat-generating resistance layer is formed on the two electrodes and the projection of the heat regenerating layer; and a process in which a protection layer is formed on the heat-generating resistance layer.

Since this embodiment of the present invention is arranged in such a manner that Al is embedded in the recess formed in the heat regenerating layer on the substrate, the thickness of the protection layer to be formed on the electrode can be reduced. Furthermore, if the Al-CVD method is used to embed Al, the structure of the portion adjacent to the electrode can be flattened. Therefore, even if a thick Al layer is formed, the thickness of the protection layer can be reduced. As a result, a countermeasure against the voltage drop in the Al electric wire and a countermeasure against the thermal energy loss in the protection layer can be simultaneously taken. As a result, an ink jet recording head exhibiting high energy efficiency can be provided. Furthermore, since the protection layer is thin, the ink bubbles can be stabilized, and the quantity of ink to be discharged and speed of the discharge can be made in form. Therefore, the quality of the print can be improved.

The ink jet head is supplied with pulse voltage to the Al electrode thereof in order to discharge ink. As a result, the electro-thermal transducer is instantaneously heated up to about 300° C. and therefore ink present on the electro-thermal transducer is vaporized, causing ink in the nozzle to be pushed out through the discharge port due to change in the volume.

However, only a portion of the supplied electric energy is utilized to perform the aforesaid discharge operation and a considerably large portion of the energy is used for the other operations.

Among others, energy is consumed in the Al electric wire and the thermal energy is consumed to heat the heat regenerating layer and the protection layer and then the same is escaped to the Si substrate. Therefore, in order to reduce the electric power consumption in the printer, it is a critical factor to reduce the consumption of the energy which does not contribute to the discharge. In order to achieve this, the following two methods may be listed:

(1) The resistance value of the Al electrode is reduced so as to prevent the thermal energy loss in the Al electrode. Specifically, the width of the electrode is enlarged or the thickness is enlarged.

(2) The ink resistance protection layer 7 is thinned to prevent the thermal energy loss in the protection layer, so that the thermal energy generated in the heat-generating portion 6 is efficiently utilized to perform the film boiling of the ink.

However, the above-mentioned methods (1) and (2) cannot be employed because of the following reasons:

(1) The width of the Al electrode is limited by the density of the configuration of the nozzles. For example, in a case of 300 dpi, one electro-thermal transducer must be formed in a space the width of which is 84.7 μm. If an attempt of narrowing the interval between the electrodes is made in the aforesaid width of the space, the width of the electrode can be widened but the interval between the electrodes is narrowed. Therefore, the frequency of generation of the short circuits is raised at the time of patterning the electrode, causing the yield to deteriorate.

(2) Even if a thick Al film is formed or a thin protection lower layer 8 made of $SiO_2$ is formed, the $SiO_2$ film cannot be satisfactorily introduced into a gap between the Al electrodes 4 and 5 in both cases of the sputter film or the CVD film. Therefore, the cavitation generated at the time of the disappearance of the bubbles and the thermal stress generated due to the repeated pulses will cause cracks to be generated in the ink-resisting protection layer 7 adjacent to the gap. If the cracks are generated once, ink can be introduced through the cracks, causing the heat-generating resistance layer 3 or the electro-thermal transducer including the Al electrodes 4 and 5 to be electrically corroded. Therefore, the disconnection will finally be taken place.

Accordingly, a method has been suggested in Japanese Patent Laid-Open No. 61-125858 in which a recess is formed in the heat regenerating layer 2 and Al is embedded in the recess.

Figure 26:
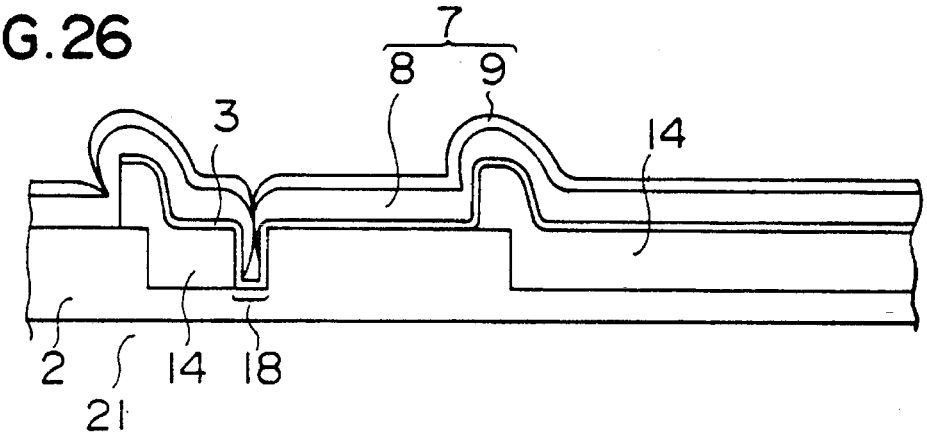
FIG. 26 is a schematic view which illustrates an effect obtainable from a fourth embodiment of the present invention.

However, as shown in FIG. 26, when patterning of the recess of the heat regenerating layer 2 with the Al film is performed by the photolithography technology, the patterning accuracy of the photoresist is deviated by a degree of about 0.5 to 1 μm. Therefore, the recess cannot be covered with the Al film and the Al film is formed on the surface of the heat regenerating layer 2 outside the recess.

[Fifth Embodiment]

A method of fabricating an ink jet recording head according to a fifth embodiment comprises the processes of: a process for forming a heat-generating resistance layer on a conductive substrate; a process for forming two main electrodes disposed away from each other on the heat-generating resistance layer; a process for forming a sub-electrode electrode for at least either of the two main electrodes; and a process for forming a protection layer in a portion of the heat regenerating layer which appears outside between the two main electrodes so as to protect the portion.

The aforesaid process for forming the electrode is performed by the selective CVD method which is preferable to be performed by the method in which alkyl aluminum hydride and hydrogen are utilized. In this case, it is preferable that the alkyl aluminum hydride be dimethyl aluminum hydride.

Since the fifth embodiment of the present invention is arranged in such a manner that the Al electrode is thickened except for the portion adjacent to the discharge energy generating device, an ink jet recording head can be provided which exhibits advantage that the resistance value of the electrode can be reduced and the voltage loss which is given to the discharge energy generating device can be reduced.

Figure 27:
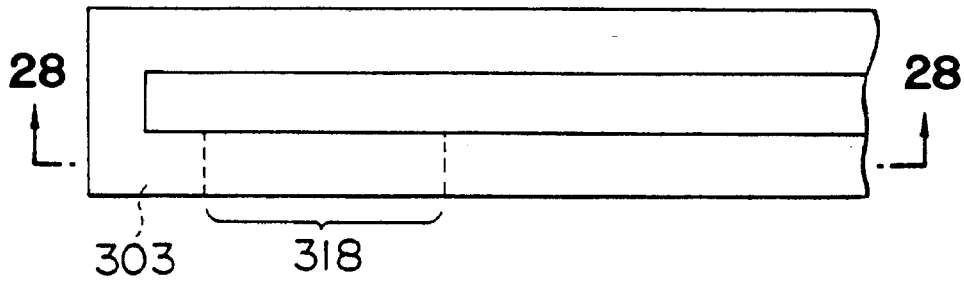
FIG. 27 is a schematic top view which illustrates a thermal energy generating means for the recording head according to the present invention.
Figure 28:
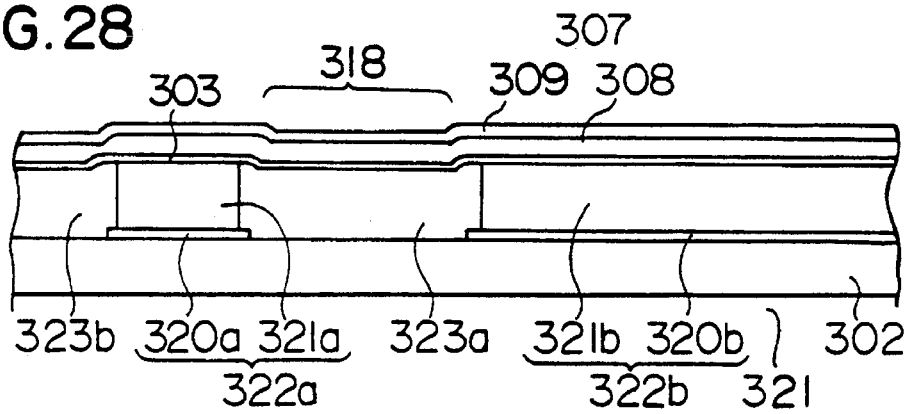
FIG. 28 is a schematic cross sectional view taken along line 28—28 of FIG. 27.

FIGS. 27 and 28 illustrate the structure of the thermal-energy generating device according to this embodiment of the present invention, where FIG. 27 is a plan view and FIG. 28 is a cross sectional view taken along line 28—28 of FIG. 27.

As shown in FIG. 28, Al thin films 320*a* and 320*b* patterned by the photolithography technology are formed on a heat regenerating layer 302 on an Si substrate 321, the Al thin films 320*a* and 320*b* being disposed away from each other by a predetermined distance. Al thick films 321*a* and 321*b* respectively are formed on the Al thin films 320*a* and 320*b*. The Al thin film 320*a* and the Al thick film 321*a* form a first Al electrode 322*a*, while the Al thin film 320*b* and the Al thick film 321*b* form a second Al electrode 322*b*.

A portion on the heat regenerating layer 302*a* between the first Al electrode 322*a* and the second Al electrode 322*b* and a portion between the first Al electrode 322*a* and the ink discharge port have a first inter-electrode protection layer 323*a* and a second inter-electrode protection layer 323*b* each of which is made of $SiO_2$ are formed in such a manner that they are positioned on the same plane on which the top surfaces of the two electrodes are positioned. A heat-generating resistance layer 303 made of a $HfB_2$ thin film and patterned as shown in FIG. 27 is formed on the two electrodes 322*a* and 322*b* and the two inter-electrode protection layers 323*a* and 323*b*. In the thus arranged structure, there is no stepped portion in the boundary between the electrode and the protection layer. Therefore, the heat-generating resistance layer 304 is formed into a substantially flat shape.

A thin ink-resisting protection layer 307 is formed on the heat-generating resistance layer 303. In this embodiment, the ink-resisting protection layer 307 is composed of a lower layer 308 for shielding the heat-generating portion 318 from ink and an upper layer 309 serving as a cavitation-resisting layer against the cavitation generated at the time of the disappearance of the ink and made of Ta. If necessary, an interposing layer (omitted from illustration) made of tantalum oxide for improving the adhesion strength of Ta may be formed between the upper and the lower protection layers 309 and 308.

Then, a method of fabricating the discharge energy generating device thus arranged will now be described with reference to the drawings.

FIGS. 29(*a–c*) and 30(*a–c*) are schematic cross sectional views which illustrates the process of fabricating the discharge energy generating device according to this embodiment of the present invention.

Figure 29A:
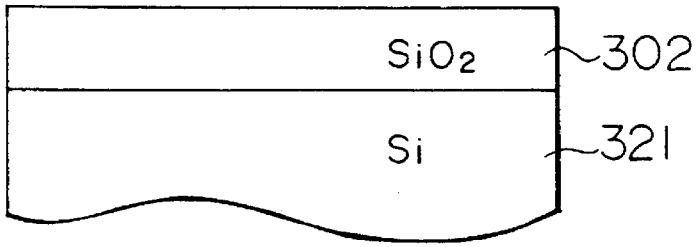
FIGS. 29(*a–c*) are schematic views which illustrate a process of fabricating a recording head according to a fifth embodiment of the present invention.

As shown in FIG. 29A, first, an Si wafer is prepared to serve as the Si substrate 321. Then, the heat regenerating layer 302 made of $SiO_2$ is formed on the main surface of the Si wafer 321 by, for example, a heat oxidation method until the thickness becomes a predetermined value (for example, 1 μm).

Figure 29B:
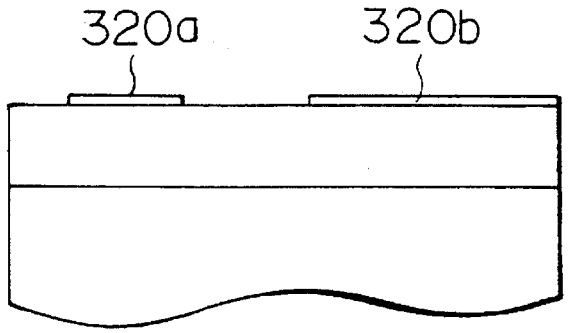
Figure 29C:
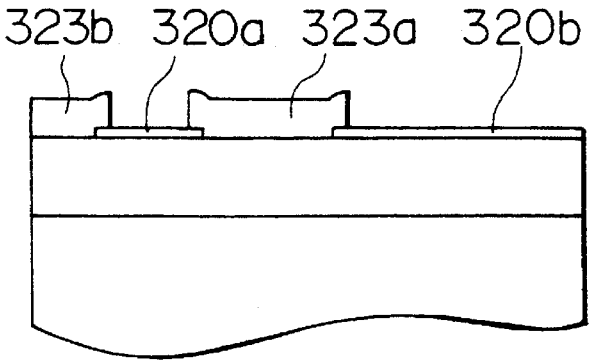

Then, the Al film is formed on the heat regenerating layer 302 to have a predetermined thickness (for example, 20 nm), and, as shown in FIG. 29B, it is patterned by the photolithography technology, so that the Al thin films 320*a* and 320*b* are formed. Then, an $SiO_2$ film is formed on the heat regenerating layer 302 including the Al thin films 320*a* and 320*b* by sputtering to have a predetermined thickness (for example, 1 μm), and then a resist is formed on the $SiO_2$ film by the photolithography technology. The resist is formed in to the same shape as that of the Al thin film 320*a* and that of the Al thin film 320*b* but a size which is slightly smaller than that of each of the Al thin films 320*a* and 320*b*. By using the resist pattern thus arranged, the $SiO_2$ film is etched by a reactive ion etcher so that the first protection layer 323*a* and the second protection layer 323*b* are formed as shown in FIG. 29C. As the reaction gas for use in the reactive ion etching may be, for example, a mixture gas of $CF_4$ and $C_2F_6$. Since Al is not substantially etched in this etching process, the above-mentioned Al thin films 320*a* and 320*b* serve as etching stop layers. The reason why the peripheral portion of each of the Al thin films 320*a* and 320*b* is introduced into the portion below the peripheral portion of each of the first and the second inter-electrode protection layers 323*a* and 323*b* while overlapping lies in that, if the aforesaid overlap is not made, a portion of the heat regenerating layer 302 below the protection layer undesirably appears outside due to the positional deviation taken place at the time of forming the protection layer by patterning and therefore the above-mentioned portion which appears must be protected from etching.

Figure 30A:
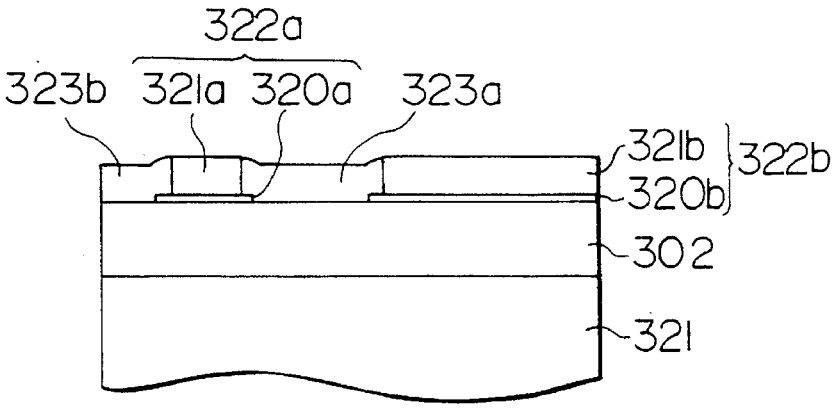
FIGS. 30(*a–c*) are schematic views which illustrate a process of fabricating the recording head according to the fifth embodiment of the present invention.

Then, as shown in FIG. 30A, the Al thick films 321*a* and 321*b* each having a predetermined thickness (for example, 1 μm) are formed on the aforesaid Al thin films 320*a* and 320. The above-mentioned thick films may be preferably formed by an Al-CVD method to be described later. In this case, the Al thin films 320*a* and 320*b* may be used as the basic layers on which Al is selectively deposited in the Al-CVD method. Then, as described above, the Al thin film 320*a* and the Al thick film 321*a* form the first Al electrode 322*a*, while the Al thin film 320*b* and the Al thick film 321*b* form the second Al electrode 322*b*.

Figure 30B:
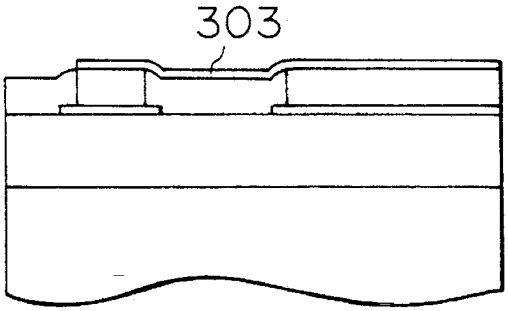

Then, the $HfB_2$ film is formed on each of the electrodes to have a predetermined thickness (for example, 200 nm) by sputtering, and then it is patterned, so that the thin heat-generating resistance layer 303 made of $HfB_2$ is formed on the first and the second Al electrodes 322*a*, 322*b* and the first inter-electrode protection layer 323*a* as shown in FIG. 30B.

Figure 30C:
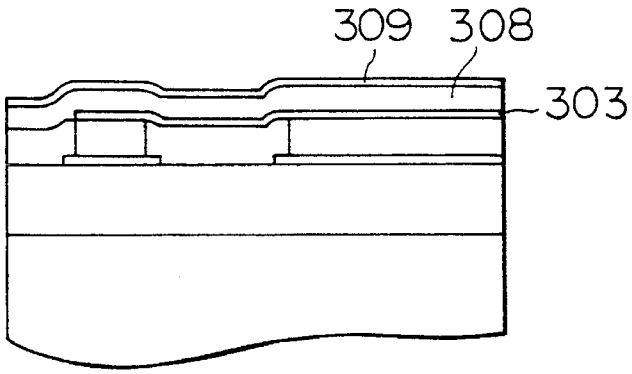

Then, the thin ink-resisting protection layer 7 is formed on the heat-generating resistance layer 303 and the second inter-electrode protection layer 323*b*. That is, as shown in FIG. 30C, a lower protection layer 308 made of $SiO_2$ and having a predetermined thickness (for example, 400 nm) is formed on the heat-generating resistance layer, and then an upper protection layer 309 having a predetermined thickness (for example, 200 nm) and made of Ta is formed on the lower protection layer 308 by sputtering, respectively. Thus, the aforesaid ink resisting protection layer is formed.

Since the discharge energy generating device thus fabricated is arranged in such a manner that the Al electrodes 322*a* and 322*b* are formed below the heat-generating resistance layer 303, a thin ink-resisting protection layer, the thickness of which is smaller than the half of that of the conventional structure, can be formed above the heat-generating resistance layer 303. Since the thickness of this ink resisting protection layer is thin enough, a portion of the thermal energy supplied from the heat generating portion between the electrodes to be consumed in the ink resisting protection layer can be minimized. Therefore, the thermal energy can be efficiently utilized to perform the film boiling of the ink. If the Al-CVD method to be described later is employed when the Al electrodes 322*a* and 322*b* are formed, the boundary region between the Al electrodes 322*a* and 322*b* and the inter-electrode protection layers 323*a* and 323*b* can be substantially flattened although slight pits and projections are left.

Figure 1:
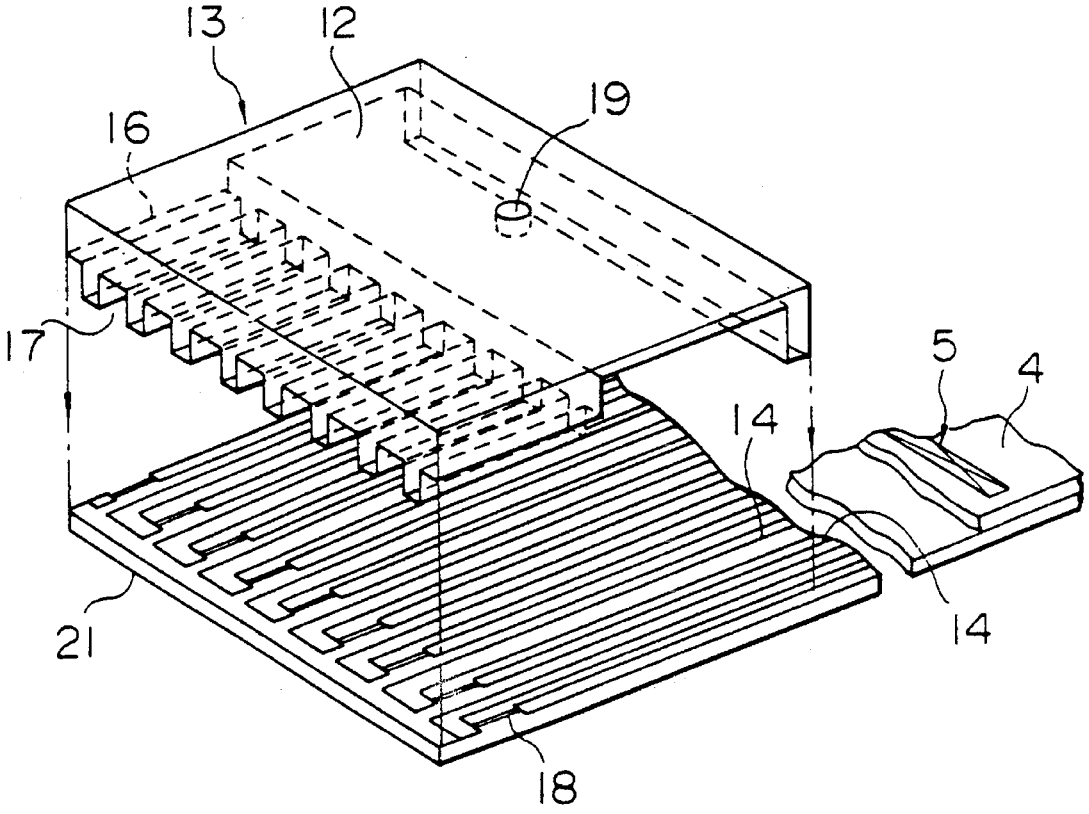
FIG. 1 PRIOR ART
FIG. 1 is a schematic view which illustrates a conventional recording head.
Figure 2:
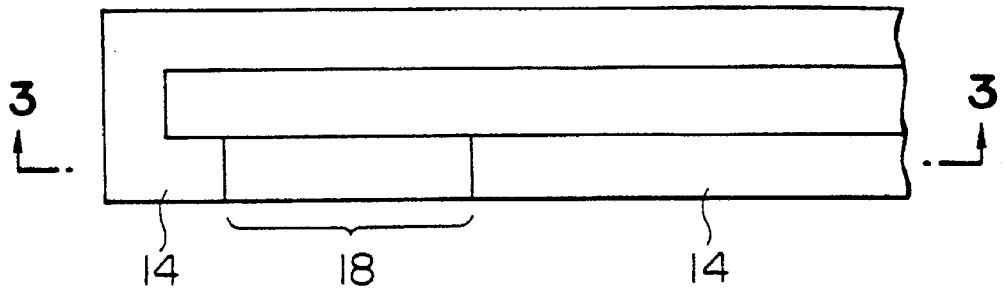
FIG. 2 PRIOR ART
FIG. 2 is schematic top view which illustrates a thermal energy generating means for a conventional recording head.

An Si substrate 3001 having the discharge energy generating device thus formed is used to assemble the ink jet recording head by performing, for example, processes as shown in FIG. 1.

[Sixth Embodiment]

Although the aforesaid fifth embodiment employs the Al thin films 320*a* and 320*b* as the etching stop layers at the time of performing the reactive ion etching, etching can be performed even if the aforesaid stop layers are omitted. In this case, the etching rate of the $SiO_2$ film is previously obtained and etching is performed in only a time taken to perform etching it to a predetermined depth (for example, 1 μm).

Figure 31:
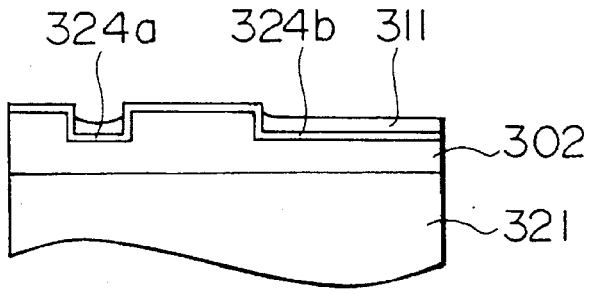
FIG. 31 is a schematic view which illustrates a process of fabricating the recording head according to a sixth embodiment of the present invention.
Figure 32:
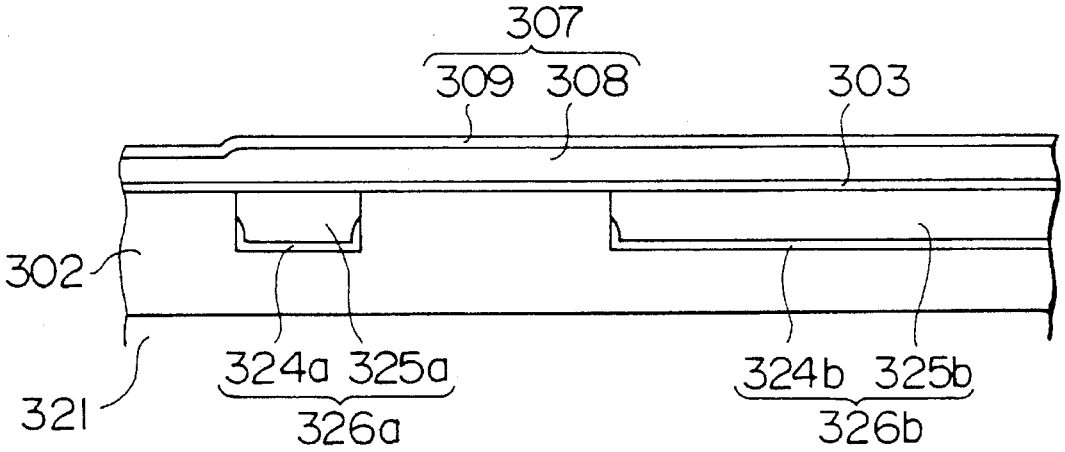
FIG. 32 is a schematic view which illustrates a process of fabricating the recording head according to a sixth embodiment of the present invention.

In the sixth embodiment, first, the heat regenerating layer 302 made of $SiO_2$ is formed on the main surface of the Si wafer 321 by, for example, the heat oxidation method as shown in FIG. 31. Then, reactive ion etching is, as described above, performed in a predetermined time under the same conditions as those according to the first embodiment, so that a recess is formed in the heat regenerating layer 302. Then, the thin Al film is formed on the heat regenerating layer 302 and in its recess by sputtering to have a predetermined thickness (for example, 20 nm). Then, a resist is spin-coated on the surface of the Al thin film, and then it is baked. Then, an $O_2$ plasma asher is used to remove the resist of the heat regenerating layer 302 except for that in the recess. In this case, a resist 311 is left in the aforesaid recess as shown in FIG. 31 and the aforesaid thin Al film appears outside in the other portions from which the resist has been removed. Then, the thin Al film is removed by etching, resulting in only thin Al film 324*a* and 324*b* on the bottom in the recess covered with the resist 311 to be left since they are not etched. After the resist in the recess has been removed, Al is selectively enlarged by an Al-CVD method to be described later in which the thin Al films 324*a* and 324*b* are used as the members for supplying electrons. As a result, thick Al films 325*a* and 325*b* are formed as shown in FIG. 32, so that Al electrodes 326*a* and 326*b* respectively composed of the thin Al films 324*a* and 324*b* and thick Al films 325*a* and 325*b* are formed. Then, a heat-generating resistance layer 303 and an ink-resisting protection layer 307 are sequentially layered similarly to the first embodiment on the surface of each of the Al electrodes 326*a* and 326*b* and the exposed heat regenerating layer 302, so that a discharge energy generating device is obtained.

The Si substrate 1 having the discharge energy generating device thus obtained is assembled to make the ink jet recording head after the processes shown in FIG. 61 have been performed.

[Seventh Embodiment]

Figure 33:
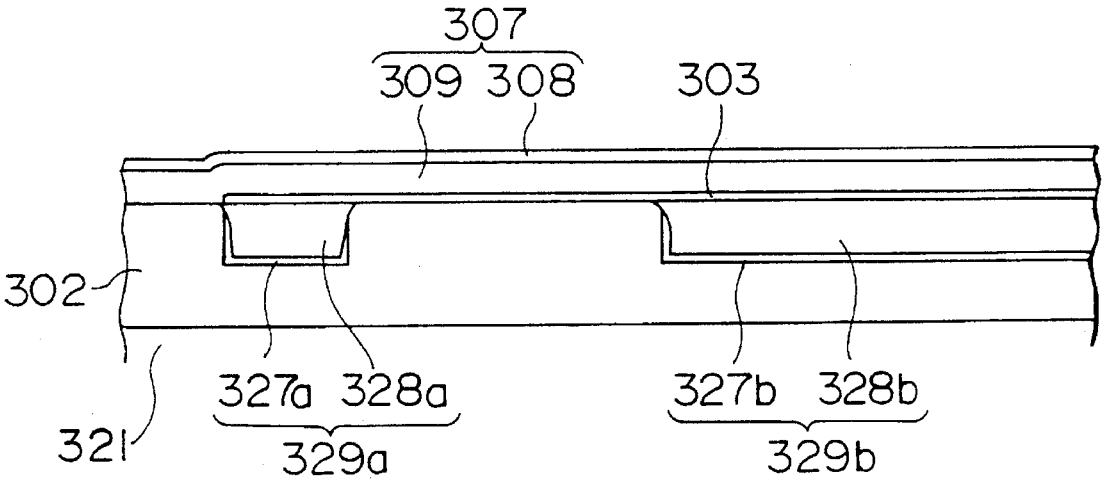
FIG. 33 is a schematic view which illustrates a process of fabricating the recording head according to a seventh embodiment of the present invention.

Although the above-mentioned sixth embodiment is arranged in such a manner that the thin Al films 324*a* and 324*b* in the recess of the heat regenerating layer 302 are not removed and etching is performed by using the resist to remove only the thin Al film formed on the surface of the heat regenerating layer 302 (projects relatively with respect to the recess), only the thin Al film on the projection of the heat regenerating layer 302 may be removed by buffing. In this case, thin Al films 327*a* and 327*b* in the recess are not removed as shown in FIG. 33. Therefore, the thin Al films 327*a* and 327*b* in the recess include the thin Al film on the entire inner surface of the recess according to this embodiment. In this case, the peripheral portion which is the boundary between the projection and the recess is chamfered. Then, Al is selectively enlarged by an Al-CVD method to be described later in which the thin Al films 327*a* and 327*b* are used as the members for supplying electrons. As a result, thick Al films 328*a* and 328*b* are formed as shown in FIG. 33, so that Al electrodes 329*a* and 329*b* respectively composed of the thin Al films 327*a* and 327*b* and thick Al films 328*a* and 328*b* are formed. Then, a heat-generating resistance layer 303 and an ink-resisting protection layer are sequentially layered similarly to the first embodiment on the surface of each of the Al electrodes 329*a* and 329*b* and the exposed projection of the heat regenerating layer 302, so that a discharge energy generating device is obtained.

The Si substrate 321 having the discharge energy generating device thus obtained is assembled to make the ink jet recording head after the processes shown in FIG. 61 have been performed.

[Eighth Embodiment]

FIGS. 34 to 43 are schematic cross sectional views which illustrate processes for fabricating a thermal energy generating device according to an eighth embodiment of the present invention.

Figure 34:
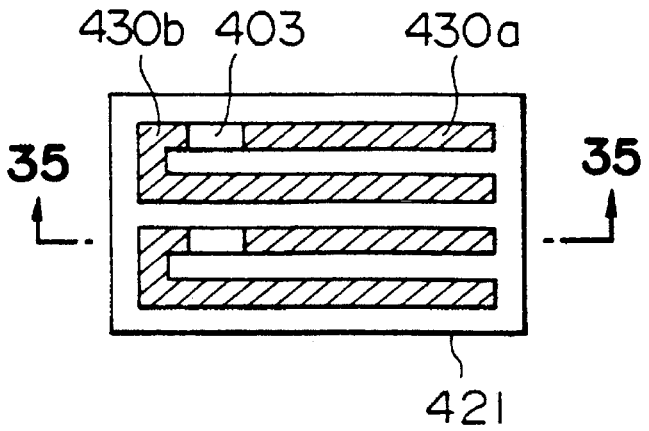
FIG. 34 is a schematic top view which illustrates a process of fabricating the recording head according to an eighth embodiment of the present invention.
Figure 35:
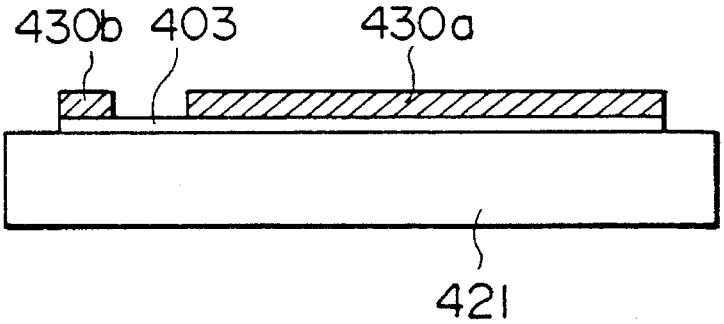
FIG. 35 is a schematic cross sectional view taken along line 35—35 of FIG. 34.

As shown in FIGS. 34 and 35, a heat-generating resistance layer 403 made of HfB2 or the like is formed on the main surface of an Si substrate 421 by sputtering or the like. The main surface of the Si substrate 421 may have an $SiO_2$ film formed by the heat oxidation or the like as described above. Then, material for the Al electrode is used to form an Al film having a predetermined thickness on a heat-generating resistance layer 403 by sputtering or evaporation. It is preferable that the thickness of the Al film be smaller than the thickness of the ink-resisting protection layer in order to maintain the durability. For example, in a case where the thickness of the ink-resisting protection layer is 0.5 μm and that of the Al film for forming the Al electrode is 0.3 μm, no problem arises in the facility of covering the stepped portion of the Al electrode pattern of the ink-resisting protection layer. The aforesaid thickness ratio is not necessitated but it may be determined properly because the ratio affects the durability.

Then, the photolithography technology is used to form the heat-generating resistance layer 403 into a desired pattern.

Furthermore, a first Al electrode 430*a* and a second Al electrode 430*b* are formed from the aforesaid Al film. The heat-generating resistance layer 403 between the two Al electrodes 430*a* and 430*b* serves as a heat generating portion 418.

Figure 36:
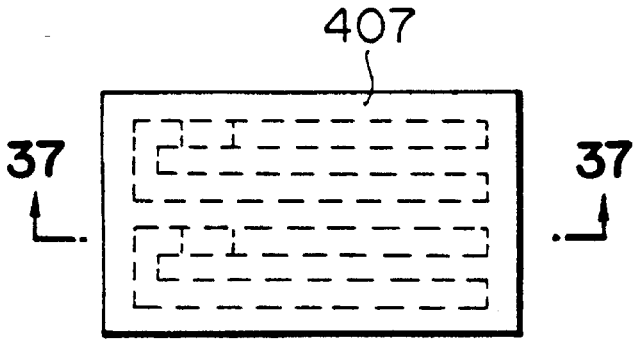
FIG. 36 is a schematic top view which illustrates the recording head according to an eighth embodiment of the present invention.
Figure 37:
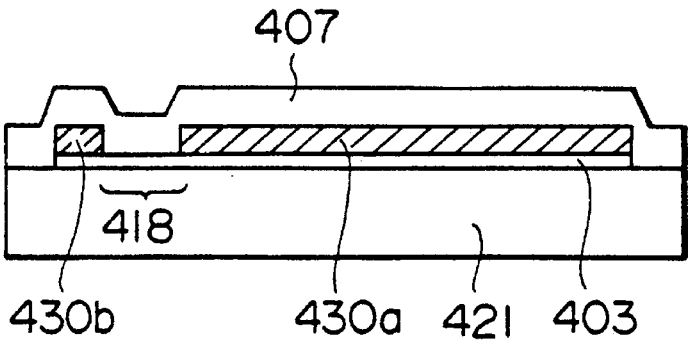
FIG. 37 is a schematic cross sectional view taken along line 37—37 of FIG. 36.
Figure 38:
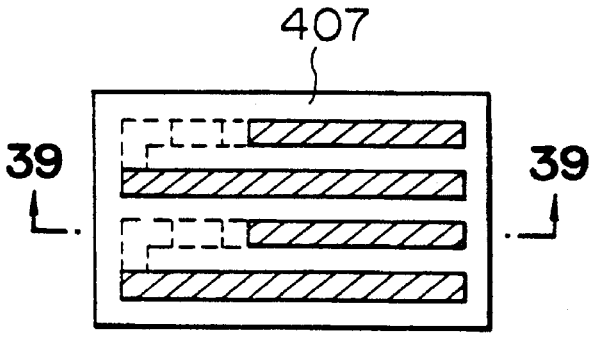
FIG. 38 is a schematic top view which illustrates the recording head according to the eighth embodiment of the present invention.
Figure 39:
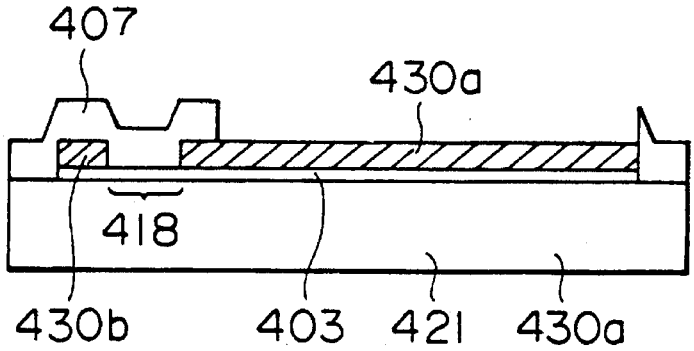
FIG. 39 is a schematic cross sectional view taken along line 39—39 of FIG. 38.

Then, as shown in FIGS. 36 and 37, a first ink-resisting protection layer 407 made of, for example, $SiO_2$ is formed on the top surface of the two Al electrodes 430*a* and 430*b* and the heat generating portion 418 between these electrodes by sputtering or the like.

Then, the first ink-resisting protection layer 407 above the Al electrode 430*a* except for the portion of the first ink-resisting protection layer 407 adjacent to the heat generating portion is etched by the photolithography technology in such a manner that the top surface of the Al electrode 430*a* appears outside.

Figure 40:
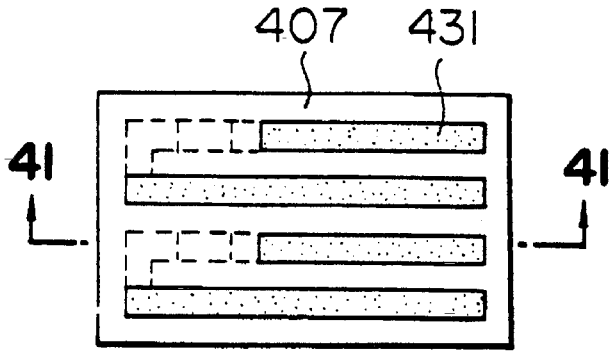
FIG. 40 is a schematic top view which illustrates the recording head according to the eighth embodiment of the present invention.
Figure 41:
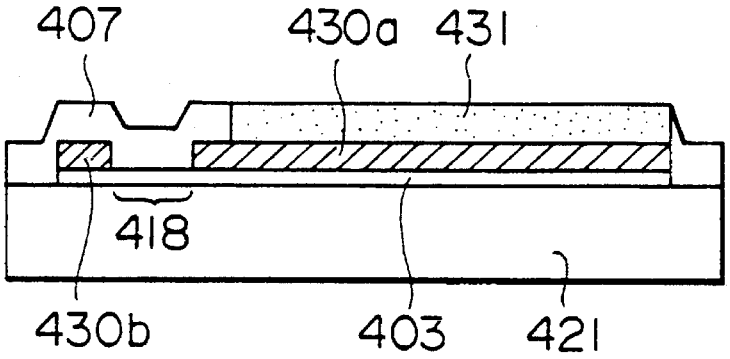
FIG. 41 is a schematic cross sectional view taken along line 41—41 of FIG. 40.

Then, as shown in FIGS. 40 and 41, an Al-CVD method to be described is employed to deposit Al ion the top surface of the Al electrode 430*a* which appears because the first ink-resisting protection layer 407 has been partially removed. As a result, a sub-Al electrode 431 is formed. It is preferable that the thickness of the sub-Al electrode 431 be substantially the same as that of the first ink protection layer 407. In a case where the thickness of the etched first ink-resisting protection layer 407 is, for example, 0.5 μm, the Al film is deposited on the top surface of the Al electrode 430*a* to have a thickness of 0.5 μm. If the thickness of the films in the two directions are substantially the same, the top surface of them become continued and flat and therefore an advantage can be realized when an ink passage and the ceiling board are connected in the following process.

Figure 42:
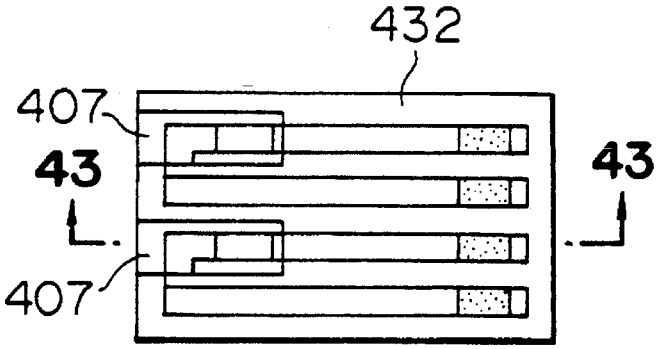
FIG. 42 is a schematic top view which illustrates the recording head according to the eighth embodiment of the present invention.
Figure 43:
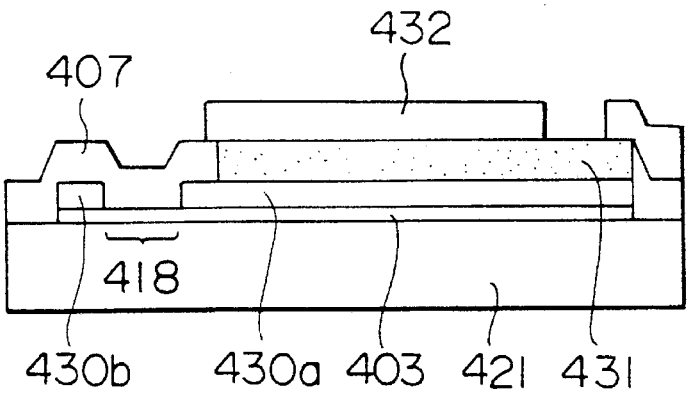
FIG. 43 is a schematic cross sectional view taken along line 43—43 of FIG. 42.

The sub-Al electrode 431 and the Al electrode 430*a* form a two-layer electrode structure and the thickness can be enlarged. Therefore, the resistance value of the Al electrode of the two-layer electrode structure can be reduced and therefore the quantity of thermal energy loss in the Al electrode can be reduced. As a result, the required electric power to be supplied to the ink jet recording head can be reduced. It leads to a fact that the electric power consumption in a printer one which the ink jet recording head of the aforesaid type can be reduced. Then, as shown in FIGS. 42 and 43, the sub-Al electrode 431 is covered with at least the sub-Al electrode 431 so that a second ink-resisting protection layer 432 for protecting the sub-Al electrode 431 and also serving as the outer frame of the discharge energy generating device is formed. The second ink-resisting protection layer 432 may be made of, for example, a photosensitive resin. According to this embodiment, the second ink-resisting protection layer 432 is formed by the photolithography technology into a pattern from which a portion (the discharge energy generating device portion) adjacent to the heat generating portion 418 and a portion of the sub-Al electrode 431 through which electricity is taken are excluded.

Figure 44:
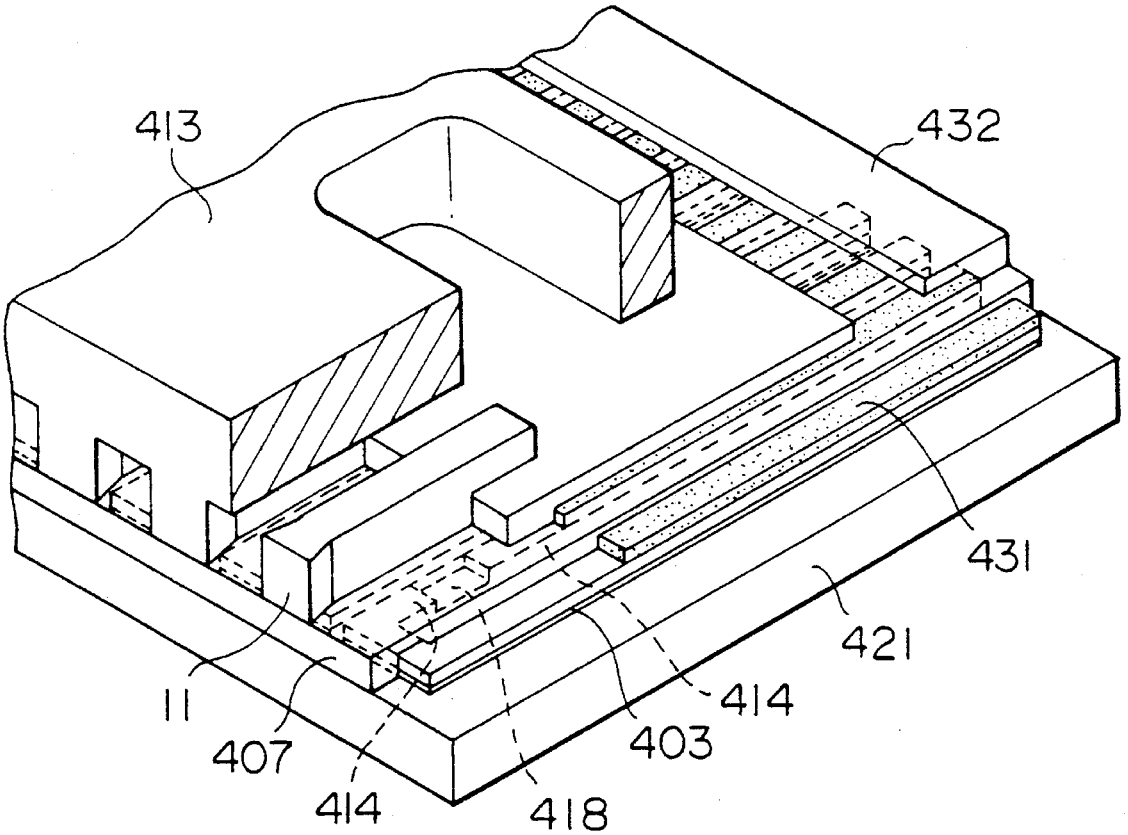
FIG. 44 is a schematic view which illustrates the structure of the recording head according to the eighth embodiment of the present invention.
Figure 45:
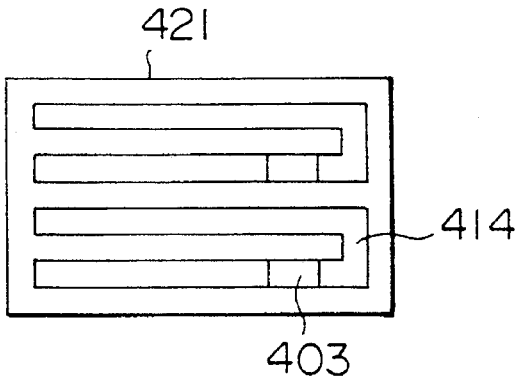
FIG. 45 is a schematic view which illustrates a process of fabricating a recording head according to a ninth embodiment of the present invention.
Figure 46:
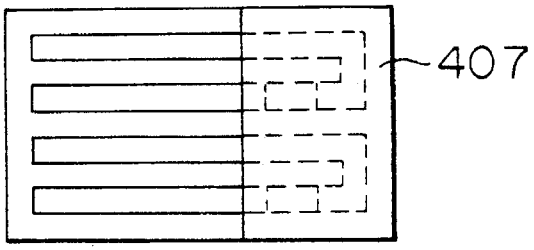
FIG. 46 is a schematic view which illustrates a process of fabricating the recording head according to the ninth embodiment of the present invention.
Figure 47:
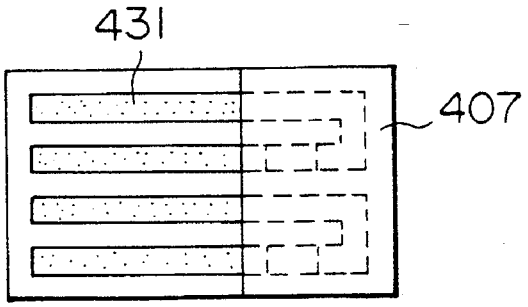
FIG. 47 is a schematic view which illustrates a process of fabricating the recording head according to the ninth embodiment of the present invention.
Figure 48:
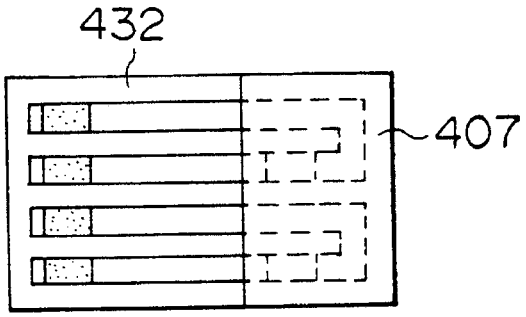
FIG. 48 is a schematic view which illustrates a process of fabricating the recording head according to the ninth embodiment of the present invention.

The Si substrate 421 having the thermal energy generating device thus obtained is subjected to a process for forming the ink fluid wall 11 by using the photosensitive resin solid film as shown in FIG. 44 and a cover 413 for covering the ink fluid wall 11 to form the ink discharge port (nozzle) is placed.

Figure 61A:
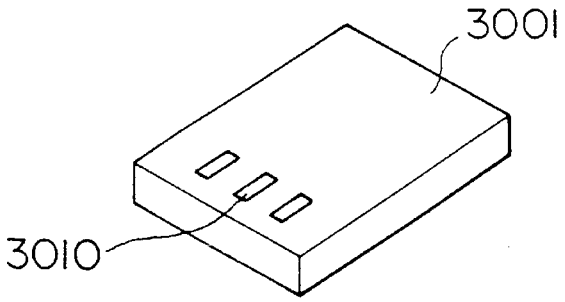
FIGS. 61(*a–d*) are schematic view which illustrates a process of fabricating the recording head according to the present invention.
Figure 61B:
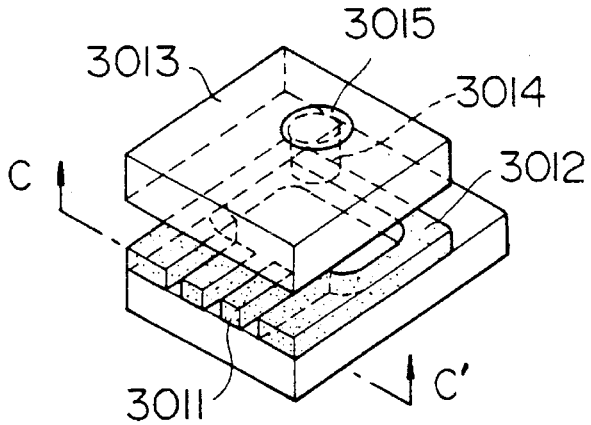
Figure 61C:
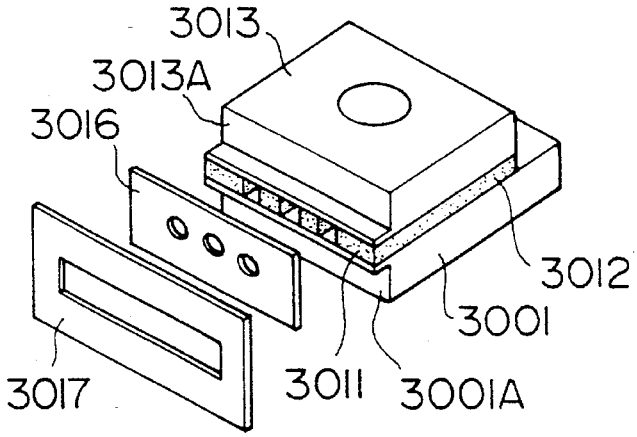
Figure 61D:
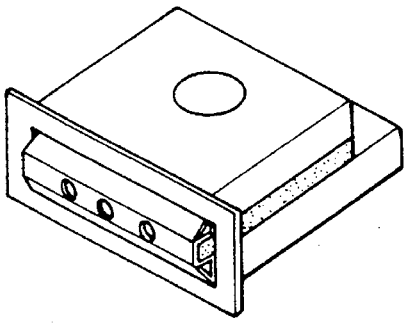

The laminated member thus constituted is subjected to processes shown in FIGS. 61B to 61D and is used to assemble the ink jet recording head.

[Ninth Embodiment]

Although the eighth embodiment is arranged in such a manner that the $SiO_2$ is first formed on the substrate 421 by sputtering as shown in FIGS. 36 and 37 and then the first ink-resisting protection layer 407 is formed by removing the unnecessary portion by the photolithography technology, the first ink-resisting protection layer 407 may be formed by putting a masking jig formed into a desired pattern on the substrate 1 and by forming $SiO_2$ film by sputtering. According to this method, an advantage that the photolithography process can be omitted can be obtained.

[Tenth Embodiment]

Although the eighth embodiment is arranged in such a manner that the heat-generating resistance layer 403 is formed on the substrate 421 and the Al film is formed on the heat-generating resistance layer 403 while being patterned as desired, another arrangement may be employed. That is, a heat-generating resistance layer made of material such as $HfB_2$ for generating discharge energy is formed on the substrate 421 by sputtering or the like. The heat-generating resistance layer is formed into the same pattern as the shape of the desired Al electrode by the photolithography technology, and then the Al film is deposited on it by the Al-CVD method to be described later. Then, the portion of the Al film which is required to serve as the discharge energy generating device is removed by the photolithography technology, and then the surface of the heat-generating resistance layer in the aforesaid removal portion is caused to appear outside. The ensuing processes are performed similarly to each of the aforesaid embodiments.

[Eleventh Embodiment ]

Since the thermal energy generating means is basically composed of the heat-generating resistance layer which generates heat when it is supplied with electricity and a pair of the electrodes for supplying the electricity to the heat-generating resistance layer, the following problems arise if the heat-generating resistance layer is able to directly come in contact with the recording liquid: electricity undesirably passes through the liquid depending upon the electric resistance value of the recording liquid; the recording liquid is electrolyzed by the of the electricity during the recording operation; or the heat-generating resistance layer and the recording liquid react with each other at the time of the supply of the electricity to the heat-generating resistance layer and the resulted corrosion of the heat-generating resistance layer causes the resistance value to be changed or the heat-generating resistance layer to be cracked or broken.

Accordingly, hitherto, an arrangement has been suggested in which the heat-generating resistance layer has been made of an inorganic material such as an alloy exemplified by NiCr or a metal boride such as $ZrB_2$ and $HfB_2$ which exhibits relatively excellent characteristics as the heat-generating resistance material. Furthermore, a protection layer made of a material such as $SiO_2$ which exhibits excellent oxidation resistance is formed on the heat-generating resistance layer made of the above-mentioned material in order to prevent the direct contact of the heat-generating resistance layer with the recording liquid. As a result, the above-mentioned problems are overcome and the reliability and the durability can be improved.

Incidentally, when the thermal energy generating means for the liquid jet recording head is formed, the above-mentioned heat-generating resistance layer is formed on a desired substrate, and the electrode and the protection layer are sequentially layered in general. The protection layer for the thermal energy generating means must be able to uniformly cover the required portions of the heat-generating resistance layer and the electrode while preventing generation of defects such as pin holes in order to serve as the protection layer for protecting the heat-generating resistance layer from breakage or preventing the short circuit between electrodes.

The liquid jet recording head arranged as described above usually has the electrode formed on the heat-generating resistance layer thereof. Therefore, a stepped portion can be formed between the electrode and the heat-generating resistance layer. Since a problem of non-uniform thickness of the layer or the like can easily be taken place in the above-mentioned stepped portion, the layers must be formed so as to sufficiently cover the stepped portion (step coverage) in order to prevent the exposure of the portion of the layer. That is, if satisfactory step coverage cannot be accomplished, the exposed portion of the heat-generating resistance layer and the recording liquid directly come in contact with each other, causing the recording liquid to be electrolyzed undesirably or the heat-generating resistance layer to be broken due to the reaction between the recording liquid and the material for the heat-generating resistance layer. What is even worse, non-uniformity of the film thickness can easily be taken place in the stepped portion, causing a local concentration of the thermal stress generated in the protection layer to take place due to the repeated generations of heat. As a result, cracks can be generated in the protection layer and the recording liquid can be introduced through the cracks, causing the heat-generating resistance layer to be broken as described above. Furthermore, the introduction of the recording liquid through the pin hole sometimes brakes the heat-generating resistance layer.

Hitherto, the above-mentioned problems have been usually overcome by thickening the protection layer to improve the step coverage and decrease the pin holes. However, although the step coverage is improved and the pin holes can be decreased by thickening the protection layer, the smooth heal supply to the recording liquid is inhibited if the protection layer is thickened, causing the following problems to arise:

That is, heat generated in the heat-generating resistance layer is transferred to the recording liquid via the protection layer. The thermal resistance between the surface of the protection layer which is the surface on which the heat acts and the heat-generating resistance layer can be enlarged when the thickness of the protection layer is enlarged. Therefore, an electric load must be effected on the heat-generating resistance layer, causing the following problems to arise:

(1) It is disadvantageous to save the electricity consumption;

(2) Heat is excessively accumulated in the base, causing the heat responsibility to deteriorate; and (3) The excessively large electric power deteriorates the durability of the heat-generating resistance layer.

Although the aforesaid problems can be overcome by thinning the protection layer, the conventional method of fabricating the liquid jet recording head arranged in such a manner that the aforesaid layer is formed by a film forming method such as sputtering or the evaporation encounters a problem of the aforesaid problems due to the unsatisfactory step coverage. Therefore, it has been difficult to thin the protection layer.

Furthermore, it has been known that the bubble forming stability in the recording liquid is in proportion to the speed at which the recording liquid is heated when recording is performed by using the aforesaid liquid jet recording head. That is, by shortening the width of the electric signal to be applied to the thermal energy generating means, which is usually a rectangular electric pulse, the bubble forming stability in the recording liquid can be improved, causing the discharge stability of droplets to be jetted to be improved. Therefore, the quality of the record can be improved. However, the conventional liquid jet recording head must have the protection layer which has a large thickness as described above. Therefore, the thermal resistance of the protection layer is enlarged and the thermal energy generating means must generate heat excessively, causing the durability and the thermal responsibility to deteriorate. As a result, it is FIGS. 49(*a–d*) are process views which illustrate an example is present in improving the quality of the recorded result.

When the conventional liquid jet recording head is fabricated, the heat-generating resistance layer 3 is layered on the substrate as shown in FIG. 3 and at least a pair of electrodes 14 to be connected to the heat-generating resistance layer 3 are formed. Reference numeral 9 represents a heat effecting surface for transferring heat generated by supplying electricity to a heat generating portion 18 of the heat-generating resistance layer 3 formed between electrodes 14, and a stepped portion is formed here.

In the thus arranged structure, a defect such as a pin hole can be easily taken place in the protection layer 7 as described above and the exposed portion can be easily formed in the stepped portion. Therefore, the thickness of the protection layer 7 must be enlarged excessively (usually, it must be enlarged to two times or more the thickness of the electrode).

This embodiment has been found on the viewpoint of the aforesaid problems experienced with the conventional structures and therefore an object of the present invention is to provide a novel method of fabricating a liquid jet recording head capable of saving electric power and exhibiting satisfactory durability, high speed responsibility and improved quality of the result of recording.

In order to achieve the aforesaid object, the method of fabricating the liquid jet recording head according to this embodiment comprises: a process for forming a heat-generating resistance layer for supplying thermal energy for discharging recording liquid to the recording liquid; a process for forming a protection layer made of patterned material, which does not supply electrons, on the heat-generating resistance layer; and a process of forming a flat portion by selectively depositing an aluminum film, which is electrically connected to the heat-generating resistance layer, in a portion from which the protection layer has been removed by patterning by an organic metal CVD method to have the same thickness as that of the protection layer.

In this embodiment, the heat-generating resistance layer, the first and the second protection layers can be formed by using a known material by sputtering such as a high frequency (RF) sputtering method, a chemical vapor deposition (CVD) method, a vacuum evaporating method and the like. The electrode to be electrically connected to the heat-generating resistance layer must be formed by the organic metal CVD method.

Then, this embodiment of the present invention will now be described with reference to the drawings.

FIG. 49 is a process view which illustrates an example of a method of fabricating a liquid jet recording head substrate according to the present invention.

Figure 49A:
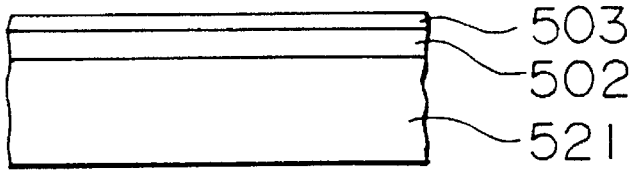
FIGS. 49(*a–d*) are schematic view which illustrates a process of fabricating a recording head according to an eleventh embodiment of the present invention.

As shown in FIG. 49A, a heat-generating resistance layer 503 made of, for example, an alloy such as NiCr or a metal boride such as $ZrB_2$ or $HfB_2$ is formed on a substrate 521 made of glass, ceramics or plastic by the vacuum evaporating method or the sputtering method or the like. Then, patterning is performed by a known method such as the photolithography. A heat regenerating layer 502 may be formed between the substrate 521 and the heat-generating resistance layer 503. The heat regenerating layer 502 is provided for the purpose of preventing deterioration of the efficiency of heating the recording liquid by preventing the escape of heat generated by the heat-generating resistance layer 503 to the substrate 521. The heat regenerating layer 502 is made of a material such as $SiO_2$ having an adverse thermal conductivity.

Figure 49B:
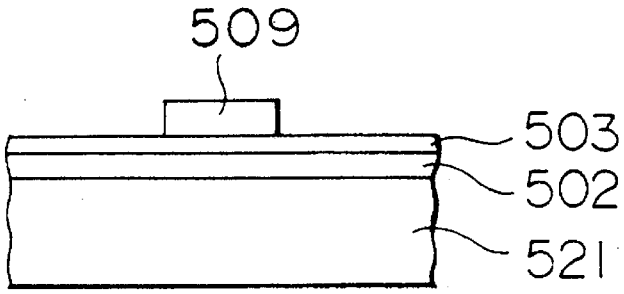

Then, as shown in FIG. 49B, a first protection layer 509 made of a material such as $SiO_2$ or $Si_3N_4$ which does not supply electrons is formed on the patterned heat-generating resistance layer 503 to have substantially the same thickness as that of the required electrode by the sputtering method or the CVD method. Then, only a portion, in which the electrode will be formed, is removed by, for example, a photolithography method. At this time, a groove having the same shape as that of the electrode pattern is formed in the first protection layer 509. In order to selectively form the Al electrode by the organic metal CVD method, it is necessary for the bottom or the surface of the groove to have the electron supplying characteristics. Usually, the heat-generating resistance layer 503 performs the aforesaid role.

Figure 49C:
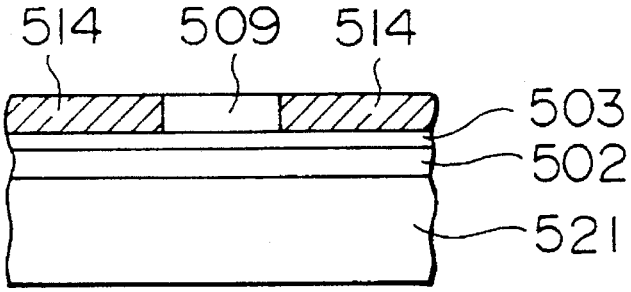

Then, as shown in FIG. 49C, the aforesaid groove is plugged by a material mainly composed of Al by a selective film forming method by the aforesaid organic metal CVD method, so that a flat surface made of a first protection layer 509 and an electrode 514 is formed.

Then, a second protection layer 507 made of an insulating material such as $SiO_2$ or $Si_3N_4$ is formed on the flat surface by a known method. As described above, since the second protection layer 507 can be freed from a defect because the base is flat and therefore it can be sufficiently thinned. The necessity of forming the second protection layer 507 to be a single layer can be eliminated but it may be formed into a plural-layer structure having a cavitation resisting layer 8 formed thereon if the insulation between electrodes can be maintained (see FIG. 49D).

Then, a further specific method of fabricating the liquid jet recording head arranged as described above will now be described with reference to FIGS. 49(*a–d*) and 50(*a–d*).

Figure 50A:
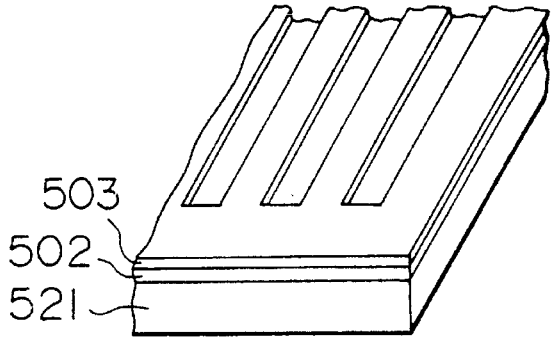
FIGS. 50(*a–d*) are schematic view which illustrates a method of fabricating the recording head according to the eleventh embodiment of the present invention.

First, a substrate in which the heat regenerating layer 502 made of $SiO_2$ is formed on the substrate 521 made of Si is prepared. Then, the heat-generating resistance layer 503 made of a material which supplies electrons is formed on the aforesaid substrate by the sputtering method. Then, the heat-generating resistance layer 502 is patterned by the photolithography method, so that an electrode pattern serving as the under layer made of a material which supplies electrons is formed by the organic metal CVD method (see FIGS. 49A and 50A).

Figure 50B:
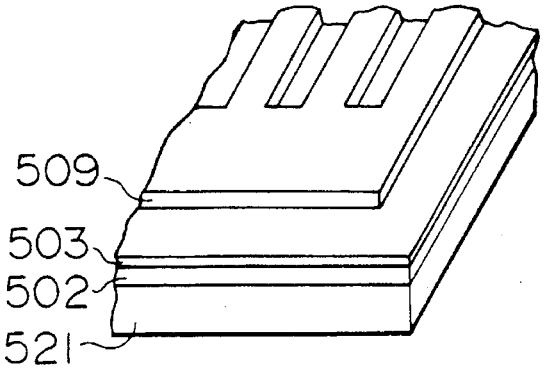

Then, a first protection layer 509 made of $SiO_2$, which is the material which does not supply electrons, is formed on the aforesaid pattern by an RF sputtering apparatus. Furthermore, a portion of the $SiO_2$ film in which the electrode will be formed by the patterning operation by the photolithography method is removed (see FIGS. 49B and 50B).

Figure 50C:
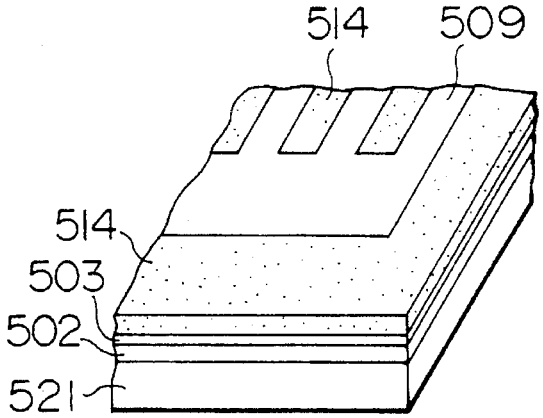

Then, the aforesaid organic metal CVD film forming apparatus is used to form an Al film to make the thickness to be the same as the thickness of the first protection layer 509, and the groove portion of the first protection layer 509 is plugged, so that the electrode 514 is formed. As a result of the observation of the state in which the film was formed, Al was selectively deposited on the $HfB_2$ portion which is the material for supplying electrons but Al was not deposited on the $SiO_2$ portion which is the material which does not supply the electrons (see FIGS. 49C and 50C).

Figure 49D:
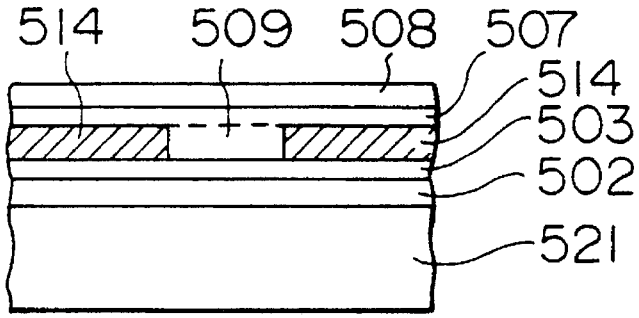
Figure 50D:
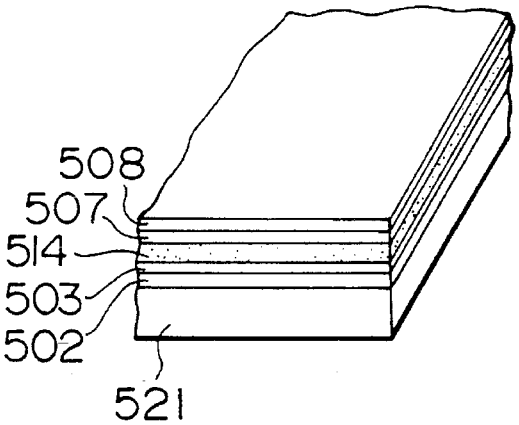

Finally, the $SiO_2$ layer is formed by the RF sputtering method, so that the second protection layer 507 is formed (see FIGS. 49D and 50D).

Furthermore, in order to improve the durability of the second protection film 507 against the damage due to the cavitation, the cavitation-resisting layer 508 made of Ta is formed on the second protection layer 507 by using the sputtering apparatus. Thus, the liquid jet recording head substrate is obtained.

Figure 51:
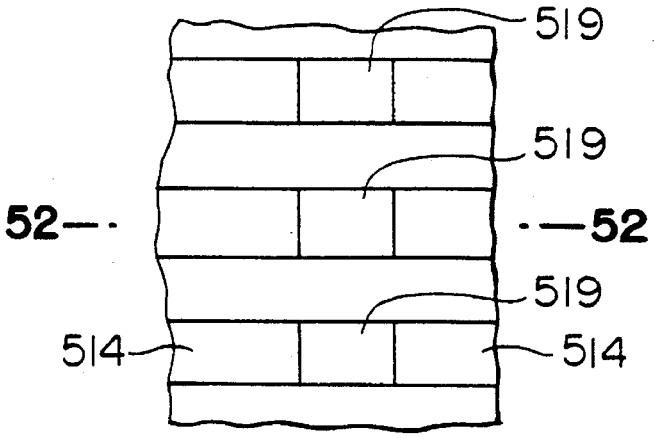
FIG. 51 is a schematic top view which illustrates a substrate for the recording head according to an eleventh embodiment of the present invention.
Figure 52:
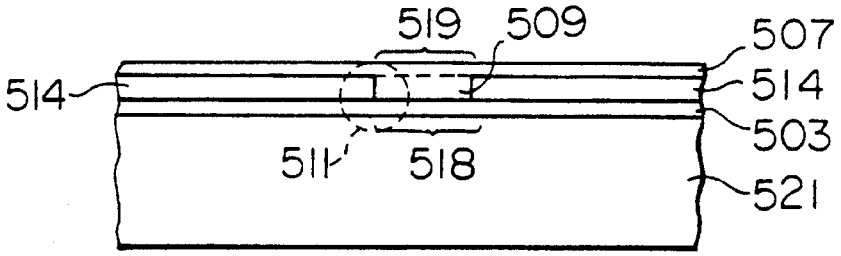
FIG. 52 is a schematic cross sectional view taken along line 52—52 of FIG. 51.

FIGS. 51 and 52 respectively are a top view which illustrates an example of the liquid jet recording head obtainable by employing the fabricating method according to the present invention and a cross sectional view taken along line 52—52 of FIG. 51 and illustrating a portion including the thermal energy generating means of the recording head.

As shown in FIGS. 51 and 52, the liquid jet recording head applied to the present invention comprises, on the substrate 521, the heat-generating resistance layer 503, at least one pair of thermal energy generating means serving as at least a pair of electrodes 514 electrically connected to the heat-generating resistance layer, the protection layer 509 formed in a portion in which no electrode is present, and the second protection layer 507 formed above the aforesaid layers. Reference numeral 519 represents a heat effecting surface formed between the electrodes 514 and acting to transfer heat generated by the heat generating portion 518 of the heat-generating resistance layer 503 to the recording liquid, the heat generating portion 518 generates heat when it is supplied with electricity. No stepped portion 511 is formed between the heat-generating resistance layer 503 and the electrode 514.

According to this embodiment, the electrode 514 is formed to have substantially the same thickness as that of the first protection layer 509 by employing the organic metal CVD method. Therefore, the projection and pits of the surface of the electrode can be prevented as compared with the conventional example. As a result, the top surface of the first protection layer 509 and that of the electrode 514 can be flattened. Thus, the conventional defects such as the non-uniformity which causes the pin hole or the cracks to be generated in the second protection layer 507 can be prevented. As a result, even if the thickness of the second protection layer 507 is reduced, an excellent step coverage can be obtained. Incidentally, since there is no stepped portion according to this embodiment, the thickness of the second protection layer 507 may be about the half of the thickness of the electrode 514.

Figure 53:
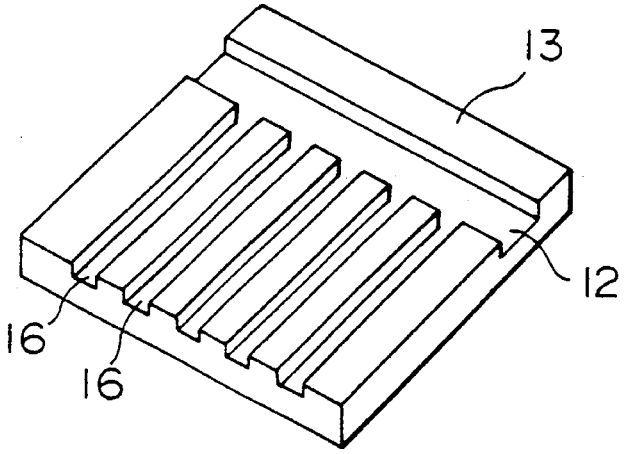
FIG. 53 is a schematic top view which illustrates a ceiling board of the recording head according to the eleventh embodiment of the present invention.
Figure 54:
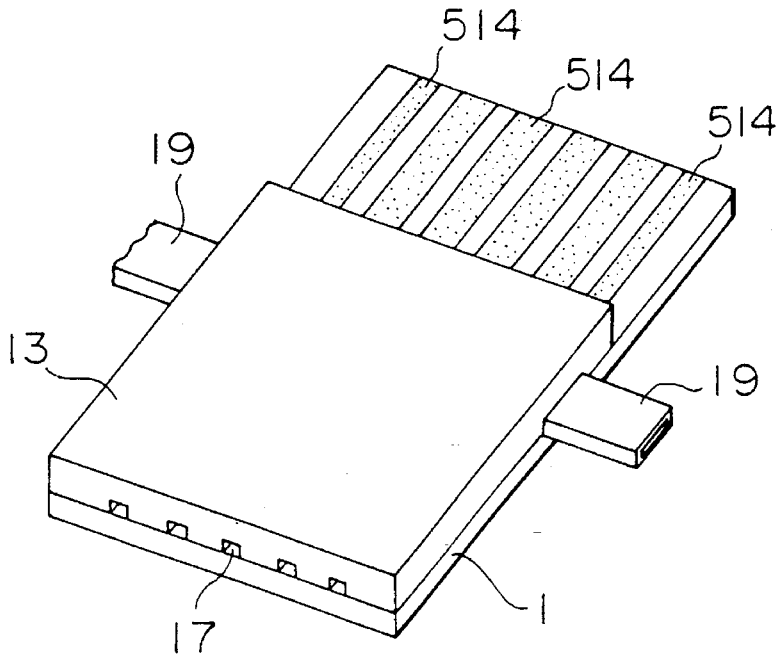
FIG. 54 is a schematic perspective view which illustrates the appearance of the recording head according to the present invention.

As shown in FIG. 53, a groove for forming a liquid passage 16 (40 μm wide and 40 μm high) serving as the working chamber is formed in the ceiling board 13 by cutting with a micro-cutter. The liquid passage 12 is a groove serving as a common liquid chamber for supplying recording liquid. A liquid supply pipe 19 is connected to the common liquid chamber 12 as a required manner as shown in FIG. 54. The recording liquid is introduced in this liquid supply pipe 19 from outside the recording head. When the ceiling board 13 is connected, locating must be performed accurately so as to make each of the thermal energy generating means correspond to the liquid passage 14. As described above, the ceiling board 13 and the substrate 521 are connected to each other and a liquid discharge port 17 communicated with the working chamber is formed. Furthermore, a lead substrate (omitted from illustration) having an electrode lead for supplying a desired pulse signal from outside of the recording head is provided for the electrode 514. Thus, the recording head substrate arranged as shown in FIG. 54 is fabricated.

Although omitted from the description, the liquid discharge port or the liquid passage may be formed by another method in which the plate having the groove arranged as shown in FIG. 53 is not used. It may be formed by patterning a photosensitive resin. Furthermore, the present invention is not limited to the multi-array type liquid jet recording head having a plurality of liquid discharge ports as described above. It may, of course, be applied to a single array type liquid jet recording head having one liquid discharge port.

[Twelfth Embodiment]

Figure 55:
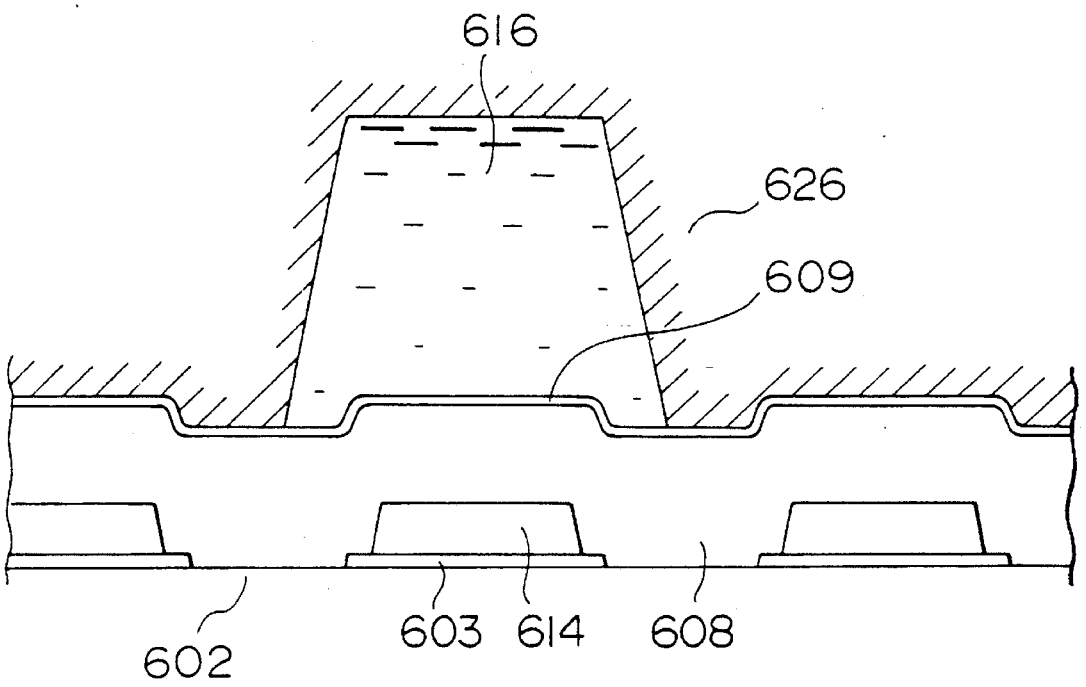
FIG. 55 is a schematic view which illustrates an effect of a twelfth embodiment of the present invention.
Figure 56:
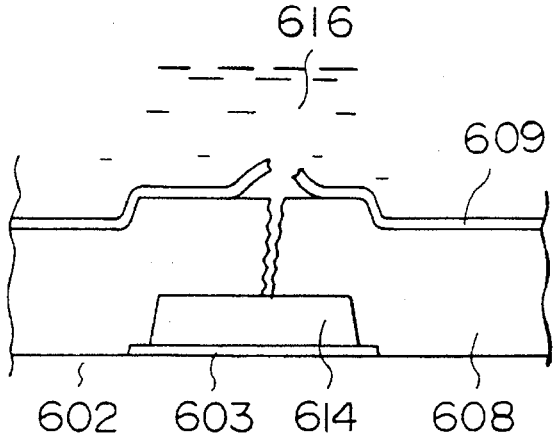
FIG. 56 is a schematic view which illustrates an effect of the twelfth embodiment of the present invention.

A schematic cross section of a liquid jet recording head is shown in FIG. 55.

The liquid jet recording head is fabricated as follows:

First, an $SiO_2$ film 602 serving as a heat regenerating layer is formed on a substrate to have a thickness of 2 to 3 μm by, usually, the heat oxidation method, the CVD method or the sputtering method, or the like. The $SiO_2$ film 602 is provided for the purpose of preventing deterioration in the heat efficiency due to the escape of heat generated in a heat-generating resistance layer to be described later to the substrate, the heat regenerating layer being made of an insulating material having an adverse thermal conductivity. On the $SiO_2$ film 602, a $HfB_2$ film 603 serving as the heat-generating resistance layer is formed by, for example, the sputtering method. Furthermore, an Al film is, as the wiring material, formed by, for example, the sputtering method, and then the Al film is patterned, so that an Al electrode 614 is formed and the electro-thermal transducer is thus fabricated.

Then, an $SiO_2$ film 608 serving as a protection film exhibiting excellent heat resistance and ink shielding performance is, if necessary, formed to have a thickness of 1 to 2 μm in order to prevent electric corrosion and oxidation due to the recording liquid.

However, the $SiO_2$ film 608 is too weak to withstand the cavitation due to the generation and disappearance of bubbles in the recording liquid when electricity is supplied to the electro-thermal transducer. Therefore, a method in which a cavitation-resisting film 609 made of Ta, Mo, or W, or the like is formed is usually employed in order to improve the reliability of the recording head. In a case where Ta is employed to form the cavitation-resisting layer, the most suitable variable processing conditions are employed in order to improve the facility of the adhesion to the $SiO_2$ film 608 serving as the base layer. As a result of the study made up to now, the temperature of the substrate at the time of forming the film is determined to be at about 200° C., Ta is used as the target material, the pressure of the Ar gas is determined to be $10^{-3}$ to $10^{-4}$ Torr, oxygen is used as the sputtering gas, and a $Ta_2O_5$ film is formed on the $SiO_2$ film 14 to have a thickness of about 100 Å. By forming the cavitation-resisting film 609 on the $Ta_2O_5$ film, a relatively strong adhesion force can be obtained.

In order to form a supply passage through which recording liquid 616 is supplied to the surface of the cavitation-resisting film 609 thus formed, a ceiling board 62 made of a photosensitive resin, a glass plate or a resin molded element is disposed.

If a gap is, at this time, present between the wall of the adjacent recording liquid supply passage and the surface of the Ta film serving as the cavitation-resisting layer, forming of a bubble by a certain nozzle affects the forming of the bubble by the adjacent nozzle. That is, a phenomenon called "crosstalk" takes place and the printing performance of the liquid jet recording apparatus deteriorates. Therefore, it is preferable that the surface of the Ta film be a flat surface having no stepped portion.

As described above, a variety of factors can be considered to improve the adhesion force between the cavitation-resisting layer and the base $SiO_2$ film. In order to maintain the yield of the mass-produced products at a constant level, each of the factors must be paid attention to.

Furthermore, it is necessary to prevent the contamination of the surface of the $SiO_2$ film 14 by dust or the like generated due to the incomplete result of the cleaning process or generated during the film forming process. However, it is difficult to completely monitor the above-mentioned factor and a lack of adhesion force rarely took place due to an unknown cause. As a result, the Ta film is separated at the boundary surface with the $SiO_2$ film due to the internal process or the like and therefore the raised $SiO_2$ film 608 is damaged by the cavitation. In this case, the recording liquid 616 is introduced into the backside of the Ta film 609 and the protection film 608 can be eroded. As a result, the Al electrode 614 and the recording liquid 616 sometimes directly come in contact with each other, causing the recording liquid to be electrolyzed, or the Al electrode 614 and the recording liquid 616 to react with each other at the time of supplying electricity to the heat-generating resistance layer 603, causing the electrode 614 or the heat-generating resistance layer 603 to be sometimes damaged or broken.

As described above, the contamination of the surface of the base $SiO_2$ film 608 or the change in the determined conditions of the sputtering apparatus for use to form the Ta film is able to cause the deterioration in the adhesion force between the Ta film and the $SiO_2$ film.

If the bubble forming/discharging operation performed by the liquid jet recording apparatus is continued in a state where the adhesion force between the cavitation-resisting film and the $SiO_2$ film has deteriorated, the cavitation-resisting film is separated from the base $SiO_2$ film and therefore the performance of the cavitation film deteriorates. As a result, the recording liquid reaches the Al electrode or the heat-generating resistance layer, causing a failure of disconnection to take place and a problem of the deterioration in the reliability of the liquid jet recording apparatus takes place.

In order to overcome the aforesaid problems, the recording head substrate according to this embodiment comprises: a substrate; an electro-thermal transducer formed on the substrate and having a heat-generating resistance layer and an electrode formed on the heat-generating resistance layer; an electron-supplying material layer formed at a predetermined position of the substrate and formed into a land-like pattern; a protection film for covering the electro-thermal transducer and having an opening formed to open in the land-pattern electron-supplying material layer; an aluminum layer or an aluminum alloy layer injected into the opening; and a cavitation-resisting layer formed to cover the protection film and the aluminum layer or the aluminum alloy layer.

The recording head according to this embodiment comprises: a recording head substrate having a substrate; an electro-thermal transducer formed on the substrate and having a heat-generating resistance layer and an electrode formed on the heat-generating resistance layer; an electron-supplying material layer formed at a predetermined position of the substrate and formed into a land-like pattern; a protection film for covering the electro-thermal transducer and having an opening formed to open in the land-pattern electron-supplying material layer; an aluminum layer or an aluminum alloy layer injected into the opening; and a cavitation-resisting layer formed to cover the protection film and the aluminum layer or the aluminum alloy layer; and a recording liquid discharge port formed in the recording head substrate and acting to discharge the recording liquid by utilizing thermal energy supplied from the heat-generating resistance layer.

A method of fabricating the recording head according to this embodiment comprises the processes of: a process for forming a heat-generating resistance layer on a substrate; a process for forming an electrode on the heat-generating resistance layer and forming a land-pattern electron-supplying material layer at a desired position of the substrate; a process for forming a protection film for covering the outer surface of the substrate, the heat-generating resistance layer, the electrode and the electron-supplying material layer; a process for patterning the protection film to form an opening in which the electron-supplying material layer; a process for selectively forming an aluminum layer or an aluminum alloy layer in the opening by an organic metal CVD method; and a process for covering the protection film and the metal film with a cavitation-resisting layer.

According to this embodiment, the Al film or the Al alloy film is selectively and vertically formed on the land-pattern portion made of the electron-supplying material by the Al-CVD method. Therefore, the cavity which cannot be prevented according to the conventional structure can be prevented. Furthermore, the cavitation-resisting film can be flattened by suitably determining the film forming time. Therefore, the gap between the ceiling board and the recording head substrate can be prevented, causing the crosstalk to be prevented.

Furthermore, according to the present invention, Al or the Al alloy is selectively formed in the opening of the protection film by the Al-CVD method, so that the adhesive property between the cavitation-resisting layer and the protection film can be improved.

Figure 57A:
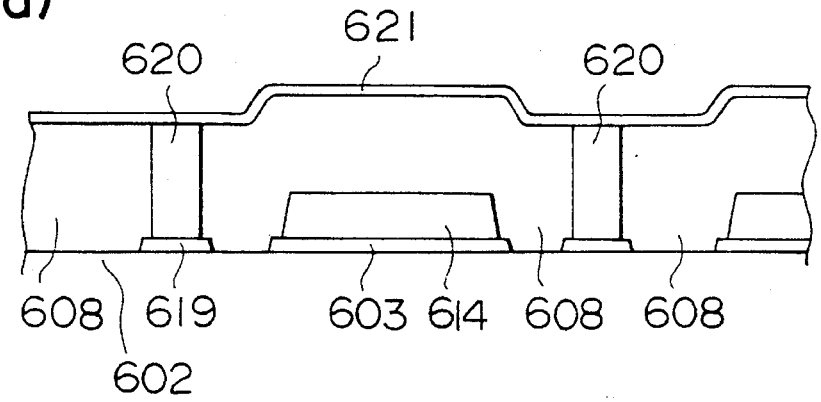
FIG. 57(*a*) and 57(*b*) are schematic view which illustrates and recording head according to the twelfth embodiment of the present invention.
Figure 57B:
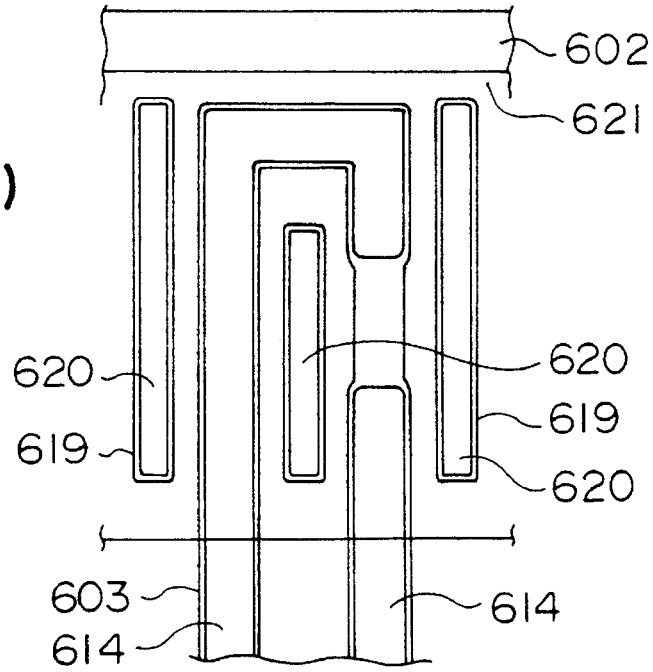

FIGS. 57A and 57B respectively are a cross sectional view and a top view of the recording head substrate according to this embodiment.

The $SiO_2$ film 602 serving as the heat regenerating layer is formed on a silicon wafer (omitted from illustration) serving as the substrate to have a thickness of 2 to 3 μm. Then, the $HfB_2$ film made of the electron-supplying material is formed on the $SiO_2$ film 602, and then the Al electrode layer is formed. It is then patterned so that the $HfB_2$ film 603 serving as the heat-generating resistance layer and the Al electrode 614 are formed. Thus, the electro-thermal transducer is formed.

Furthermore, a land-pattern electron-supplying material layer 619 made of $HfB_2$ is formed between the portions of the $HfB_2$ film 603 at the time of forming the aforesaid pattern.

Then, the $SiO_2$ film 608 serving as the ink-resisting protection film is formed on the electro-thermal transducer to have a thickness of 1 to 2 μm.

Then, the land-pattern $HfB_2$ film 619 is patterned and a through hole is formed. When Al is deposited in the through hole by the Al-CVD method, Al can be selectively and vertically deposited on the $HfB_2$ film 619 because $HfB_2$ is a material which supplies electrons. Since the $SiO_2$ film 608 does not supply electrons, Al is not deposited.

Furthermore, the Ta film 621 is formed as the cavitation-resisting layer on the Al layer 620 selectively deposited in the through hole of the protection layer 608 and the $SiO_2$ film 608 which is the ink-resisting protection film. Since the Al layer 620 is made of metal, excellent affinity can be obtained between Al and Ta if the Ta film is formed by sputtering or the evaporating method. As a result, the adhesive property between the Ta film 621 and the Al layer 620 can be improved.

As a result, the conventional problem of the separation of the Ta film 621 from the base $SiO_2$ film 608 can be prevented even if the bubble-forming in the ink/discharging operation is continued. Therefore, the cavitation resistance of the Ta film 621 can be improved, causing the breakage of the Ta film 621 due to the cavitation to be prevented. Therefore, the electrolysis of the recording liquid due to the supply of the electricity, or the reaction between the electrode and the recording liquid taken place at the time of supplying the electricity to the heat-generating resistance layer and causing the damage or the breakage of the electrode and the heat-generating resistance layer can be prevented. Therefore, the reliability of the recording head substrate can be improved.

Since the Al-CVD method is a film forming method exhibiting excellent selectivity, conductive materials such as Al—Si, Al—Ti, Al—Cu, Al—Si—Ti, Al—Si—Cu can be selectively deposited by properly combining gases to realize a mixture gas atmosphere.

Although the Ta film is used as the cavitation-resisting film in this embodiment, metal such as W, Mo or Nb, or the like, or their alloy may be used to achieve the object of the present invention.

Figure 58:
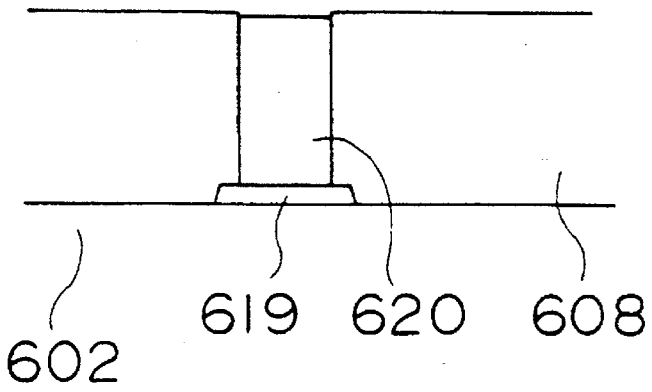
FIG. 58 is a schematic cross sectional view which illustrates a portion of the recording head according to the twelfth embodiment of the present invention.

FIG. 58 is a partial cross sectional view which illustrates the recording head substrate. The reference numerals of the elements shown in FIG. 58 represent the same elements as those shown in FIG. 57. By properly determining the film forming time, Al can be deposited to form a flat portion in cooperation with the $SiO_2$ film 608. Therefore, even if the ceiling board is provided for the cavitation-resisting layer (omitted from illustration) when the recording head is fabricated, the cavitation-resisting layer is flat and therefore no gap is formed between the ceiling board and the cavitation-resisting layer. As a result, the crosstalk can be prevented. Consequently, the printing performance cannot be adversely affected and therefore a recording head exhibiting excellent ink discharge performance can be provided.

[Thirteenth Embodiment ]

Figure 59:
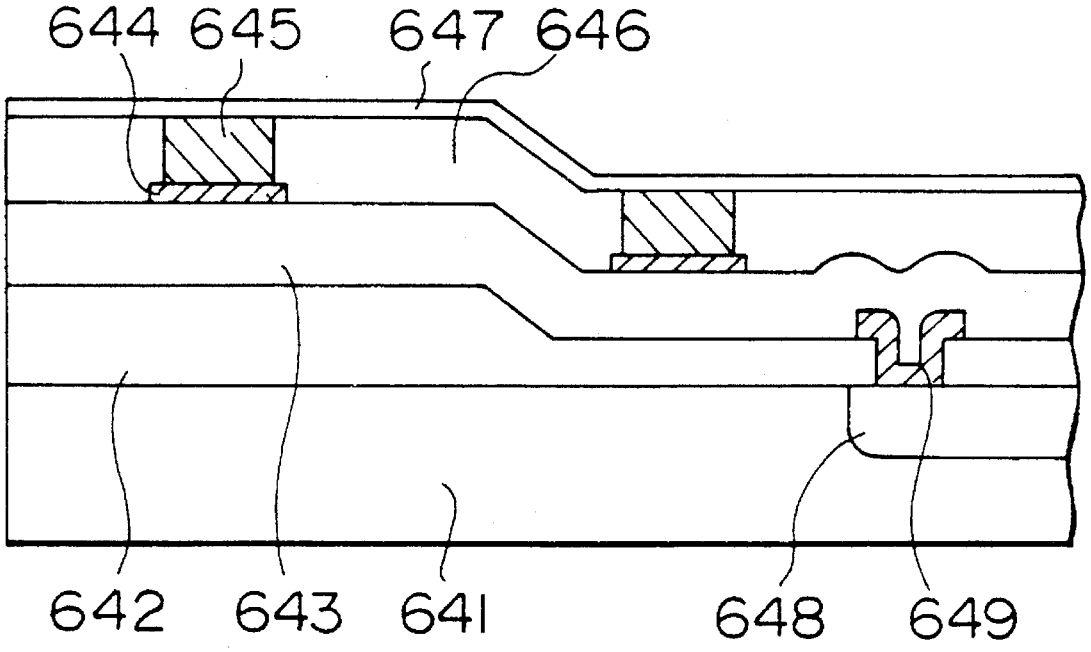
FIG. 59 is a schematic cross sectional view which illustrates a recording head according to a thirteenth embodiment of the present invention.

FIG. 59 is a schematic cross sectional view which illustrates another embodiment of the recording head substrate according to the present invention.

FIG. 59 illustrates a structure in which an electro-thermal transducer and a functional device such as a device array for separating a drive signal for driving the electro-thermal transducer are provided on a P- or N-type silicon substrate.

The recording head substrate can be fabricated as follows:

First, a diffusion layer 648 which forms an N- (or P-) type functional device is formed on a P- (or N-) type silicon substrate 641. On this diffusion layer 648, an $SiO_2$ film 642 serving as both an insulating layer and a heat regenerating layer is formed, and then it is patterned. Then, an Al taking electrode 649 is formed, and then it is formed into a desired shape by patterning. Furthermore, an $SiO_2$ film 643 serving as both an insulating layer and a heat regenerating layer is formed on the $SiO_2$ film 642 and the Al taking electrode 649 before it is patterned. The $SiO_2$ film 642 and the $SiO_2$ film 643 form a double-layer structure which serve as a heat regenerating layer. Furthermore, the $HfB_2$ film serving as the heat-generating resistor and the Al electrode are formed on the heat regenerating layer, so that the electro-thermal transducer is fabricated. However, only a $HfB_2$ film 644 serving as the base layer for improving the adhesion force is illustrated in FIG. 59.

The $HfB_2$ film is formed before it is patterned, and then an $SiO_2$ protection film 646 is formed.

Then, a through hole for the Al electrode is patterned so that the hole is formed in the $HfB_2$ film 644. Then, Al is selectively deposited by the Al-CVD method while using the $HfB_2$ film 644 as the base layer, so that an Al layer 645 is formed.

Since the $HfB_2$ film 644 is made of the material which supplies electrons, Al can be selectively and vertically deposited on the $HfB_2$ film 644. On the other hand, since the $SiO_2$ protection film 646 is made of the material which does not supply electrons, Al is not deposited on the $SiO_2$ protection film 646. A Ta layer 647 serving as the cavitation-resisting layer is formed on the Al layer 645 and the $SiO_2$ protection film 646 by the sputtering method or the evaporation method. Since the Al layer 645 is a metal layer, excellent affinity is obtained between Al and Ta. Therefore, the adhesive property between the Al layer 645 and the Ta film 647 can be improved.

The recording head substrate shown in FIG. 59 is arranged in such a manner that the Al electrode is formed into a double-layer structure for establishing the connection between the electro-thermal transducer and the functional device.

It is preferable that the recording head substrate arranged as shown in FIG. 59 be arranged in such a manner that the $HfB_2$ film 644 placed adjacent to the recording liquid is used as the base layer and the Al electrode is formed by the Al-CVD method. However, if the $SiO_2$ protection film 646 and the $SiO_2$ film 642 are patterned to form an opening and a through hole in which the base silicon substrate 641 appears outside is formed, Al or the Al alloy is selectively and vertically deposited on the silicon substrate because the silicon substrate 641 is made of the electron-supplying material. Therefore, if the Ta film serving as the cavitation-resisting film is formed on the thus formed Al film or the Al alloy film by the sputtering method or the evaporating method, excellent affinity can be obtained since both Al and Ta are metal. Therefore, the adhesive property between the Al film or the Al alloy film and the Ta film can be improved.

The recording head substrate thus fabricated is used to fabricate a recording head.

Figure 60:
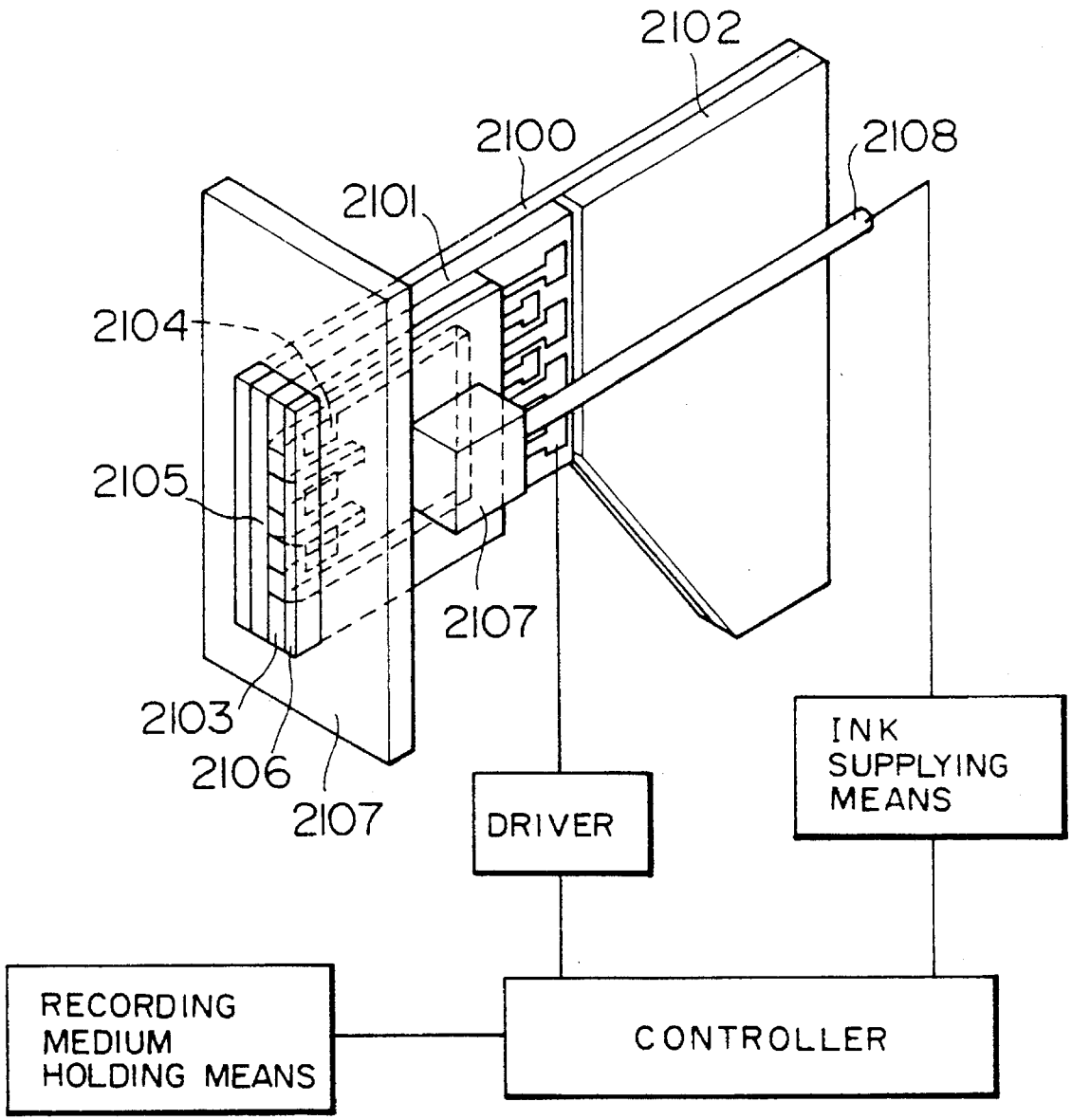
FIG. 60 is a schematic view which illustrates the recording head according to the present invention.

FIG. 60 is a perspective view which illustrates the recording head according to the present invention.

A heater board 2101, in which a heat-generating device 2104 is formed on a recording head substrate by patterning, is bonded to the upper surface of an aluminum base plate 2100. The heater board 2101 is bonded to the upper surface of the aluminum base plate 2100 and, by wire bonding, connected to a printed circuit substrate 2102 having an external taking terminal for establishing an electrical connection with the outside (a driver). A liquid passage may be formed in the heater board 2101 by patterning a dry film 2103 or the same may be formed in a proper flat plate such as glass by a mechanical method or the etching method or the like.

Furthermore, a ceiling board 2106 made of glass or the like is bonded to the upper surface of the dry film 2103, and then a photosensitive composition layer formed on a recording head substrate in which the nozzle and the ink discharge port will be formed is subjected to a predetermined pattern exposure, so that a solid region is formed. Then, non-solidified compositions are removed from the photosensitive composition layer, so that a groove to form the ink passage is formed in the recording head substrate.

As an alternative to this, the ceiling board for the recording head may be fabricated in the following processes: a photosensitive resin is applied to the substrate, a ceiling board made of glass is placed and bonded to it, and unnecessary portions of the photosensitive resin are removed so that the ink discharge port, the ink passage and the common liquid chamber are formed by the photosensitive resin.

On the ceiling board 2106, a member 2107 for forming the ink supply passage and a tube 2108 for supplying ink from outside (ink supply means) are bonded. The head is positioned at a predetermined position with respect to the recording medium holding means when recording is performed.

As described above, according to this embodiment, the Al film or the Al alloy film is selectively and vertically formed on the land-type pattern portion made of the electron-supplying material by the Al-CVD method. Therefore, the cavity, which cannot be eliminated by the conventional technology, can be prevented. Furthermore, by suitably determining the film forming time, the cavitation-resisting film can be flattened, causing the gap between the ceiling board and the recording head substrate to be eliminated. As a result, the crosstalk can be prevented.

This embodiment is arranged in such a manner that Al or the Al alloy is selectively formed in the opening formed in the protection film by the Al-CVD method and the cavitation-resisting layer exhibiting excellent affinity is formed on it. Therefore, the adhesive property between the cavitation-resisting layer and the protection film can be improved as compared with the conventional technology.

Therefore, the $Ta_2O_5$ film which has been utilized as a material for improving the adhesive property can be omitted from the structure. As a result, the process for forming the film can be simplified and the through-put can be improved.

An ink jet recording head which uses the substrate 1 having the thus arranged thermal energy generating device is assembled by, for example, processes shown in FIGS. 61(*a–d*).

FIG. 61A is a perspective view which illustrates the schematic structure of the substrate. Referring to FIG. 61A, reference numeral 3010 represents an electro-thermal transducer serving as a discharge energy generating device. On an Si substrate 3001 on which the electro-thermal transducer 3010 is disposed, an ink passage wall 3011 and an outer frame 3012 made of a photosensitive resin solid film are formed as shown in FIG. 61B. Then, a cover 3013 for covering the ink passage wall 3011 is disposed on it. A filter 3015 is previously bonded to an ink supply hole 3014 formed at the central portion of the cover 3013. Then, the laminated member thus fabricated is sectioned by cutting at a plane along a line C–C' in order to section the ink discharge port (nozzle) and the electro-thermal transducer 3010 in the most suitable manner.

Then, as shown in FIG. 61C, the cover 3013 for covering the ink passage wall 3011 and the Si substrate 3001 are removed to a predetermined depth while leaving a portion which forms the ink passage in the peripheral portion of the orifice by cutting with a diamond cutting grindstone.

On the other hand, an orifice plate 3016 having orifices formed therein is previously bonded to a thin metal plate 3017 having an area larger than that of the periphery portion of the orifice in which the recording head is not cut.

Then, a member integrating the orifice plate 3016 and the thin plate 3017 is bonded to a surface 3001A and 3013A from the recording head has been removed by cutting after the orifices formed in the orifice plate 3016 and the opening formed in the laminated member are aligned to each other. As a result, the orifice plate 3016 can be brought into contact with the surface of the head in which the opening is formed under a tension applied thereto.

The present invention is particularly suitably usable in an ink jet recording head and recording apparatus wherein thermal energy by an electrothermal transducer, laser beam or the like is used to cause a change of state of the ink to eject or discharge the ink. This is because the high density of the picture elements and the high resolution of the recording are possible.

The typical structure and the operational principle are preferably the ones disclosed in U.S. Pat. Nos. 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleate boiling point, by which the thermal energy is provided by the electrothermal transducer to produce film boiling on the heating portion of the recording head, whereby a bubble can be formed in the liquid (ink) corresponding to each of the driving signals. By the production, development and contraction of the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion, as well as the structure of the combination of the ejection outlet, liquid passage and the electro-thermal transducer as disclosed in the above-mentioned patents. In addition, the present invention is applicable to the structure disclosed in Japanese Laid-Open Patent Application No. 123670/1984 wherein a common slit is used as the ejection outlet for plural electro-thermal transducers, and to the structure disclosed in Japanese Laid-Open Patent Application No. 138461/1984 wherein an opening for absorbing pressure wave of the thermal energy is formed corresponding to the ejecting portion. This is because the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head and plural recording head combined to cover the maximum width.

In addition, the present invention is applicable to a serial type recording head wherein the recording head is fixed on the main assembly, to a replaceable chip type recording head which is connected electrically with the main apparatus and can be supplied with the ink when it is mounted in the main assembly, or to a cartridge type recording head having an integral ink container.

The provisions of the recovery means and/or the auxiliary means for the preliminary operation are preferable, because they can further stabilize the effects of the present invention. As for such means, there are capping means for the recording head, cleaning means therefor, pressing or sucking means, preliminary heating means which may be the electrothermal transducer, an additional heating element or a combination thereof. Also, means for effecting preliminary ejection (not for the recording operation) can stabilize the recording operation.

As regards the variations of the recording head, it may be a single head corresponding to a signal color ink, or it may be plural heads corresponding to the plurality of ink materials having different recording color or density. The present invention is effectively applicable to an apparatus having at least one of a monochromatic mode mainly with black, a multi-color mode with different color ink material and/or a full-color mode using the mixture of the colors, which may be an integrally formed recording unit or a combination of plural recording heads.

Furthermore, in the foregoing embodiment, the ink has been liquid. It may be, however, an ink material which is solidified below the room temperature but liquefied at the room temperature. Since the ink is controlled within the temperature not lower than 30° C. and not higher than 70° C. to stabilize the viscosity of the ink to provide the stabilized ejection in usual recording apparatus of this type, the ink may be such that it is liquid within the temperature range when the recording signal in the present invention is applicable to other types of ink. In one of them, the temperature rise due to the thermal energy is positively prevented by consuming it for the state change of the ink from the solid state to the liquid state. Another ink material is solidified when it is left, to prevent the evaporation of the ink. In either of the cases, the application of the recording signal producing thermal energy, the ink is liquefied, and the liquefied ink may be ejected. Another ink material may start to be solidified at the time when it reaches the recording material. The present invention is also applicable to such an ink material as is liquefied by the application of the thermal energy. Such an ink material may be retained as a liquid or solid material in through holes or recesses formed in a porous sheet as disclosed in Japanese Laid-Open Patent Application No. 56847/1979 and Japanese Laid-Open Patent Application No. 71260/1985. The sheet is faced to the electro-thermal transducers. The most effective one for the ink materials described above is the film boiling system.

The ink jet recording apparatus may be used as an output terminal of an information processing apparatus such as computer or the like, as a copying apparatus combined with an image reader or the like, or as a facscimile machine having information sending and receiving functions.

It is preferable to employ a vapor deposition method such as the CVD method and the sputtering method as the selective deposition method according to the present invention.

The material to be selectively deposited is exemplified by a semiconductor material such as Si and Ge, and a metal material such as Al, Cu, W, and Mo. If the semiconductor material is used, it is preferable to employ the selective epitaxial growing method. If the metal material is used, it is preferable to employ the bias sputtering method or the MOCVD method. Among others, the following MOCVD method is suitable as the selective deposition method according to the present invention.

In particular, as the raw material gas, monomethyl aluminum hydride (MMAH) or dimethyl aluminum hydride (DMAH) is used and $H_2$ gas is used as the reaction gas, and the surface of the substrate is heated under the aforesaid mixture gas, so that excellent Al film can be deposited. When Al is selectively deposited, it is preferable to maintain the surface temperature of the substrate at a temperature higher than a temperature at which alkyl aluminum hydride is decomposed and lower than 450° C., more preferably 260° C. or higher and 440° C. or lower.

The method of heating the substrate preferably to the aforesaid temperature range is exemplified by direct heating method and an indirect heating method. In particular, if the substrate is maintained at the aforesaid temperature by the direct heating method, Al exhibiting excellent quality can be deposited at high deposition speed. For example, if the temperature of the surface of the substrate is made to be in the preferable temperature range from 260° C. to 440° C. at the time of forming the Al film, an excellent film can be obtained at a higher deposition speed of 300 Å to 5000 Å/minute than that realized at the time of the resistance heating operation. The direct heating method (energy supplied from the heating means is directly transferred to the substrate to heat the substrate) is exemplified by a heating with a lamp such as a halogen lamp or a xenon lamp. The indirect heating method is exemplified by a resisting heating method which uses, for example, a heating member provided for a substrate supporting member for supporting the substrate on which the deposited film will be formed, the substrate supporting member being disposed in a space for forming the deposited film.

By using any one of the aforesaid methods and by subjecting the substrate in which both a surface portion which gives electrons and a surface portion which does not give electrons are present to the CVD method, a single Al crystal can be selectively formed only on the portion of the surface of the substrate which gives electrons. The thus formed Al portion exhibits excellent characteristics required for the electrode/circuit material. That is, the probability of the generation of hillocks and that of the generation of the alloy spikes can be lowered.

The reason for this can be considered that excellent Al can be selectively formed on the surface of a semiconductor which gives electrons or the surface of the conductive member. Furthermore, since Al thus formed exhibits excellent crystallinity, the generation of the alloy spikes due to the eutectic reaction with silicon or the like present in the base layer can be prevented or reduced significantly. If it is employed to form the electrode for the semiconductor device, an effect which has not been expected to be realized as the Al electrode by the conventional technology can be obtained.

Although the description is made a fact that Al, which is deposited in the opening which is formed in the electron-supplying surface, for example, an insulating film and in which the surface of the semiconductor substrate appears, becomes a single crystal structure, any one of the following metal films having Al as the main component can be selectively deposited according to the Al-CVD method, resulting in the excellent film quality.

For example, an atmosphere of a mixture gas is prepared by properly combining an alkyl aluminum hydride gas, hydrogen and a gas containing Si atoms such as $SiH_4$, $Si_2H_6$, $Si_3H_8$, Si $(CH_3)_4$, $SiCl_4$, $SiH_2Cl_2$, $SiHCl_3$ and the like, or a gas containing Ti atoms such as $TiCl_4$, $TiBr_4$, Ti $(CH_3)_4$ and the like, or a gas containing Cu atoms such as bisacetylacetonacopper Cu $(C_5H_7O_2)$, bisdipivaloylmethanitecopper Cu $(C_{11}H_{19}O_2)_2$, bishexafuloroacetylacetonacopper Cu $(C_5HF_6O_2)_2$, and then a conductive material such as Al—Si, Al—Ti, Al—Cu, Al—Si—Ti, and Al—Si—Cu is selectively deposited to form the electrode.

The above-mentioned Al-CVD method is a film forming method exhibiting excellent selectivity and therefore excellent surface property can be obtained from the deposited film. Therefore, if the non-selective film forming method is employed in the ensuing deposition method and an Al-metal film or that having Al as the main component is formed on the selectively deposited Al film and $SiO_2$ serving as the insulating film, a metal film for use in a variety of purposes can be obtained as the wiring for a semiconductor device.

The metal film is exemplified by a combination of selectively deposited Al, Al—Si, Al—Ti, Al—Cu, Al—Si—Ti, and Al—Si—Cu, and non-selectively deposited Al, Al—Si, Al—Ti, Al—Cu, Al—Si—Ti, and Al—Si—Cu.

As the film forming method for the non-selective deposition, a CVD method except for the aforesaid Al-CVD method and the sputtering method may be employed.

(Film Forming Apparatus)

Then, a film forming apparatus for forming the electrode according to the present invention will now be described.

FIGS. 28 to 30(*a–c*) schematically illustrate a metal film continuously forming apparatus to which the above-mentioned film forming method is applied.

Figure 62:
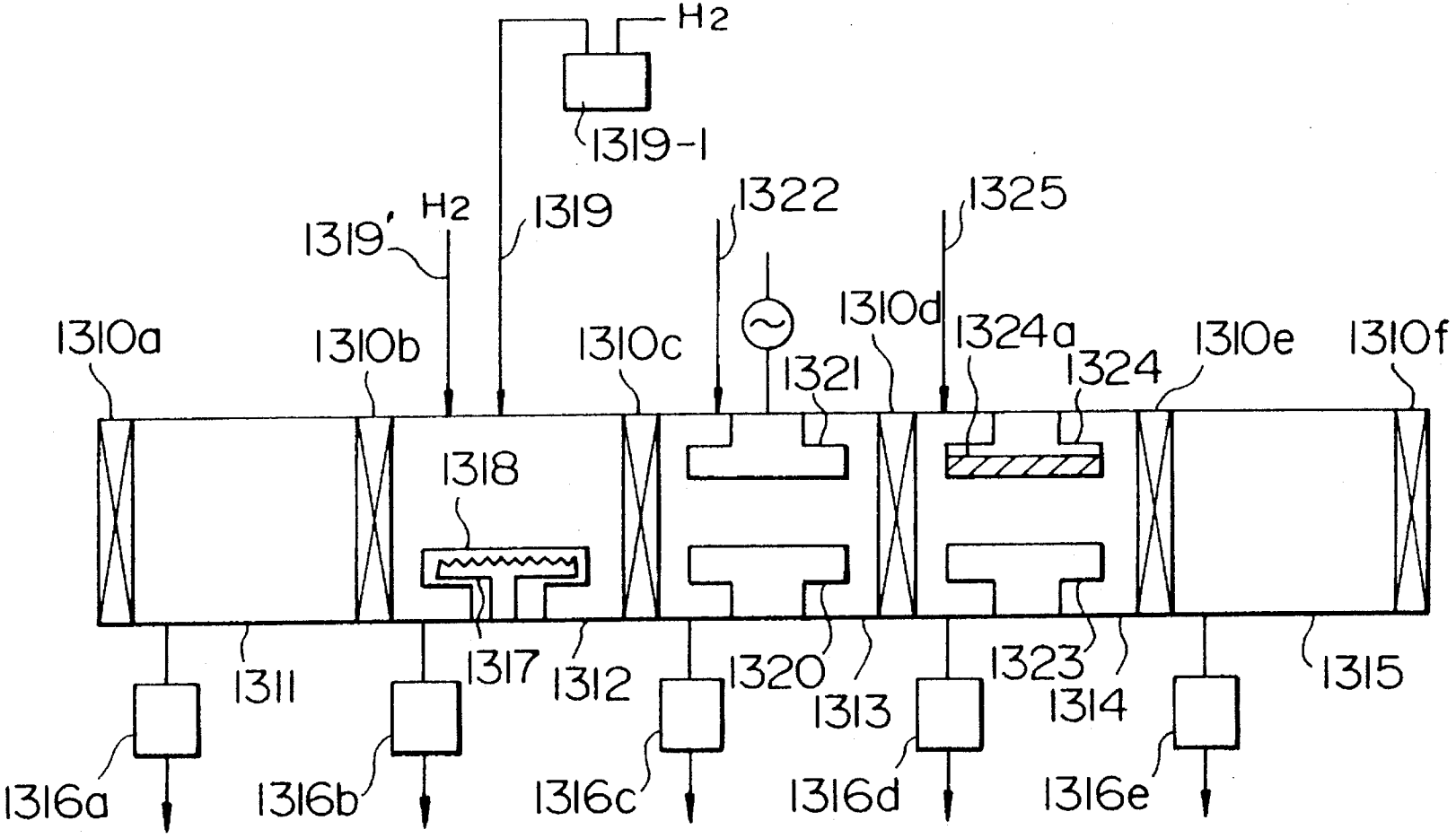
FIG. 62 is a schematic view which illustrates an example of a deposited film forming apparatus for use in the process of fabricating the recording head according to the present invention.

As shown in FIG. 62, the metal film continuously forming apparatus comprises load lock chambers 1311 disposed adjacently so as to be communicated with each other by gate valves 1310*a* to 1310*f* while shutting outside air, a CVD reaction chamber 1312 serving as the first film forming chamber, an RF etching chamber 1313, a sputtering chamber 1314 serving as the second film forming chamber, and a load lock chamber 1315. Each of the chambers are arranged to be exhausted by exhaust systems 1316*a* to 1316*e* so that its pressure can be lowered. The aforesaid load lock chamber 1311 is a chamber for substituting the atmospheric gas before the deposition process into an $H_2$ atmosphere after discharging the former atmospheric gas in order to improve the through-put. The ensuing CVD reaction chamber 1312 is a chamber for selectively depositing a film on the substrate at the atmospheric pressure or a reduced pressure by the aforesaid Al-CVD method, the CVD reaction chamber 1312 including a substrate holder 1318 having a heat-generating resistor 1317 capable of heating the surface of the substrate, on which a film will be formed, to at least a range from 200° C. to 450° C. Furthermore, it is arranged in such a manner that a raw material gas such as alkyl aluminum hydride gasified by a bubbling operation performed with hydrogen by a bubbler 1319-1 into the chamber thereof through a CVD raw material introducing line 1319 and a hydrogen gas is as a reaction gas is introduced to the same through a gas line 1319'. The ensuing RF etching chamber 1313 is a chamber for cleaning the surface of the substrate under Ar atmosphere after the selective deposition has been completed, the RF etching chamber 1313 including a substrate holder 1320 capable of heating the substrate to a temperature range from 100° C. to 250° C. and an RF etching electrode line 1321. Furthermore, an Ar gas supply line 1322 is connected to the RF etching chamber 1313. The sputter chamber 1314 is a chamber for non-selectively depositing a metal film on the surface of the substrate by sputtering under the Ar atmosphere, the sputter chamber 1314 including a substrate holder 1323 which is heated to at least a range from 200° C. to 250° C. and a target electrode 1324 to which a sputter target material 1324*a* is installed. Furthermore, an Ar gas supply line 1325 is connected to the sputter chamber 1314. The load lock chamber 1315 is an adjustment chamber acting prior to discharging outside the substrate on which the metal film has been deposited, the load lock chamber 1315 being arranged to substitute the atmosphere by $N_2$.

Figure 63:
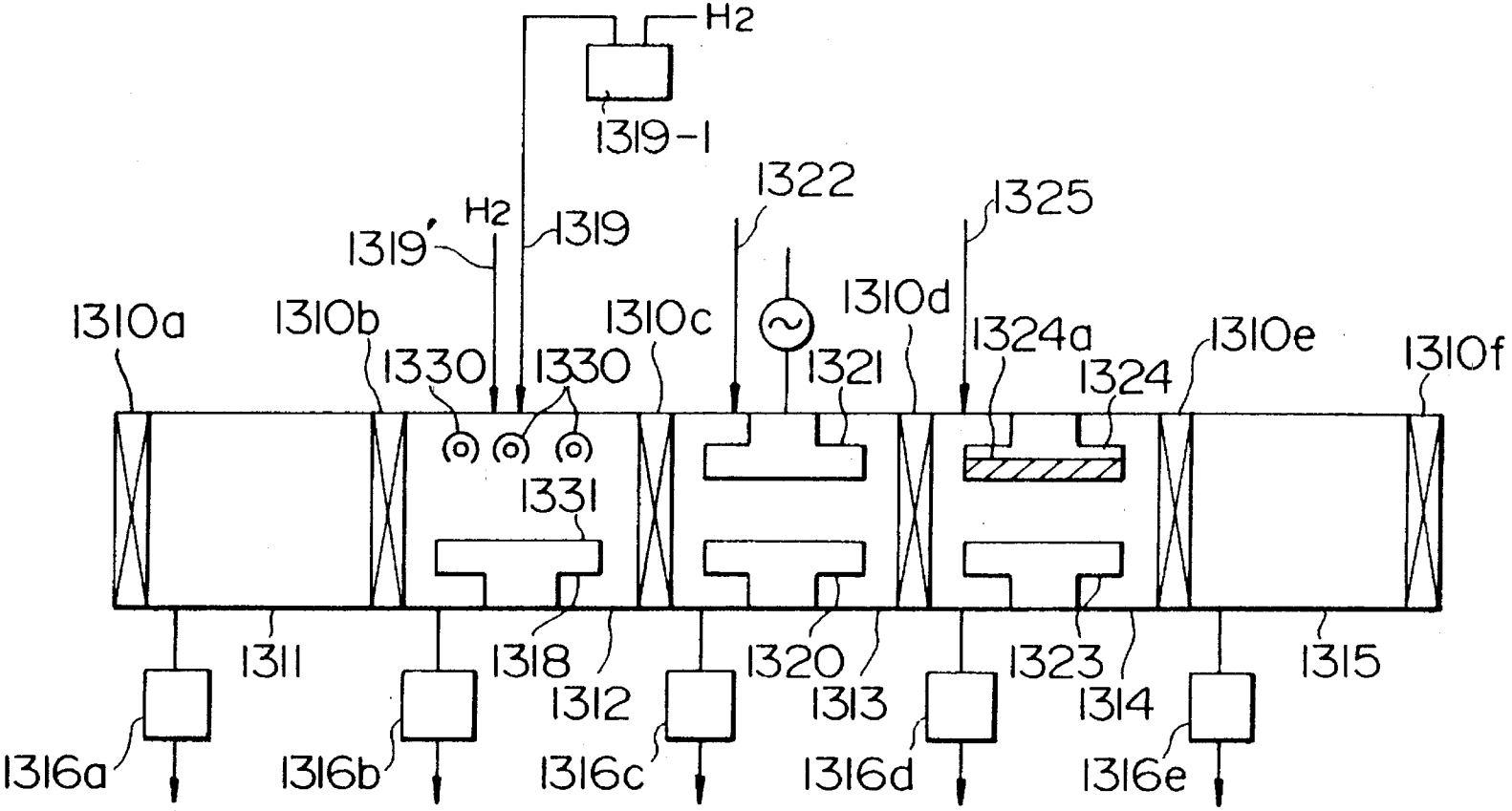
FIG. 63 is a schematic view which illustrates another example of the deposited film forming apparatus for use in the process of fabricating the recording head according to the present invention.

FIG. 63 illustrates another structure of the metal film continuously forming apparatus to which the aforesaid film forming method can be preferably applied, where the same elements as those shown in FIG. 62 are given the same reference numerals. The apparatus shown in FIG. 63 is different from the apparatus shown in FIG. 62 in the arrangement made in such a manner that a halogen lamp 1330 is provided as the direct heating means so that the surface of the substrate can be directly heated. In order to achieve this, a claw 1331 is provided for the substrate holder 1312 for holding the substrate while causing the same to floated.

Since the surface of the substrate is directly heated, the deposition speed can be further raised as described above.

Figure 64:
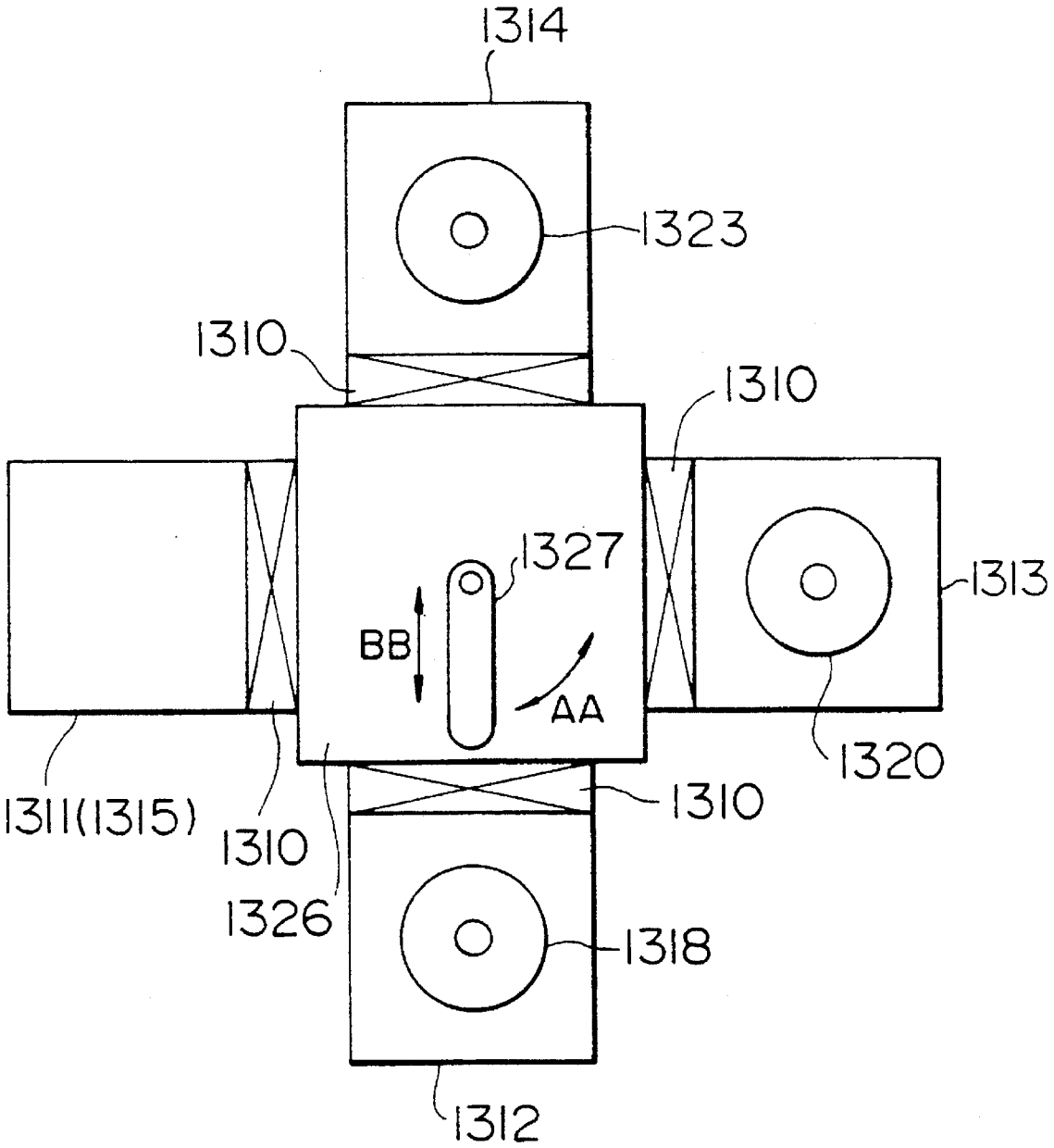
FIG. 64 is a schematic view which illustrates the operation of the deposited film forming apparatus for use in the process of fabricating the recording head according to the present invention.
Figure 65:
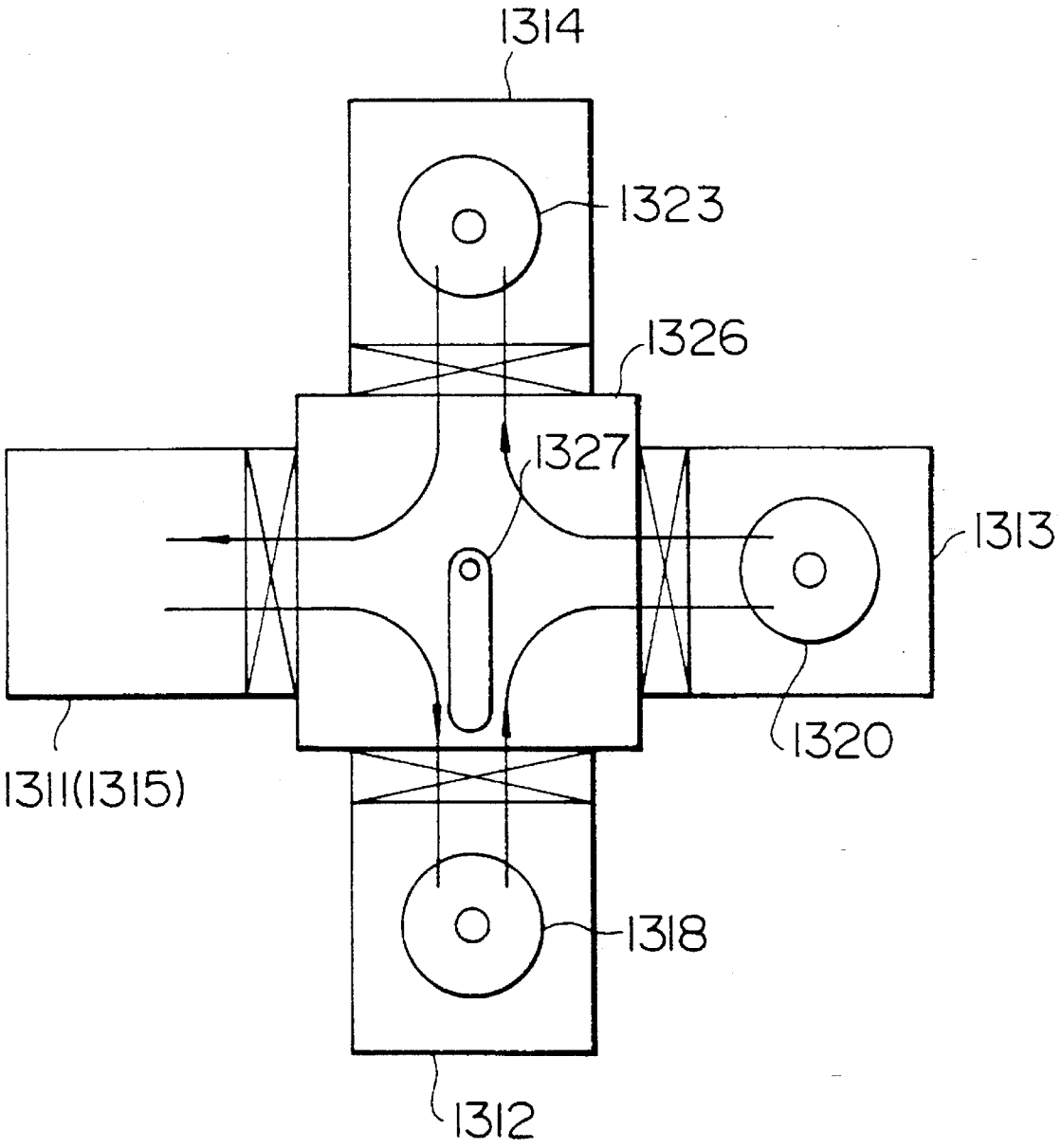
FIG. 65 is a schematic view which illustrates the operation of the deposited film forming apparatus for use in the process of fabricating the recording head according to the present invention.

The metal film continuously forming apparatus thus constituted is substantially equivalent to a structure arranged as shown in FIG. 64 in such a manner that the load lock chamber 1311, the CVD reaction chamber 1312, the RF etching chamber 1313, the sputtering chamber 1314 and the load lock chamber 1315 are mutually connected to one another while making a conveyance chamber 1326 to be a relay chamber. In this structure, the load lock chamber 1311 also serves as the load lock chamber 1315. The aforesaid conveyance chamber 1326 has an arm 1327 serving as a conveying means which can be rotated forwards/rearwards in direction AA and enlarging/contracting in direction BB as illustrated. By means of this arm 1327, the substrate can be continuously and sequentially moved as designated by an arrow of FIG. 65 from the load lock chamber 1311 to the load lock chamber 1315 via the CVD chamber 1312, the RF etching chamber 1313, and the sputter chamber 1314 while preventing exposure to the outside air.

(Film Forming Sequence)

Then, the sequence for forming the film for forming the electrode and the wiring according to the present invention will now be described.

FIGS. 66(*a–d*) are schematic perspective views which illustrate the sequential order of forming the electrode and the wiring according to the present invention.

First, the schematic sequence will now be described. A semiconductor substrate having an opening formed in an insulating film thereof is prepared. The substrate is placed in a film forming chamber and the temperature of the surface of the substrate is maintained at, for example, 260° C. to 450° C. In this state, Al is selectively deposited in a portion of an opening in which the semiconductor appears outside by a heat CVD method under an atmosphere of a mixture gas composed of a DMAH gas serving as the alkyl aluminum hydride and a hydrogen gas. A gas containing Si atoms or the like may, of course, be introduced to selectively deposit a metal film having Al such as Al—Si as the main component. Then, an Al film or a metal film having Al as the main component thereof is non-selectively formed on the selectively deposited Al and the insulating film by the sputtering method. Then, the metal film non-selectively deposited is patterned to be in the desired shape, so that the electrode and the wiring can be formed.

Then, description will be made specifically with reference to FIGS. 63 and 66(*a–d*). First, the substrate is prepared, which has, for example, an insulating film in which openings having desired diameters are formed in a single-crystal wafer thereof.

Figure 66A:
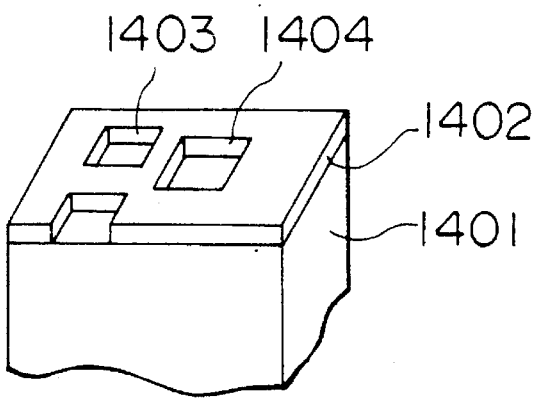
FIGS. 66(*a–d*) are schematic view which illustrates a process of forming the deposited film for use in the process of fabricating the recording head according to the present invention.

FIG. 66A is a schematic view which illustrates a portion of the aforesaid substrate. Referring to FIG. 66A, reference numeral 1401 represents a single-crystal substrate serving as a conductive substrate, and 1402 represents a thermally oxidized silicon film serving as the insulating film (layer).

The process of forming the Al film serving as the electrode of the first wiring layer will be arranged as follows to be described with reference to FIG. 63:

First, the aforesaid substrate is placed in the load lock chamber 1311. The load lock chamber 1311 is made to be a hydrogen atmosphere by introducing hydrogen as described above. Then, the reaction chamber 1312 is exhausted to have a pressure of about $1\times10^{-8}$ Torr by the exhaust system 1316*b*. However, if the degree of vacuum in the reaction chamber is inferior to $1\times10^{-8}$ the Al film can be formed.

Then, the DMAH gas subject to the bubbling process is supplied from the gas line 1319. As the carrier gas for the DMAH line, $H_2$ is used.

The second gas line 1319' is a line through which $H_2$ passes as the reaction gas. The $H_2$ gas is passed through the second gas line 1319' and the degree of opening of a slow-leak valve (omitted from illustration) is adjusted so as to make the pressure in the reaction chamber 1312 to be a predetermined level. In this case, it is preferable that the typical pressure be 1.5 Torr. Then, the DMAH is introduced into the reaction tube from the DMAH line. The total pressure is made to be about 1.5 Torr and the divided pressure of the DMAH is made to be about $5.0\times10^{-3}$ Torr. Then, electricity is supplied to the halogen lamp 1330 so as to directly heat the wafer. Thus, Al is selectively deposited.

After a predetermined deposition time has passed, the supply of the DMAH is temporarily stopped. The term "predetermined deposition time" for the Al film used hereinbefore is meant a time taken for the thickness of the Al film on the Si (single-crystal silicon substrate) to become the same as the thickness of the $SiO_2$ (thermally oxidized silicon film) and it can be previously obtained from the result of an experiment.

Figure 66B:
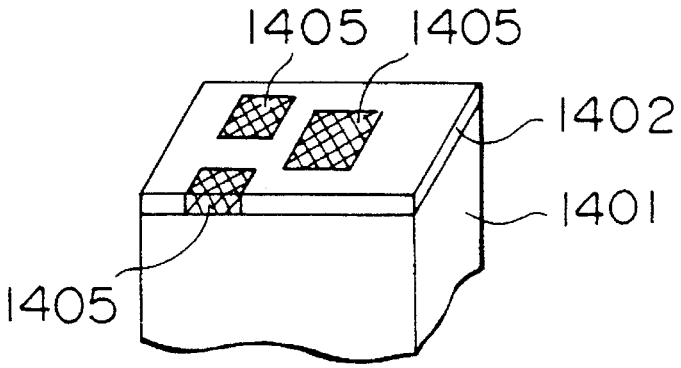
Figure 66C:
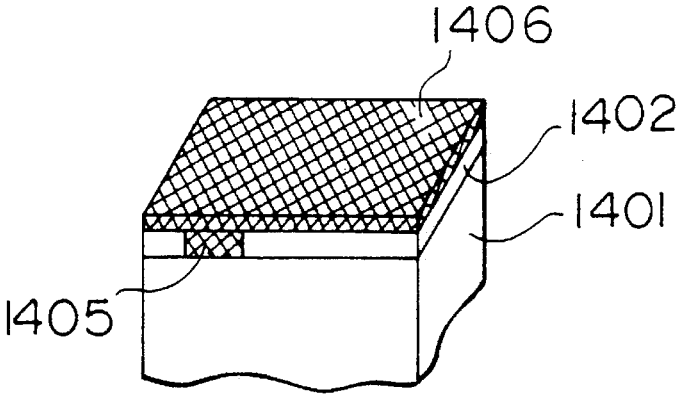

The temperature of the surface of the substrate realized by the direct heating operation is determined to be about 270° C. As a result of the process performed as described above, the Al film 1405 is selectively deposited in the opening as shown in FIG. 66B.

The aforesaid process is called a first film forming process for forming the electrode in the contact hole.

After the aforesaid first film forming process has been completed, the pressure in the CVD reaction chamber 1312 is lowered to make the degree of vacuum to be $5\times10^{-3}$ Torr or lower by the exhaust system 1316*b*. Simultaneously, the pressure of the RF etching chamber 1315 is lowered to $5\times10^{-6}$ Torr or lower. After the pressure of each of the aforesaid two chambers has been lowered to the above-mentioned degree of vacuum, the gate valve 1310*c* is opened to move the substrate into the RF etching chamber 1313 from the CVD reaction chamber 1312 by the conveyance means. Then, the gate valve 1310*c* is closed, and the substrate is conveyed to the RF etching chamber 1313, and then the pressure in the RF etching chamber 1313 is lowered to make the degree of vacuum to be $10^{-6}$ Torr or lower by the exhaust system 1316*c*. Then, Ar is supplied through the RF etching Ar supply line 1322 so as to maintain the Ar atmosphere of the RF etching chamber 1313 at $10^{-1}$ to $10^{-3}$ Torr. The temperature of the RF etching substrate holder 1320 is maintained at about 200° C., an RF power of 100 W is supplied to the RF etching electrode 1321 for about 60 seconds, and the RF etching chamber 1313 is caused to discharge Ar. As a result of this, the surface of the substrate is etched by Ar ions and the unnecessary portions of the CVD deposited film can be removed. In this case, the depth of the etching is made to be about 100 Å converted by an oxide. Although etching of the surface of the CVD deposited film is performed in the RF etching chamber, the RF etching may be omitted because the surface layer of the CVD film of the substrate which is being conveyed in a vacuum atmosphere does not contain oxygen or the like. In this case, the RF etching chamber 1313 serves as a temperature-changing chamber for changing the temperature in a short time if the temperature of the CVD reaction chamber 1312 and that of the sputter chamber 1314 is considerably different.

After the RF etching process has been completed in the RF etching chamber 1313, the introduction of Ar is stopped and Ar in the RF etching chamber 1313 is discharged. The pressure in the RF etching chamber 1313 is lowered to $5\times10^{-6}$ Torr and as well as the pressure in the sputter chamber 1314 is lowered to $5\times10^{-6}$ Torr. Then, the gate valve 1310*d* is opened, and then the substrate is moved from the RF etching chamber 1313 to the sputter chamber 1314 by using the conveyance means before the gate valve 1310*d* is closed.

After the substrate has been conveyed to the sputter chamber 1314, the sputter chamber 1314 is made to be the Ar atmosphere the pressure of which is $10^{-1}$ to $10^{-3}$ Torr similarly to the RF etching chamber 1313. Furthermore, the substrate holder 1323 is set to a temperature level of about 200° to 250° C. Then, the Ar discharge is performed with a DC power of 5 to 10 kw to cut the target materials such as Al and Al—Si (Si: 0.5%) and the metal such as Al and Al—Si is deposited at a deposition speed of about 10,000 Å/minute on the substrate. The above-described process is a non-selective deposition process, which is called a "second film forming process" for forming the wiring to be connected to the electrode.

After a metal film about 5000 Å thick has been formed on the substrate, the introduction of the Ar flow and the application of the DC power are stopped. Then, the pressure of the load lock chamber 1311 is lowered to $5\times110^{-3}$ Torr or lower, and then the substrate is moved by opening the gate valve 1310*e*. After the gate valve 1310*e* has been closed, an $N_2$ gas is introduced into the load lock chamber 1311 until its pressure reaches the atmospheric pressure. Then, the gate valve 1310*f* is opened so as to discharge the substrate outside the apparatus.

Figure 66D:
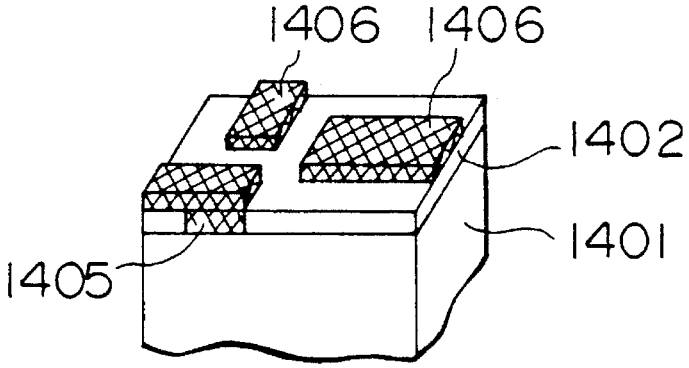

As a result of the second Al-film deposition process, the Al film 1406 can be formed on the $SiO_2$ film 1402 as shown in FIG. 66D, so that a desired wiring can be formed.

Experimental Examples

Then, the advantages of the aforesaid Al-CVD method and the high quality of the Al deposited in the opening realized by this method will now be described with the results of experiments.

First, the surface of an N-type single crystal silicon wafer was, as the substrate, oxidized by heat so that $SiO_2$ which was 8,000 Å thick was formed. Then, a plurality of samples, in which openings, the size of which was varied from 0.25 μm×0.25 μm square to 100 μm×100 μm, were formed by patterning and the base Si single crystal portion was allowed to appear outside, were prepared (Sample 1-1).

Then, the Al film was formed on each of the samples by the Al-CVD method under the following conditions. The common conditions were determined as follows: the raw material gas was DMAH, hydrogen was used as the reaction gas, the total pressure was made to be 1.5 Torr and the divided pressure for the DMAH was $5.0\times10^{-3}$ Torr. Furthermore, the electricity to be supplied to the halogen lamp was adjusted and the surface temperature of the substrate was made to be in a range from 200° C. to 490° C. by the direction heating operation so that the film was formed.

The results were as shown in Table 1.

TABLE 1

| Temperature of Substrate Surface (°C.) | 200 | 230 | 250 | 260 | 270 | 280 | 300 | 350 | 400 | 440 | 450 | 460 | 470 | 480 | 490 |
|---|---|---|---|---|---|---|---|---|---|---|---|---|---|---|---|
| Deposition speed (Å/min) ○ . . . 1000 to 1500 ◎ . . . 3000 to 5000 | ○ | ○ | ○ | ◎ | ◎ | ◎ | ◎ | ◎ | ◎ | ◎ | ◎ | ◎ | ◎ | ◎ | ◎ |
| Through-put (sheets/hour) ○ . . . 7 to 10 ◎ . . . 15 to 30 | ○ | ○ | ○ | ○ | ◎ | ◎ | ◎ | ◎ | ◎ | ◎ | ◎ | ◎ | ◎ | ◎ | ◎ |
| Line type defect of Si | Not Observed | | | | | | | | | | | | | | |
| Carbon Content | Not Detected | | | | | | | | | | | | | | |
| Resistance Ratio (μΩcm) ○ . . . 2.7 to 3.3 ◎ . . . 2.8 to 3.4 | ○ | ○ | ○ | ◎ | ◎ | ◎ | ◎ | ◎ | ◎ | ◎ | ○ | ○ | ○ | ○ | ○ |
| Reflectance (%) ○ . . . 85 to 95 ◎ . . . 90 to 95 Δ . . . 60 or less | ○ | ○ | ○ | ○ | ◎ | ◎ | ◎ | ◎ | ◎ | ◎ | Δ | Δ | Δ | Δ | Δ |
| Density of hillocks larger than 1 μm($cm^{-2}$) ○ . . . 1 to $10^2$ ◎ . . . 0 to 10 Δ . . . 10 to $10^4$ | ○ | ○ | ○ | ◎ | ◎ | ◎ | ◎ | ◎ | ◎ | ◎ | Δ | Δ | Δ | Δ | Δ |
| Generation of Spikes (%) (Probability of breakage of 0.15 μm junction) | 0 | 0 | 0 | 0 | 0 | 0 | 0 | 0 | 0 | 0 | 30 | 30 | 30 | 30 | 30 |

As can be understood from Table 1, Al was selectively deposited in the opening at a high deposition speed of 3000 to 5000 Å/minute in a case where the temperature of the surface of the substrate was 260° C. or higher by the direction heating operation.

The characteristics of the Al film formed in the opening in a case where the temperature of the surface of the substrate was ranged from 260° C. to 440° C. were examined, resulting in excellent characteristics to be observed such that no carbon was contained, the resistance ratio was 2.8 to 3.4 μΩcm, the reflectance was 90 to 95%, the density of hillocks which were 1 μm or more was 0 to 10, and the generation of the spikes (the probability of the breakage of the 0.15 μm junction) was substantially prevented.

If the temperature of the surface of the substrate was ranged from 200° C. to 250° C., the quality of the formed film was slightly inferior to that formed when the temperature was ranged from 260° C. to 440° C. but the quality was superior to the quality realized by the conventional technology. However, an unsatisfactory deposition speed of 1000 to 1500 Å/minute was realized and also a relatively low through-put of 7 to 10 sheets/hour was resulted.

If the temperature of the surface of the substrate was 450° C. or higher, the reflectance was 60% or less, the density of hillocks which were 1 μm or more was 10 to $10^4$ $cm^{-2}$ and the generation of the alloy spikes was 0 to 30%. As described above, the characteristics of the Al film in the opening deteriorated.

Then, the advantage of the aforesaid method when it is adapted to the contact hole or the through hole will now be described.

That is, it can be preferably adapted to a contact hole structure and a through hole structure made of the following material.

Under the same conditions as those when the Al film was formed on the sample 1-1, an Al film was formed on a substrate (sample) structured as follows:

By the CVD method, an oxidized silicon film was, as a second material for the surface of the substrate, formed on a single crystal silicon, which is a first material for the surface of the substrate. Then, the oxidized silicon film was patterned by the photolithography process, so that the surface of the single crystal silicon was partially allowed to appear outside.

The thickness of the thermally oxidized $SiO_2$ film was 8000 Å, and the size of the exposed portion of the single crystal silicon, that is the size of the opening was 0.25 μm×0.25 μm to 100 μm×100 μm. The thus made sample was called sample 1-2 (hereinafter samples thus prepared are abbreviated to "CVD$SiO_2$ (hereinafter abbreviated to $SiO_2$)/single crystal silicon").

Sample 1-3 was boron doped oxidized film (hereinafter abbreviated to "BSG") formed by the atmospheric pressure CVD/single crystal silicon, sample 1-4 was phosphorus doped oxidized film (hereinafter abbreviated to "PSG") formed by the atmospheric pressure CVD/single crystal silicon, sample 1-5 was phosphorus and boron doped oxidized film (hereinafter abbreviated to "BSPG") formed by the atmospheric pressure CVD/single crystal silicon, sample 1-6 was nitrized film (hereinafter abbreviated to "P-SiN") formed by the plasma CVD/single crystal silicon, sample 1-7 was thermally nitrized film (hereinafter abbreviated to "T-SiN")/single crystal silicon, sample 1-8 was nitrized film (hereinafter abbreviated to "LP-SiN") formed by pressure-reduced CVD/single crystal silicon and sample 1-9 was nitrized film (hereinafter abbreviated to "ECR-SiN") formed by an ECR apparatus/single crystal silicon.

Furthermore, the first materials (18 types) for the surface of the substrate and the second materials (9 types) for the surface of the substrate were combined to one another so that samples 1-11 to 1-179 (note: samples Nos. 1-10, 20, 30, 40, 50, 60, 70, 80, 90, 100, 110, 120, 130, 140, 150, 160 and 170 are missing Nos.) were fabricated. As the first material for the surface of the substrate, the following materials were used: single crystal silicon (single crystal Si), polycrystal silicon (polycrystal Si), amorphous silicon (amorphous Si), tungsten (W), molybdenum (Mo), tantalum (Ta), tungsten silicide (WSi), titanium silicide (TiSi), aluminum (Al), aluminum silicon (Al—Si), titanium aluminum (Al—Ti), titanium nitride (Ti—N), copper (Cu), aluminum silicon copper (Al—Si—Cu), aluminum palladium (Al—Pd), titanium (Ti), molybdenum silicide (Mo—Si) and tantalum silicide (Ta—Si) were used. As the second material for the surface of the substrate, T-$SiO_2$, $SiO_2$, BSG, PSG, BPSG, P-SiN, T-SiN, LP-SiN, and ECR-SiN were used. Also an excellent Al film similarly to the sample 1-1 was formed on the aforesaid samples.

Then, Al was non-selectively deposited by the sputtering method on the substrate on which Al has been selectively deposited.

As a result, the Al film formed by the sputtering method and the Al film selectively deposited in the opening were in a contact state exhibiting excellent electrical and mechanical durability because the Al film in the opening has excellent surface characteristics.

Experimental Example 1

An ink jet recording head was fabricated by a method according to the aforesaid first embodiment. An oxidized silicon film was formed on the surface of an Si wafer by the sputtering method to have a thickness of 1 μm.

Then, a hafnium boride serving as a heat-generating resistance layer 3 was formed by the sputtering method to have a thickness of 0.1 μm.

Then, an Al film was formed by the electron beam evaporating method to have a thickness of 0.5 μm in order to form the electrode 14.

The heat-generating resistance layer 3 and the Al film 14 were formed into a pattern shown in FIG. 9 by etching, so that the electro-thermal transducer (14, 18) was formed.

A silicon oxide film 1 μm thick was formed by the sputtering method. Then, a contact hole 5 was formed in the silicon oxide film 8 by etching.

Then, Al which was 1 μm thick was deposited in the contact hole while setting the temperature of the substrate to be 250° C. by the CVD method in which DMAH and hydrogen were used.

The Al film which was 0.5 μm thick was again formed by the electron beam evaporating method. Then, the Al film 4 was formed into the desired wiring shape by patterning. Then, the silicon oxide which was 0.6 μm thick was formed by the sputtering method. Thus, a recording head substrate having a double-layer wiring structure made of Al was fabricated. Then, the ceiling board represented by reference numeral 13 shown in FIG.9 was bonded, so that a plurality of samples of the recording head shown in FIG. 10 were fabricated.

Comparative Example 1

A recording head substrate was fabricated by the processes of the aforesaid Experimental Example 1 but the process of selectively depositing Al was omitted. Then, the ceiling board 13 was bonded, so that a recording head (sample C11) was fabricated. By the same process as that described above, a plurality of samples (sample C12) of the recording head arranged in such a manner that the thickness of the Al film 4 was made to be in a range from 0.2 μm to 3 μm and the thickness of the silicon oxide film 26 was made to be in a range from 0.6 μm to 2 μm.

As a result of the comparison made between the recording head according to Experimental Example 1 and that according to Comparative Example 1, the following effects were confirmed:

(1) Since the stepped portion between the through hole and the insulating protection layer could be eliminated, an excellent step coverage could be obtained. Therefore, the thickness of the Al film 4 could be reduced from 2 μm, which was required in the comparative example to 0.1 μm or less and the disconnection of the electrode portion could be decreased.

(2) Because of the same reason as (1), the thickness of the protection film 26 was reduced from 1.5 μm, which was required in the comparative example, to 0.75 μm. Furthermore, the defects of the film such as the pinhole could be reduced.

(3) The Al film formed by the CVD method according to Experimental Example 1 showed a low resistance ratio of 0.7 to 3.4 μΩ·cm because it had excellent crystallinity as compared with the polycrystal Al film formed by the conventional sputtering method or the electron beam evaporating method. Therefore, a large quantity of electric currents could be passed. Furthermore, since Al could be selectively deposited in the through hole portion, the aspect ratio could be enlarged.

Experimental Example 2

Figure 13:
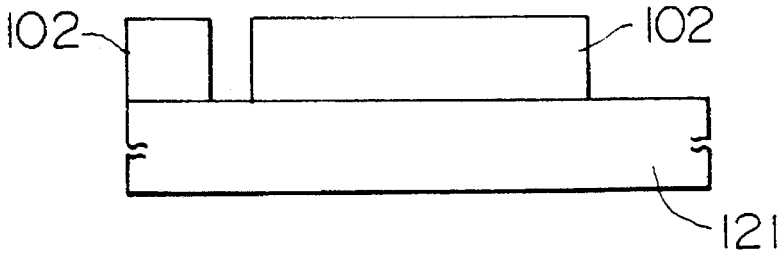
FIGS. 13(*a–e*) are schematic views which illustrate a process.
Figure 13:
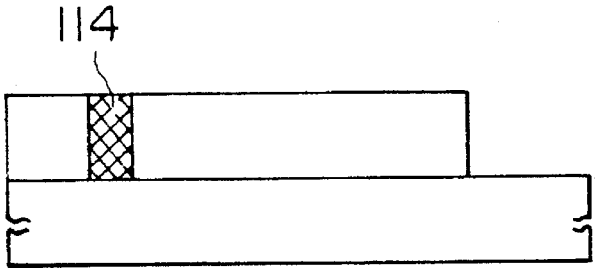
Figure 13:
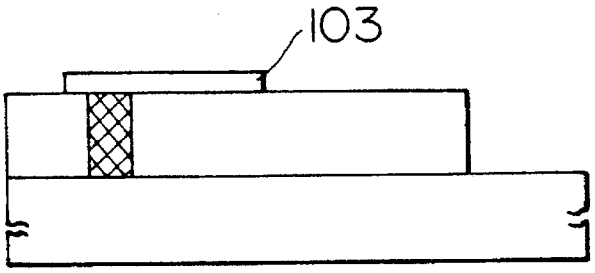
Figure 13:
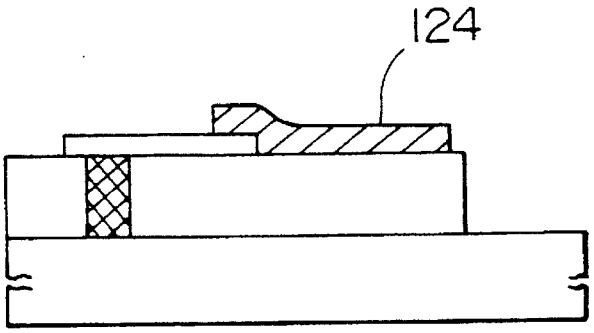
Figure 13:
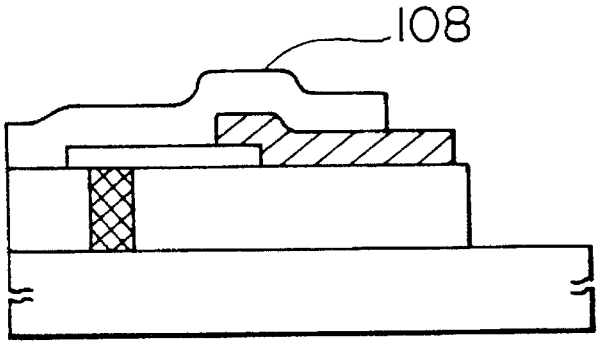

Then, an ink jet recording head was fabricated by the method according to the second embodiment as shown in FIG. 13.

First, as the heat regenerating layer, the silicon oxide film 102, which was the material which does not give electrons and which was 1.0 μm thick, was formed on the entire surface of the substrate 121 made of Al which was 2.0 mm thick and which was the material which gives electrons by the sputtering method. Then, the resist was applied and the through hole was formed by patterning. Then, unnecessary portions were removed.

Then, dimethylalkyl hydride (DMAH) was used as the raw material and Al was deposited to have the same thickness as that of the heat regenerating layer (the $SiO_2$ film) by the CVD method in which hydrogen was used as the reaction gas under the conditions that total gas pressure was 1.5 Torr, the divided pressure of DMAH was $10^{-2}$ Torr, and the temperature at which the film was formed was 270° C. As a result of the observation of the state of the deposition, a fact was found that Al was selectively deposited on only the portion in which the Al substrate 121, which was the material which does not give electrons, was allowed to appear outside, but Al was not deposited on the silicon oxide film 102 which does not give electrons. Under the aforesaid conditions, the film forming speed was 800 Å/min.

Then, $HfB_2$ was deposited on the entire surface by the sputtering method to have a thickness of 1000 Å, so that the heat-generating resistance layer 103 was formed. On this heat-generating resistance layer 103, a Ti film (omitted from illustration), which was 50 Å thick, was formed so as to improve the contact facility with the electrode. Then, 48 heat-generating resistor patterns, the size of each of which was 24 μm×60 μm, were formed at a pitch of 42 μm (which corresponds to a pixel density of 600 dpi) by the patterning process.

Then, Al was deposited to have a thickness of 5000 Å by the sputtering method so that individual electrodes were formed. Then, patterning was performed, so that the electrode 124 was formed.

Then, the silicon oxide film 108 was formed to have a thickness of 1.0 μm as the protection layer for protecting the heat-generating resistance layer 103 and the electrode 124, and then patterning was performed so as to remove unnecessary portions.

The substrate having the heat-generating resistance device array, that is, the ink jet recording head substrate and the ceiling board were aligned and connected to each other, the ceiling board having the liquid passage wall and the groove for forming the ink discharge ports. Then, the common liquid chamber for supplying the recording liquid to the liquid passage which is the working chamber was formed. The liquid supply pipe was connected to the common liquid chamber as a desired manner and the recording liquid was introduced from outside the recording head through the liquid supply pipe. Thus, the ink jet recording head was fabricated.

The ink jet recording head according to this embodiment was mounted on a driving device and a rectangular wave of 5 μsec was applied at 20 V and 5 KHz, so that the recording liquid (water: 70 parts, diethyleneglycol: 28 parts, water soluble dye: 2 parts) was discharged. As a result, the recording liquid was extremely stably discharged and the obtained image of the record was satisfactorily precise while exhibiting excellent characteristics in the continuous discharge of the recording liquid. Furthermore, no defect was observed in the through hole portion after the experiment has been completed in which 100,000,000 pulses were applied.

Experimental Example 3

In this example, similarly to Experimental Example 2, the silicon oxide film 102 serving as the heat regenerating layer was, by the sputtering method, formed on the entire surface of the substrate 121 made of Al. Then, the resist was applied and the through hole was formed by patterning. Then, the Al film 114 was deposited in the through hole by the Al-CVD method.

According to Experimental Example 2, the heat-generating resistance layer 103 was formed to have a thickness of 2500 Å by the sputtering method in which an alloy target made of Al, Ta and Ir was used. The difference from the Experimental Example 2 lies in that the arrangement made in such a manner that the heat-generating resistance layer 103 directly comes in contact with the recording liquid.

Then, Au was deposited to have a thickness of 5000 Å by the electron beam evaporating method, so that individual electrodes were formed. Then, patterning was performed, so that the electrode pattern 124 was formed. Reference numeral 101 represents a heat effecting surface.

Then, an ink jet recording head was fabricated by the similar method as that according to Experimental Example 2.

The ink jet recording head thus fabricated was mounted on an electric drive apparatus and the recording liquid was discharged similarly to Experimental Example 2, resulting in that the recording liquid could be significantly stably discharged. Furthermore, the temperature rise at the time of supplying electricity to the ink jet recording head could be halved as compared with the Experimental Example 2. In addition, the electric power consumption was measured, resulting in 0.35 $mW/\mu m^2$ per unit area of the heat-generating resistance layer, the value being about 45% of that realized in Experimental Example 2. Thus, the electric power consumption could be reduced.

Experimental Example 4

A recording head was fabricated by the process according to the third embodiment.

The recording head thus fabricated exhibited excellent durability.

Experimental Example 5

A recording head was fabricated by the process according to the eleventh embodiment.

First, a substrate constituted by an $SiO_2$ layer which was 2.5 μm thick formed on an Si substrate was prepared. Then, under the conditions shown in Table 2, the heat-generating resistance layer 502, the first protection layer 509, the electrode 514, the second protection layer 507 and the cavitation-resisting layer 508 were formed. The heat-generating portion was formed into a rectangular shape which was 30 μm wide and 150 μm long.

Furthermore, the ceiling board 13 arranged as shown in FIG. 53 was fabricated by the process according to the eleventh embodiment.

The ceiling board 13 and the substrate 521 on which the heat-generating portion was formed were applied to each other, so that the recording head as shown in FIG. 54 was fabricated.

The recording head thus fabricated exhibits the capability of reducing the electric power consumption by about 30% as compared with the conventional head. In addition, the heat responsibility was improved by about 30%. Since it can be driven with a shorter pulse width than the conventional pulse width, the durability was improved. Also the bubble forming stability was improved since it was driven with a short pulse width, the recording liquid discharge stability was improved, and the quality of the result of the recording was improved.

TABLE 2

| | Material/Thickness | Film-Forming Method | Film Forming Conditions Etc. | |
|---|---|---|---|---|
| Heat-Generating Resistance Layer 502 | HfB2 130 nm | RF Sputtering | Base Pressure | $2 \times 10^{-4}$ Pa |
| | | | Sputter Gas | Ar |
| | | | Sputter Pressure | 0.4 Pa |
| | | | Substrate Temperature | 150° C. |
| | | | Film Forming Speed | 200 Å/min |
| | | | Film Thickness | 1300 Å |
| First Protection Layer 509 | SiO2 600 nm | RF Sputtering | Base Pressure | $2 \times 10^{-4}$ Pa |
| | | | Sputter Gas | Ar |
| | | | Sputter Pressure | 0.4 Pa |
| | | | Substrate Temperature | 150° C. |
| | | | Film Forming Speed | 200 Å/min |
| | | | Film Thickness | 6000 Å |
| Electrode 514 | Al 600 nm | Organic Metal CVD | Total Pressure | 200 Pa |
| | | | Raw Material Gas | DMAH (dimethyl aluminum hydride) |
| | | | DMAH Divided Pressure | 1.3 Pa |
| | | | Substrate Temperature | 270° C. |
| | | | Film Forming Speed | 500 Å/min |
| | | | Film Thickness | 6000 Å |

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed is:

1. A method of fabricating a head for an ink jet recording apparatus having an electro-thermal transducer for generating thermal energy for use to discharge ink, and a wiring portion electrically connected to said electro-thermal transducer, which comprises the steps of:

forming a first conductive layer on a substrate;

forming an insulating layer on said first conductive layer;

forming an opening portion in said insulating layer in which at least portion of said conductive layer is exposed therethrough;

forming a conductor in said opening portion by a selective deposition method; and forming a second conductive layer on said insulating layer and said conductive layer and connecting said first conductive layer and said second conductive layer to each other.

2. A method of fabricating a head for an ink jet recording apparatus having an electro-thermal transducer for generating thermal energy for use to discharge ink, and a wiring portion electrically connected to said electro-thermal transducer, which comprises the steps of:

forming an insulating layer on a substrate having a conductive surface;

forming an opening portion in said insulating layer in which said conductive surface is exposed therethrough;

embedding a conductor in said opening portion by a selective deposition method;

forming a heat-generating resistance layer on said conductor and a portion of said insulating layer to electrically connect said conductive surface to said heat-generating resistance layer; and forming a conductive layer connected to said heat-generating resistance layer on said insulating layer.

3. A method of fabricating a head for an ink jet recording apparatus having an electro-thermal transducer for generating thermal energy for use to discharge ink, and a wiring portion electrically connected to said electro-thermal transducer, which comprises the steps of:

forming a plurality of semiconductor regions defined by semiconductor junctions on the surface of a semiconductor substrate;

forming an insulating layer on said semiconductor substrate;

forming a plurality of opening portions in said insulating layer in each of which said semiconductor regions is exposed therethrough;

embedding conductors in said opening portions of said insulating layer by a selective deposition method; and forming a heat-generating resistance layer on a portion of said conductor and a portion of said insulating layer.

4. A method of fabricating a head for an ink jet recording apparatus having an electro-thermal transducer for generating thermal energy for use to discharge ink, and a wiring portion electrically connected to said electro-thermal transducer, wherein said wiring portion has a substrate having the surface of a semiconductor, an insulating layer formed on said substrate, and a heat-generating resistance layer formed on said insulating layer, and a pair of opening portion of said insulating layer are filled with conductors formed by a selective deposition method so that said heat-generating resistance layer is connected to said conductor.

5. A method of fabricating a head for an ink jet recording apparatus having an electro-thermal transducer for generating thermal energy for use to discharge ink, and a wiring portion electrically connected to said electro-thermal transducer, which comprises the steps of:

forming a pair of recessed portions in a substrate having an insulating surface;

forming a pair of conductors in a pair of said recessed portion by a selective deposition method, a pair of said conductors being substantially flat with respect to said surface; and forming a heat-generating resistance layer on a pair of said conductors and a portion of said surface.

6. A method of fabricating a head for an ink jet recording apparatus having an electro-thermal transducer for generating thermal energy for use to discharge ink, and a wiring portion electrically connected to said electro-thermal transducer, which comprises the steps of:

forming a heat-generating resistance layer on a substrate;

forming a pair of conductive layers on said heat-generating resistance layer;

forming an insulating layer on a pair of said conductive layers;

forming an opening portion in said insulating layer in which at least portion of said conductive layer is exposed therethrough; and forming a conductor in said opening portion by a selective deposition method.

7. A method of fabricating a head for an ink jet recording apparatus having an electro-thermal transducer for generating thermal energy for use to discharge ink, and a wiring portion electrically connected to said electro-thermal transducer, which comprises the steps of:

forming an undercoat layer on a substrate on the two sides of said heat-generating resistance layer for defining said electro-thermal transducer at an interval;

selectively depositing a conductor on said undercoat layer; and forming a protection layer on said conductor.

8. A method of fabricating a head for an ink jet recording apparatus according to any one of claims 1 to 7, wherein said selective deposition method is a chemical vapor deposition method.

9. A method of fabricating a head for an ink jet recording apparatus according to any one of claims 1 to 7 further comprising a step of injecting ink into an ink storing portion.

* * * * *

UNITED STATES PATENT AND TRADEMARK OFFICE

CERTIFICATE OF CORRECTION

PATENT NO. : 5,580,468

DATED : December 3, 1996

INVENTOR(S) : TAKASHI FUJIKAWA ET AL.

It is certified that error appears in the above-indentified patent and that said Letters Patent is hereby corrected as shown below:

TITLE PAGE, ITEM

[75] INVENTORS

Line 3, "Junichi Kohayashi;" should read --Junichi Kobayashi;--.

COLUMN 1

Line 34, "the applicant of the present invention has" should be deleted.
Line 49, "to simpler as" should read --simpler--.
Line 59, "no" should read --to--.

COLUMN 2

Line 63, "wire the" should read --wire and the--.

COLUMN 4

Line 39, "layers" should read --layer--.
Line 51, "layers" should read --layer--.

COLUMN 7

Line 35, "process;" should read --process of fabricating the recording head according to a second embodiment of the present invention;--.

UNITED STATES PATENT AND TRADEMARK OFFICE

CERTIFICATE OF CORRECTION

PATENT NO. : 5,580,468

DATED : December 3, 1996

INVENTOR(S) : TAKASHI FUJIKAWA ET AL.

It is certified that error appears in the above-indentified patent and that said Letters Patent is hereby corrected as shown below:

COLUMN 9

Line 4, "view which illustrates" should read --views which illustrate--.
Line 7, "view which illustrates" should read --views which illustrate--.
Line 25, "FIG. 57(a) and 57(b) are schematic view which illustrates" should read --FIGS. 57(a) and 57(b) are schematic views which illustrate--.
Line 26, "and" should read --a--.
Line 36, "view which illustrates" should read --views which illustrate--.
Line 56, "view which illustrates" should read --views which illustrate--.

COLUMN 10

Line 33, "a amolp-" should read --amorp- --.

COLUMN 13

Line 15, "medal" should read --metal--.
Line 39, "steel or," should read --steel, or--.

COLUMN 18

Line 36, "selective" should read --selectively--.
Line 42, "the each" should read --each--.

UNITED STATES PATENT AND TRADEMARK OFFICE

CERTIFICATE OF CORRECTION

PATENT NO. : 5,580,468

DATED : December 3, 1996

INVENTOR(S) : TAKASHI FUJIKAWA ET AL.

It is certified that error appears in the above-indentified patent and that said Letters Patent is hereby corrected as shown below:

COLUMN 19

Line 42, "the ground" should read --ground--.

COLUMN 20

Line 9, "in form." should read --uniform.--.

COLUMN 22

Line 12, "illustrates" should read --illustrate--.
Line 29, "in" should read --into--.
Line 30, "to" should be deleted.

COLUMN 25

Line 18, "ion" should read --on--.

COLUMN 26

Line 36, "the of the" should read --the flow of the--.

COLUMN 27

Line 6, "taken" should read --taking--.
Line 24, "brakes" should read --breaks--.
Line 31, "heal" should read --heat--.

UNITED STATES PATENT AND TRADEMARK OFFICE

CERTIFICATE OF CORRECTION

PATENT NO. : 5,580,468

DATED : December 3, 1996

INVENTOR(S) : TAKASHI FUJIKAWA ET AL.

It is certified that error appears in the above-indentified patent and that said Letters Patent is hereby corrected as shown below:

COLUMN 28

Line 7, "it is" should read --it is difficult to shorten the pulse width and therefore a limit.--.
Lines 8-9, " is present in improving the quality of the recorded result" should be deleted.

COLUMN 30

Line 44, "the half" should read --half--.

COLUMN 37

Line 10, "nucleate" should read --the nucleate--.

COLUMN 41

Line 62, "$1x10^{-8}$" should read --$1x10^{8}$,--.

COLUMN 49

Table 2, please insert attached after Table 2.

COLUMN 50

Line 3, "portion" should read --a portion--.
Line 63, "is" should read --are--.

UNITED STATES PATENT AND TRADEMARK OFFICE

CERTIFICATE OF CORRECTION

PATENT NO. : 5,580,468

DATED : December 3, 1996

INVENTOR(S) : TAKASHI FUJIKAWA ET AL.

It is certified that error appears in the above-indentified patent and that said Letters Patent is hereby corrected as shown below:

COLUMN 51

Line 11, "portion" should read --portions--.
Line 24, "portion" should read --portions--.

COLUMN 52

Line 8, "least" should read --least a--.

Signed and Sealed this

Tenth Day of June, 1997

Bruce Lehman

*Attest:*

BRUCE LEHMAN

*Attesting Officer*

*Commissioner of Patents and Trademarks*

| | Material/Thickness | Film-Forming Method | Film Forming Conditions Etc. | |
|---|---|---|---|---|
| Second Protection Layer 507 | $SiO_2$ 300 nm | RF Sputtering | Base Pressure | $2 \times 10^{-4}$ Pa |
| | | | Sputter Gas | Ar |
| | | | Sputter Pressure | 0.4 Pa |
| | | | Substrate Temperature | 150°C |
| | | | Film Forming Speed | 200Å/min |
| | | | Film Thickness | 3000Å |
| Cavitation-Resisting Layer 508 | Ta 500 nm | RF Sputtering | Base Pressure | $2 \times 10^{-4}$ Pa |
| | | | Sputter Gas | Ar |
| | | | Sputter Pressure | 0.4 Pa |
| | | | Substrate Temperature | 150°C |
| | | | Film Forming Speed | 200Å/min |
| | | | Film Thickness | 5000Å |